US008606132B2

(12) United States Patent
Tanimura et al.

(10) Patent No.: US 8,606,132 B2
(45) Date of Patent: Dec. 10, 2013

(54) IMAGE FORMING APPARATUS

(75) Inventors: Mihoko Tanimura, Osaka (JP); Kyosuke Taka, Osaka (JP); Hiroshi Kawano, Osaka (JP); Takashi Kikutani, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 138 days.

(21) Appl. No.: 13/043,116

(22) Filed: Mar. 8, 2011

(65) Prior Publication Data

US 2011/0243591 A1 Oct. 6, 2011

(30) Foreign Application Priority Data

Mar. 30, 2010 (JP) ..... 2010-079577
Oct. 27, 2010 (JP) ..... 2010-240840

(51) Int. Cl.
*G03G 15/01* (2006.01)
*G03G 15/08* (2006.01)

(52) U.S. Cl.
USPC ..... 399/54; 399/223

(58) Field of Classification Search
USPC ..... 399/54, 223
See application file for complete search history.

(56) References Cited

U.S. PATENT DOCUMENTS 5,032,904 A * 7/1991 Murai et al. ..... 358/500
6,352,806 B1 * 3/2002 Dalal ..... 430/45.4
6,535,712 B2 * 3/2003 Richards ..... 399/341
7,110,686 B2 * 9/2006 Toyohara ..... 399/45
7,310,484 B2 * 12/2007 Namba ..... 399/54
2002/0163570 A1 * 11/2002 Phillips ..... 347/224
2006/0110193 A1 * 5/2006 Emmert et al. ..... 399/341
2007/0196133 A1 * 8/2007 Kubo ..... 399/223

FOREIGN PATENT DOCUMENTS

JP 61170757 A * 8/1986
JP 10-171198 A 6/1998
JP 2005-3951 A 1/2005
JP 2005-167826 A 6/2005
JP 2006-251389 A 9/2006
JP 2007-57703 A 3/2007
JP 2007-127999 A 5/2007

* cited by examiner

*Primary Examiner* — Clayton E Laballe
*Assistant Examiner* — Jas Sanghera
(74) *Attorney, Agent, or Firm* — Birch, Stewart, Kolasch & Birch, LLP

(57) ABSTRACT

Provided is an image forming apparatus in which one of developing units that respectively contain visible toners of black, yellow, magenta, and cyan other than the developing unit that contains the visible toner of black is replaced by a developing unit that contains a transparent fluorescent toner. Consequently, a document image can be expressed by the visible toner of black and a designated color which falls within a color reproduction range determined by two of the visible toners of yellow, magenta, and cyan, and an additional pattern which is an additional information image for preventing falsification and forgery can be printed on the document image with the use of the transparent fluorescent toner.

12 Claims, 26 Drawing Sheets

FULL-COLOR (FOUR-COLOR) IMAGE

TWO-COLOR + TRANSPARENT FLUORESCENT COLOR IMAGE

IMAGE FORMING APPARATUS

This Nonprovisional application claims priority under 35 U.S.C. §119(a) on Patent Application No. 2010-079577 filed in Japan on Mar. 30, 2010, and Patent Application No. 2010-240840 filed in Japan on Oct. 27, 2010, the entire contents of which are hereby incorporated by reference.

TECHNICAL FIELD

The present invention relates to an image forming apparatus that can outputs an image that is difficult to falsify and forge.

BACKGROUND ART

Today, image forming apparatuses such as multifunction printing apparatuses (MFP apparatuses) are widely used as one of OA apparatuses related to information. Such image forming apparatuses can easily output (print) image information supplied from a host apparatus, such as a personal computer, connected to LAN. In addition, many image forming apparatuses have a scanner function, and therefore can easily copy a document.

However, there is a problem that such image forming apparatuses undesirably allow easy leakage of important information to an outside, although such image forming apparatuses conveniently allow easy printing and copying of image information. In view of this, various devices and methods for preventing leakage of information that occurs through printing and copying have been conventionally proposed.

For example, Patent Literature 1 discloses a technique of forming, on a recording sheet, an image created by adding an additional information image formed with the use of an invisible toner to an image formed with the use of a visible toner. The invisible toner is a toner which can hardly be observed under visible light, and is, for example, a toner containing a fluorescent substance that glows when irradiated by ultraviolet light.

As long as the additional information image is formed on a printed material with the use of an invisible toner, it is possible to judge whether the printed material is the original one or not by checking presence or absence of the additional information image. That is, a document on which the additional information image is formed is the original one, and a document on which the additional information image cannot be found is a copy (false document) of the original one. Moreover, even in a case where an original document is falsified, and then the document thus falsified is copied and even in a case where a digitalized original document is falsified, and then the document thus falsified is printed, an additional information image is removed from such documents. Accordingly, even in these cases, it is possible to judge whether a document is a falsified one or not by checking presence or absence of an additional information image.

CITATION LIST

Patent Literature 1

Japanese Patent Application Publication, Tokukai, No. 2006-251389 A (Publication Date: Sep. 21, 2006)

SUMMARY OF INVENTION

Technical Problem

However, according to the technique of Patent Literature 1, an invisible toner is used in addition to visible toners of yellow, magenta, cyan, and black. This requires five image forming stations to be provided around a photoreceptor drum.

Most full-color image forming apparatuses that are in widespread use today are the ones having four image forming stations corresponding to yellow, magenta, cyan, and black, respectively. One more increase in the number of image forming stations necessarily causes an increase in size of an image forming apparatus. Further, one more increase in the number of image forming stations makes it impossible to use existing full-color image forming apparatuses. For example, it is necessary to start again from designing as for components such as a housing and an intermediate transfer belt of an image forming apparatus.

Accordingly, the arrangement of the technique of Patent Literature 1 causes an increase in size and cost of an image forming apparatus, contrary to market demands for reduction in size and cost. As a result, efforts for reducing size and cost are required. Moreover, there is also a demand from users for development of a small and inexpensive image forming apparatus that can output an image that is difficult to falsify and forge.

Solution to Problem

The present invention was attained in view of the above problems, and an object of the present invention is to provide a small and inexpensive image forming apparatus that can output an image that is difficult to falsify and forge.

As a result of diligent studies, the applicant of the present application found that most documents, such as a document of settlement, an approval document, and a certificate, for which a user wants to prevent falsification and forgery (hereinafter referred to as "secret document") are not full-color images, but two-color (black and red) images. This is because, in countries, such as Japan and China, in which seals are used, most of the secret documents bear words written in black and a seal stamped in red (vermilion).

Further, the applicant of the present application thought that even in countries having no custom and culture of using seals, secret documents used in general company and corporation except for some types of business, such as business related to design, in which secret documents are often full-color images, need not to be full-color images.

In view of this, the applicant of the present application found that an additional image forming station is required because one persists in creation of a full-color image, and that if one does not persist in creation of a full-color image, it is possible to easily provide, by using a conventional full-color image forming apparatus, a small and inexpensive image forming apparatus that allows an additional information image to be printed with the use of an invisible toner. Based on this finding, the applicant of the present application attained the present invention.

In order to attain the above object, an image forming apparatus of the present invention in which four developing units can be provided, includes: a developing unit that contains an invisible toner which can hardly be observed under visible light; a developing unit that contains a visible toner of black; at least one developing unit that contains a visible toner of a chromatic color; first image processing means for creating print data for the visible toner of black and print data for the visible toner of the chromatic color with use of functions of full-color image processing means for creating, based on image data of a document image, print data for respective visible toners of black, yellow, magenta, and cyan; second image processing means for creating print data for the invisible toner on basis of image data of an additional information image; and an image forming section that forms toner images according to the image data of the document image with use of the print data for the visible toners which print data are created in the first image processing means, forms a toner image according to the image data of the additional information image with use of the print data for the invisible toner which print data is created in the second image processing means, and forms an image on a recording sheet from the toner images thus formed.

According to the arrangement, the first image processing means creates print data for the visible toner of black and print data for the at least one visible toner of the chromatic color with the use of the functions of the full-color image processing means. Further, the second image processing means creates print data for the invisible toner on the basis of the image data of the additional information image. Then, the image forming section reproduces the document image with the use of the visible toners on the basis of the print data for the visible toners thus created, and reproduces the additional information image with the use of the invisible toner on the basis of the print data for the invisible toner thus created.

Here, the document image is expressed by black and at least one chromatic color. In a case where two types of visible toners of different chromatic colors are mounted, the document image is expressed by black and a color that can be reproduced within a color reproduction range determined by a combination of the two chromatic colors. Meanwhile, the additional information image is expressed by the invisible toner.

The image forming apparatus of the present invention thus can form an image that is difficult to falsify and forge by adding an additional information image formed with the use of an invisible toner to a document image expressed by black and a color that can be reproduced within a color reproduction range determined by a combination of one or two chromatic colors although a full-color image of the document image cannot be reproduced.

Moreover, the number of developing units that can be mounted in the image forming apparatus of the present invention is four. Accordingly, it is possible to easily realize the image forming apparatus of the present invention except the first and second image processing means by an easy method of replacing, with a developing unit that contains an invisible toner, any one of developing units except a black developing unit, i.e., yellow developing unit, magenta developing unit, and cyan developing unit of a prevailing full-color image forming apparatus which includes four developing units.

Further, the first and second image processing means also can be realized just by changing software, for example, by loading an image processing program into an arithmetic processing section, including CPU etc., of a full-color image forming apparatus or by changing a printer driver of the image forming apparatus in addition to this.

Consequently, it is possible to provide a small and inexpensive image forming apparatus that can output an image that is difficult to falsify and forge in compliance with a users' demand.

In order to attain the above object, another image forming apparatus of the present invention in which four developing units can be provided, includes: full-color image processing means for creating, based on image data of a document image, print data for respective visible toners of black, yellow, cyan, and magenta; first image processing means for separating the image data of the document image into chromatic color data and achromatic color data, creating, based on the chromatic color data, print data for a visible toner of a chromatic color and creating, based on the achromatic color data, print data for the visible toner of black with use of functions of the full-color image processing means; second image processing means for creating, based on image data of an additional information image, print data for an invisible toner which can hardly be observed under visible light; and an image forming section that forms toner images, and forms an image on a recording sheet from the toner images thus formed, the image forming apparatus being switched between (i) a full-color mode in which developing units that contain visible toners of black, yellow, magenta, and cyan, respectively are mounted, and the image forming section forms toner images according to the image data of the document image with use of the print data for the visible toners which print data are created in the full-color image processing means, and forms a full-color image on a recording sheet from the toner images thus formed, and (ii) a transparent color mode in which at least one of the developing units used in the full-color mode other than the developing unit that contains the visible toner of black is replaced by a developing unit that contains the invisible toner, and the image forming section forms toner images according to the image data of the document image with use of the print data for the visible toners which print data are created in the first image processing means, forms a toner image according to the image data of the additional information image with use of the print data for the invisible toner which print data is created in the second image processing means, and forms an image on a recording sheet from the toner images thus formed.

According to the arrangement, by switching between the modes, an image forming apparatus can be used not only as a full-color image forming apparatus for creating a full-color image, but also as an image forming apparatus which can obtain an image that is difficult to falsify and forge on which an additional information image is formed with the use of an invisible toner.

Specifically, in the full-color mode, the developing units that contains visible toners of black, yellow, magenta, and cyan, respectively, are mounted, and print data for the visible toners of black, yellow, magenta, and cyan are created based on image data of a document image with the use of the full-color image processing means. Then, the image forming section forms a full-color image of the document image on a recording sheet with the use of the print data thus created.

Meanwhile, in the transparent color mode, a developing unit that contains the invisible toner is mounted in replacement of at least one of the developing units used in the full-color mode except the developing unit that contains the visible toner of black. Then, the first image processing means creates print data for the visible toner of black and print data for the visible toner of the chromatic color on the basis of the document image data, and the second image processing means creates print data for the invisible toner o the basis of the image data of the additional information image. Then, the image forming section forms, with the use of the print data thus created, a document image to which additional information is added.

This makes it unnecessary for a user of the image forming apparatus of the present invention and a service for providing the image forming apparatus to purchase a new one even in a case where work is changed from the one which more often requires secret documents to the one which more often requires full-color images. The user and the service can flexibly respond to such a change in work.

Each means of the image forming apparatus may be realized by a computer. In this case, a computer-readable storage medium in which a program for causing a computer to function as each means of the image forming apparatus so that the image forming apparatus is realized by the computer is stored is also encompassed in the scope of the present invention.

Advantageous Effects of Invention

According to the present invention, it is possible to provide a small and inexpensive image forming apparatus that can form an additional information image with the use of an invisible toner so that an image that is difficult to falsify and forge can be obtained.

Figure 2:
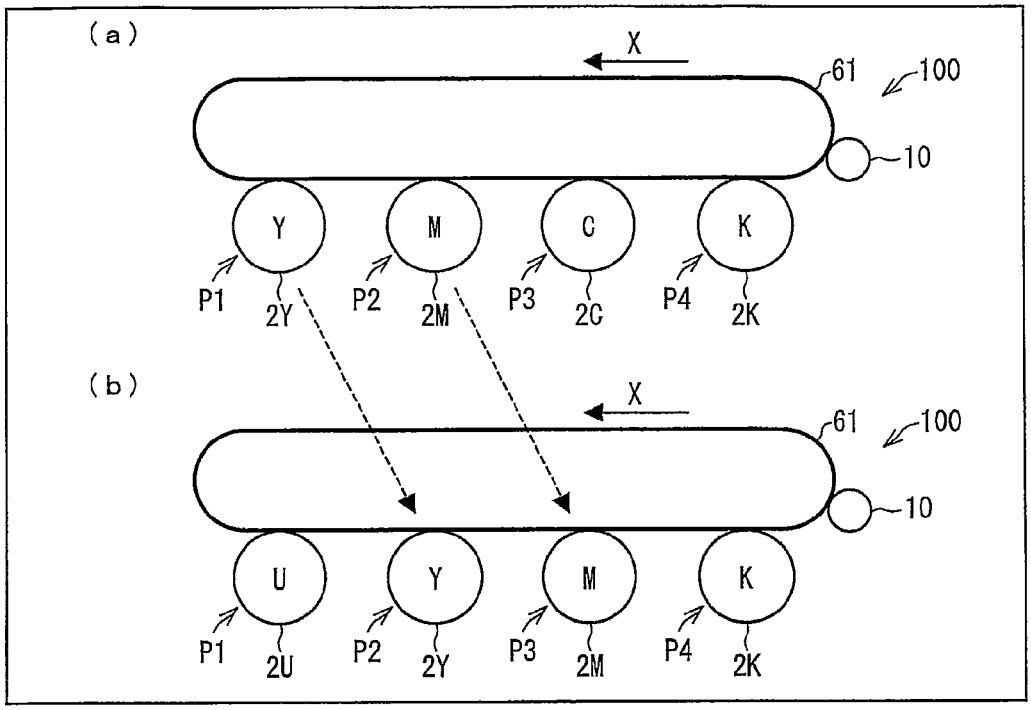

(a) of FIG. 2 is a view illustrating a preferable example of the way in which developing units are disposed in a case where the image forming apparatus of the Embodiment 1 is used for creation of a full-color image, and (b) of FIG. 2 is a view illustrating a preferable example of the way in which developing units are disposed in a case where the image forming apparatus of the Embodiment 1 is used for creation of a secret document.

Figure 3:
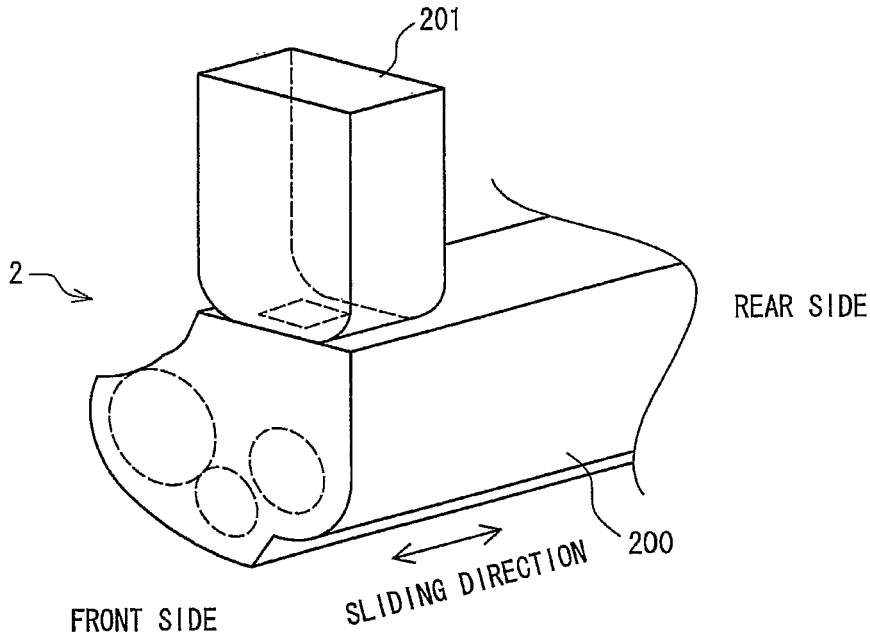

FIG. 3 is a perspective view illustrating an outline configuration of a developing unit provided in the image forming apparatus of the Embodiments 1 through 4.

Figure 4:
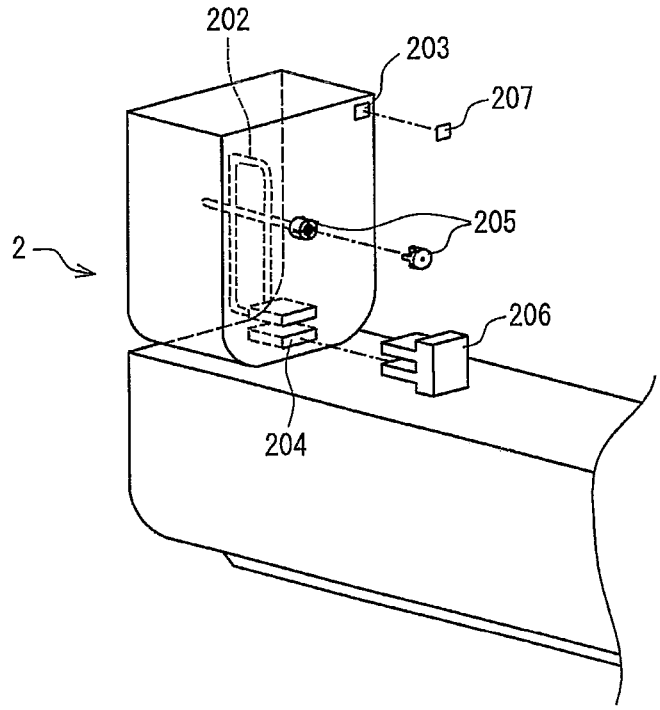

FIG. 4 is a perspective view illustrating an outline configuration of a developing unit provided in the image forming apparatus of the Embodiments 1 through 4.

Figure 5:
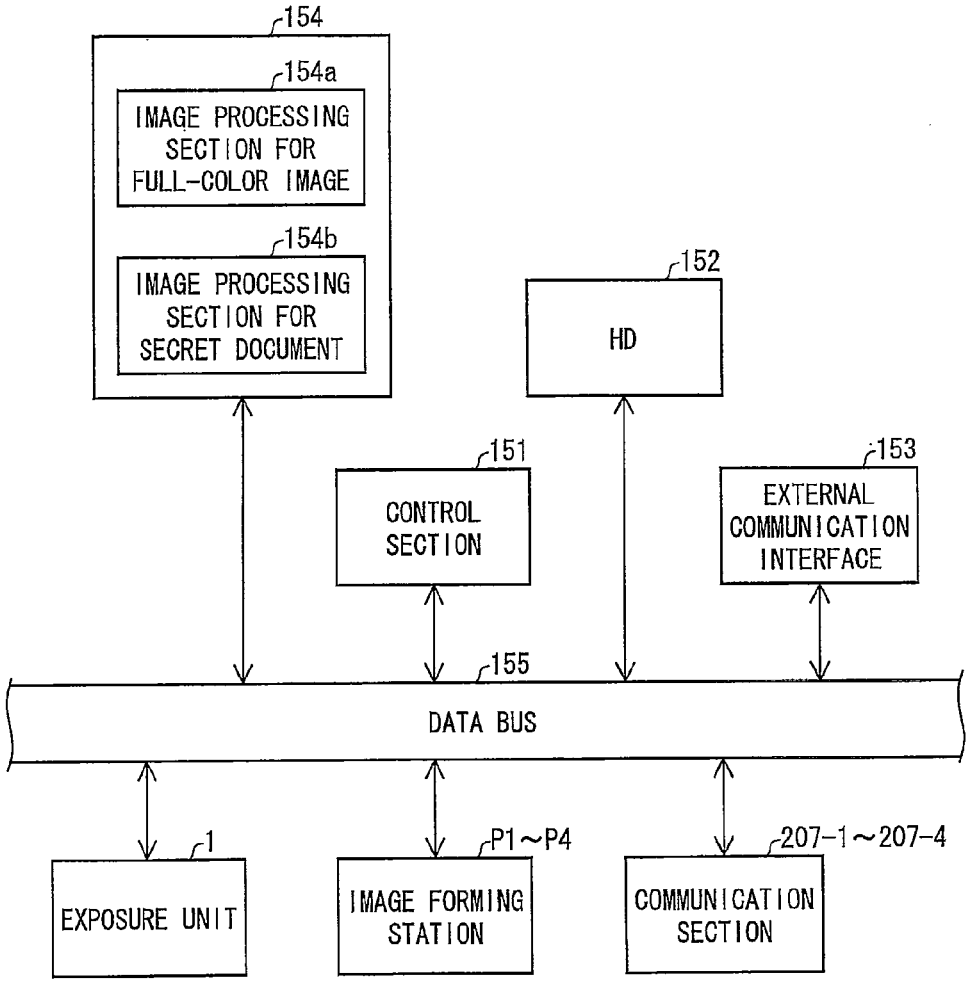

FIG. 5 is a block diagram illustrating a substantial part of a control system of the image forming apparatus of the Embodiments 1 through 4.

Figure 6:
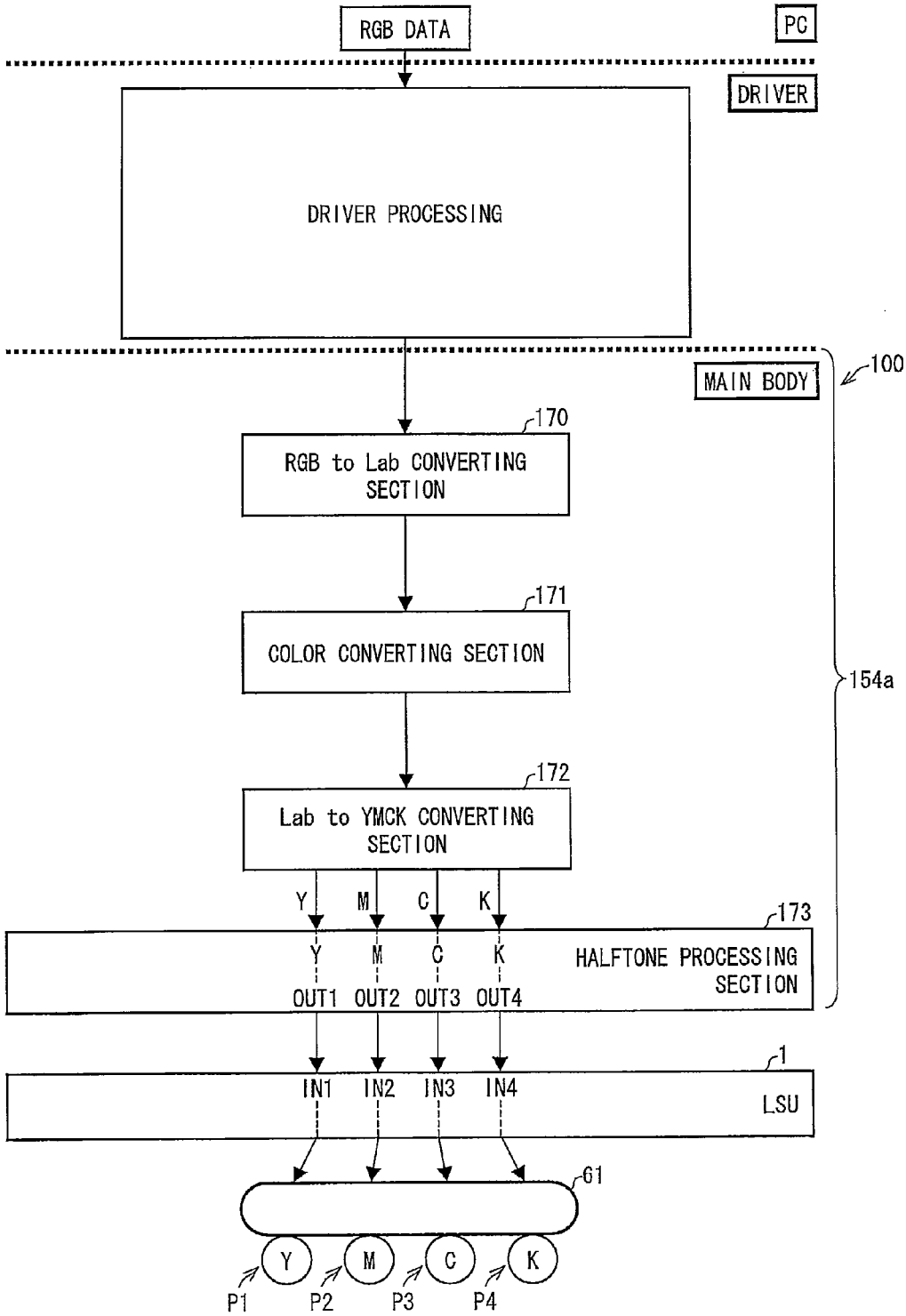

FIG. 6 is a view showing image processing carried out in a case where the image forming apparatus of the Embodiment 1 is used for creation of a full-color image.

Figure 7:
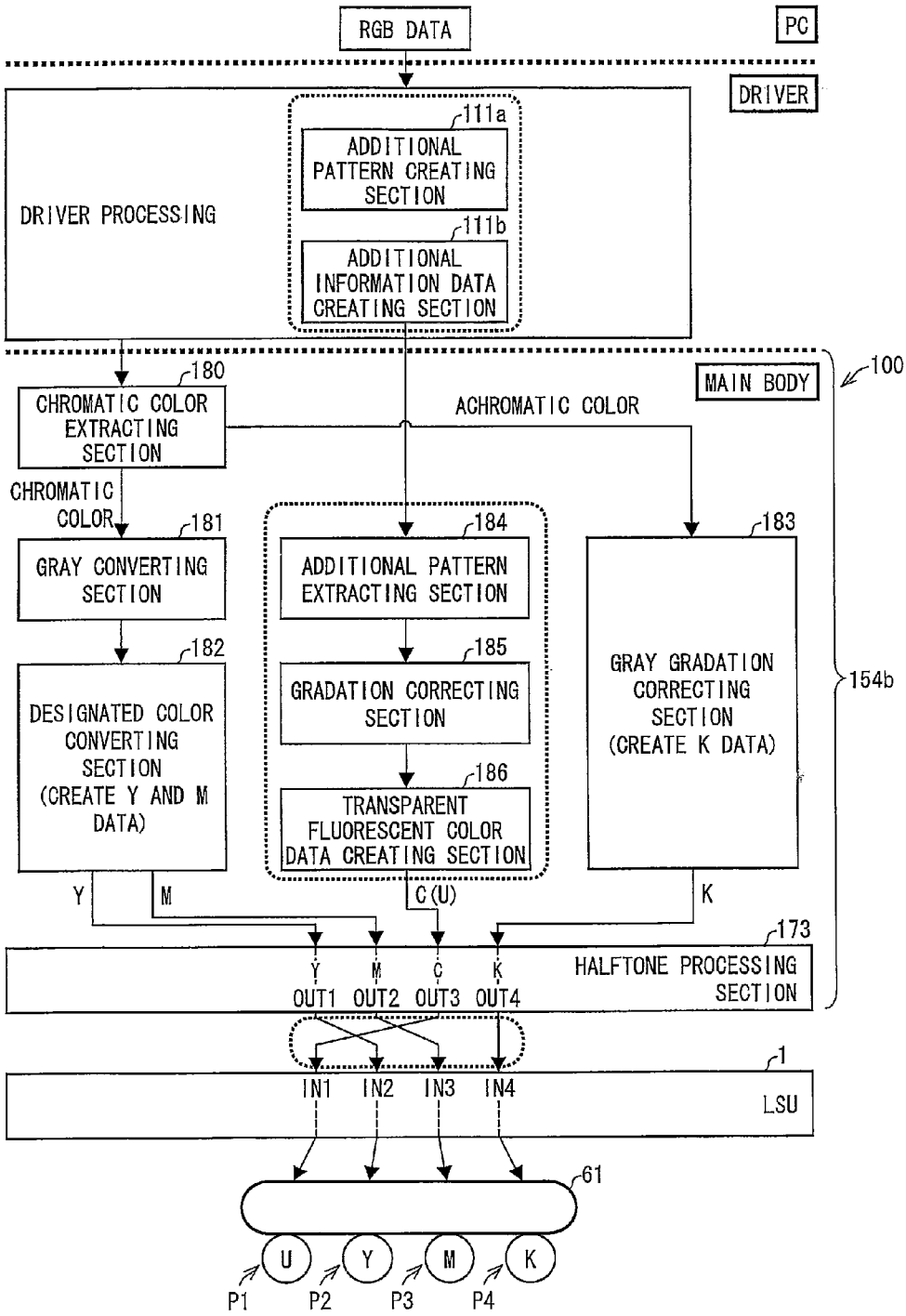

FIG. 7 is a view showing image processing carried out in a case where the image forming apparatus of the Embodiment 1 is used for creation of a secret document.

Figure 8:
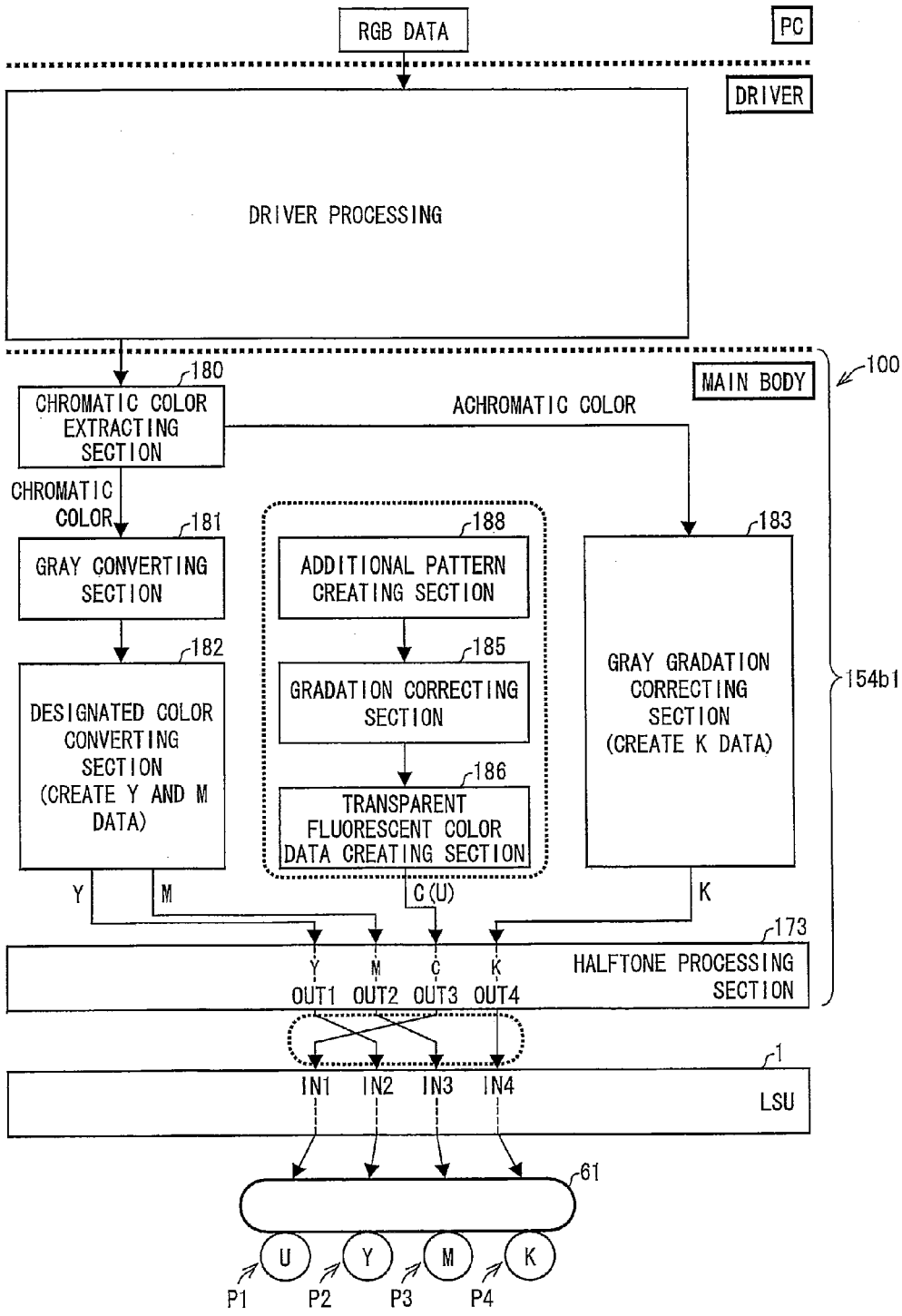

FIG. 8 is a view showing another image processing carried out in a case where the image forming apparatus of the Embodiment 1 is used for creation of a secret document.

Figure 9:
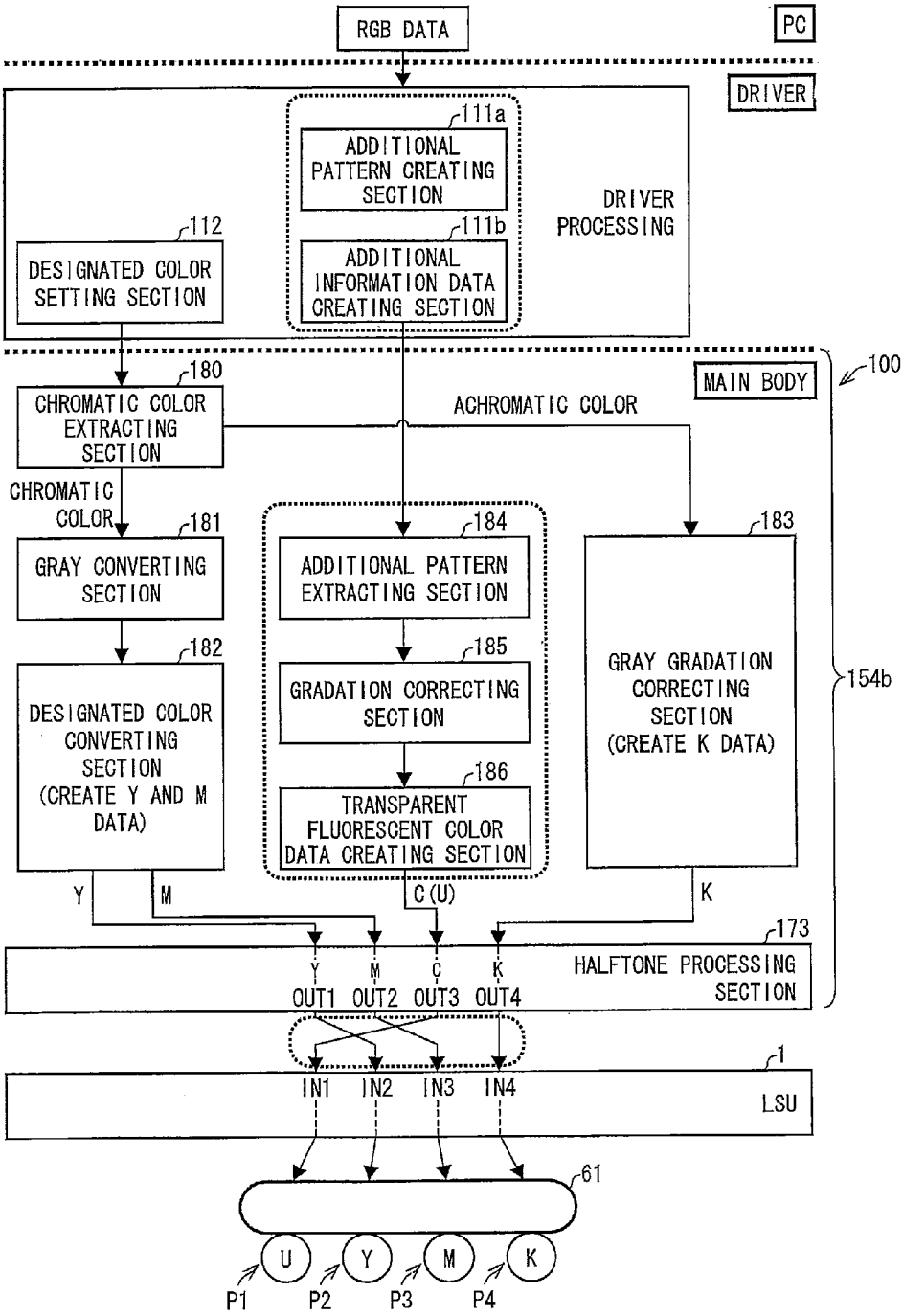

FIG. 9 is a view showing another image processing carried out in a case where the image forming apparatus of the Embodiment 1 is used for creation of a secret document.

Figure 10:
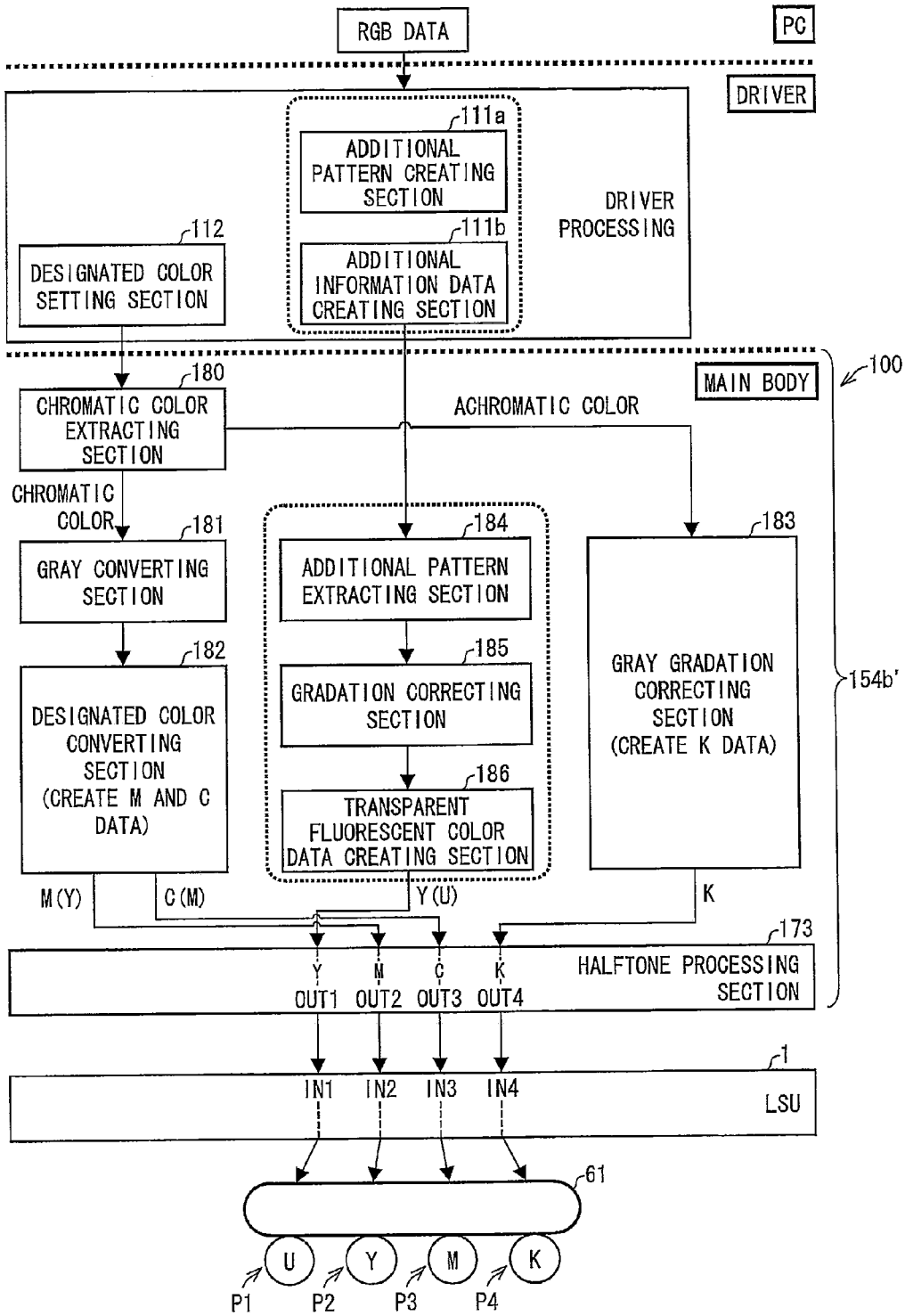

FIG. 10 is a view showing another image processing carried out in a case where the image forming apparatus of the Embodiment 1 is used for creation of a secret document.

Figure 11:
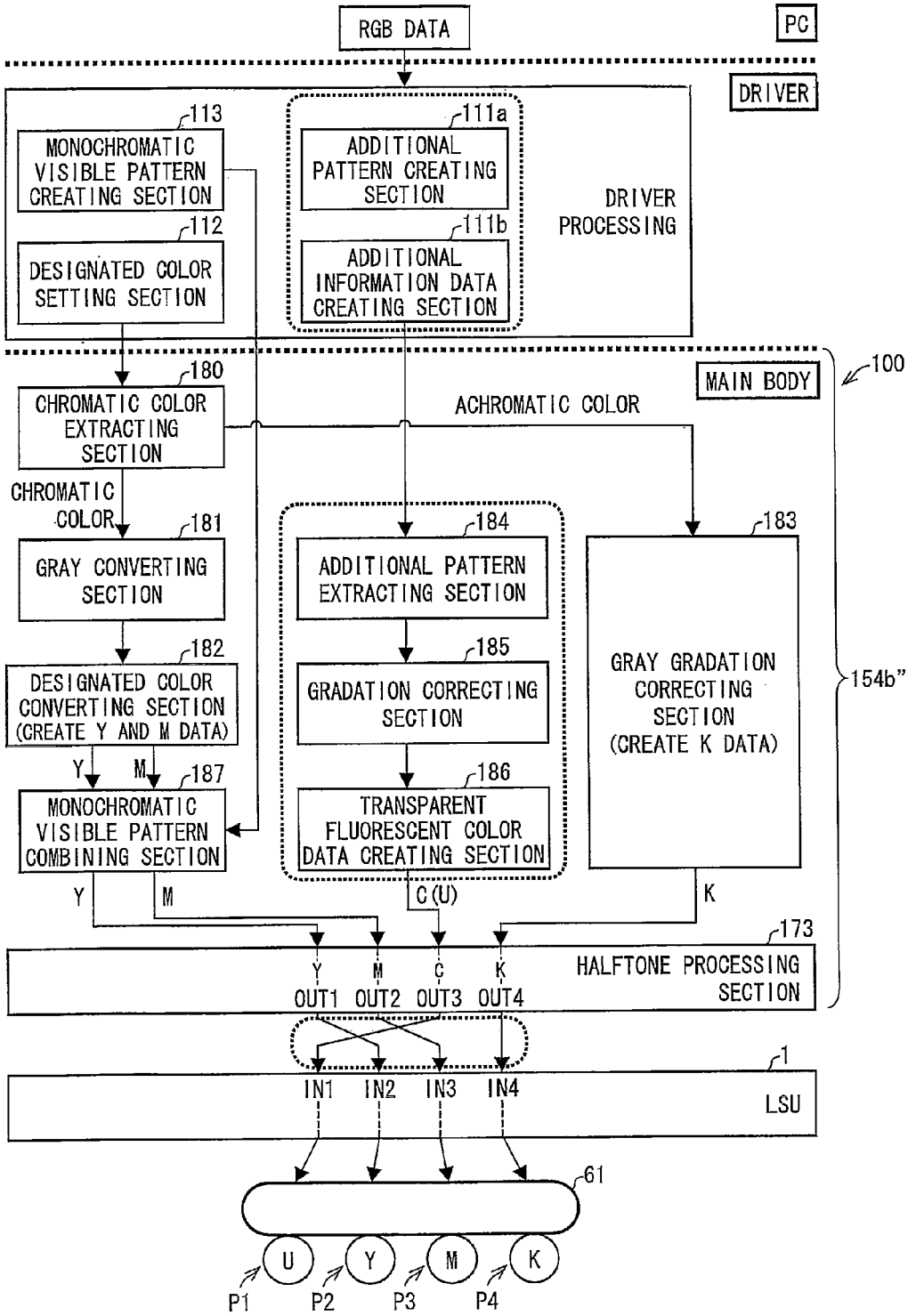

FIG. 11 is a view showing another image processing carried out in a case where the image forming apparatus of the Embodiment 1 is used for creation of a secret document.

Figure 12:
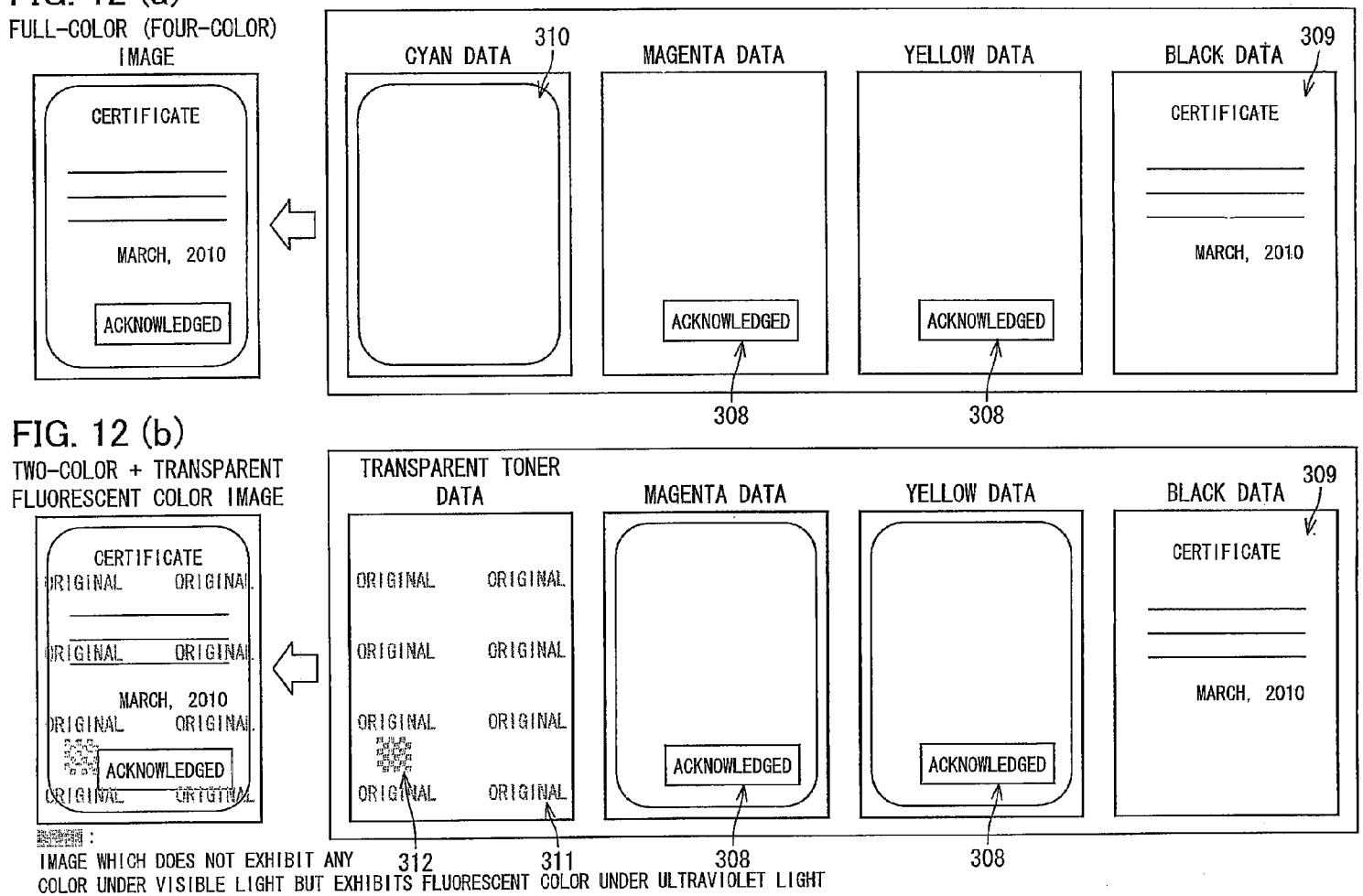

FIG. 12 (*a*) is a view illustrating an exemplary arrangement of print data and a printing result obtained in a case where the image forming apparatus is used for creation of a full-color image.

FIG. 12 (*b*) is a view illustrating an exemplary arrangement of print data and a printing result obtained in a case where the image forming apparatus is used for creation of a secret document.

Figure 13:
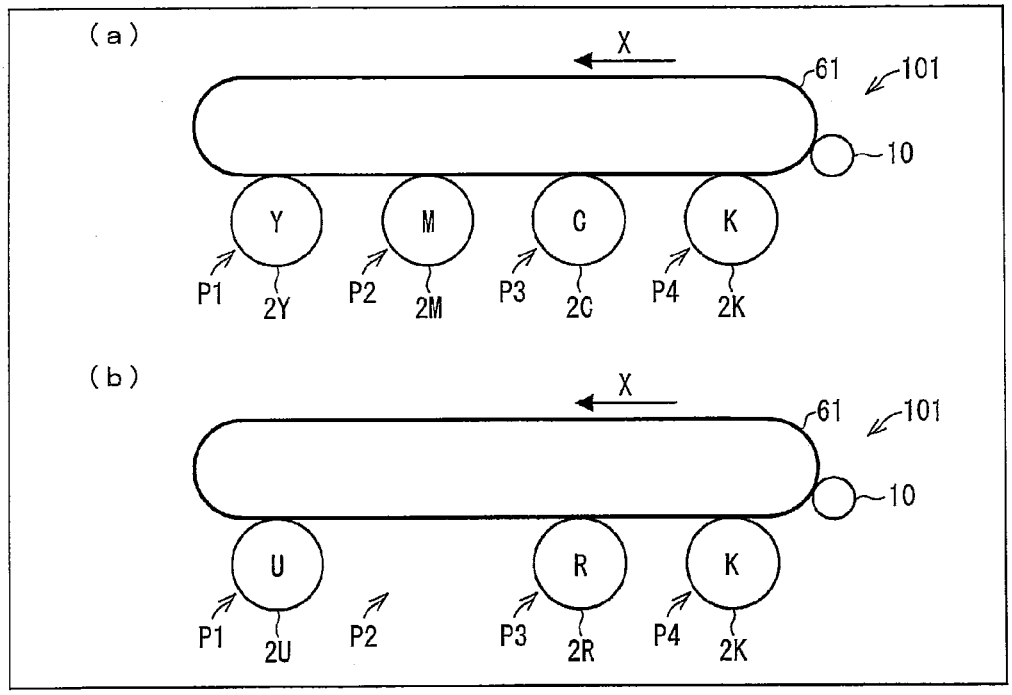

(a) of FIG. 13 is a view illustrating a preferable example of the way in which developing units are disposed in a case where the image forming apparatus of the Embodiment 2 is used for creation of a full-color image, and (b) of FIG. 13 is a view illustrating a preferable example of the way in which developing units are disposed in a case where the image forming apparatus of the Embodiment 2 is used for creation of a secret document.

Figure 14:
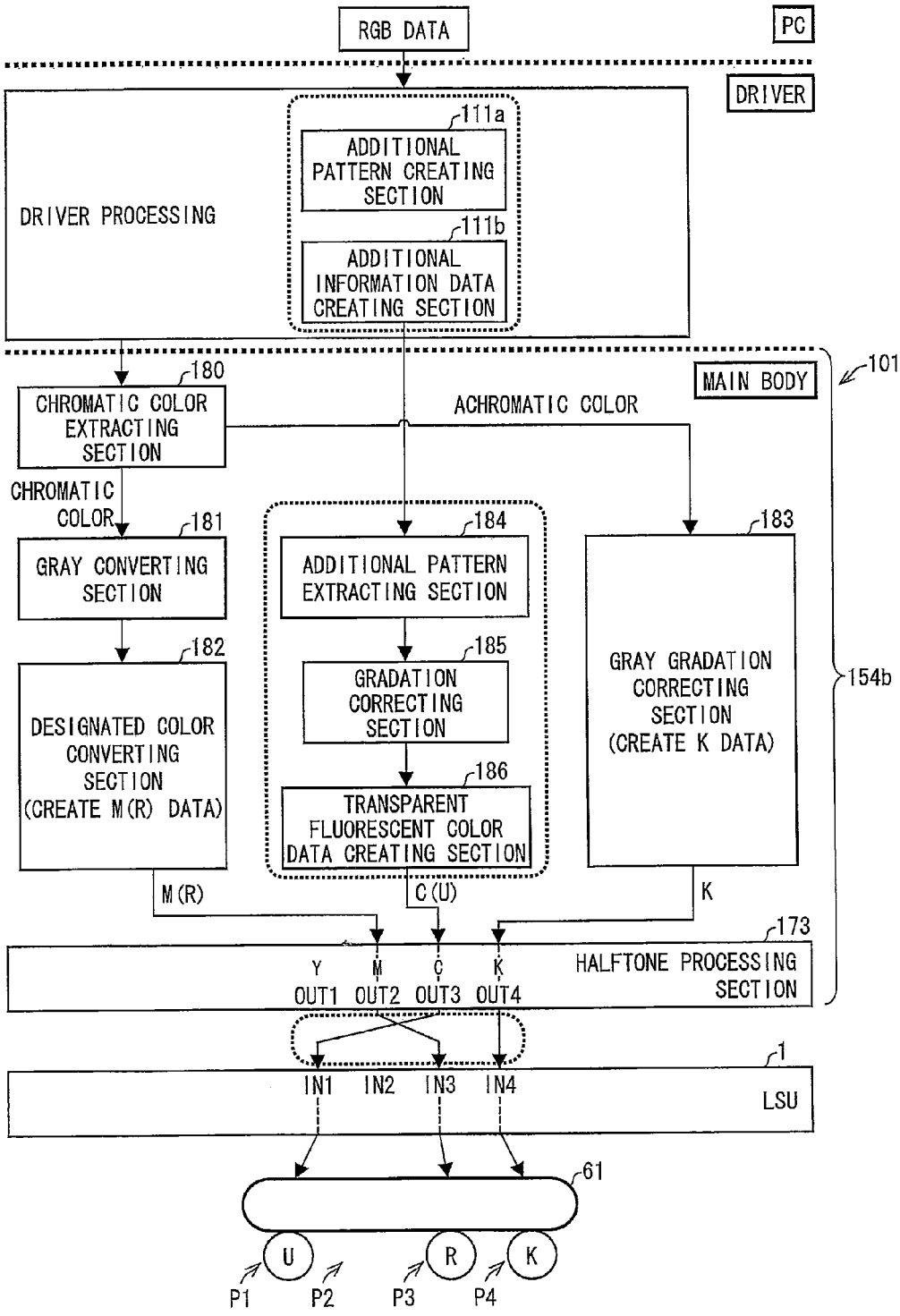

FIG. 14 is a view showing image processing carried out in a case where the image forming apparatus of the Embodiment 2 is used for creation of a secret document.

Figure 15:
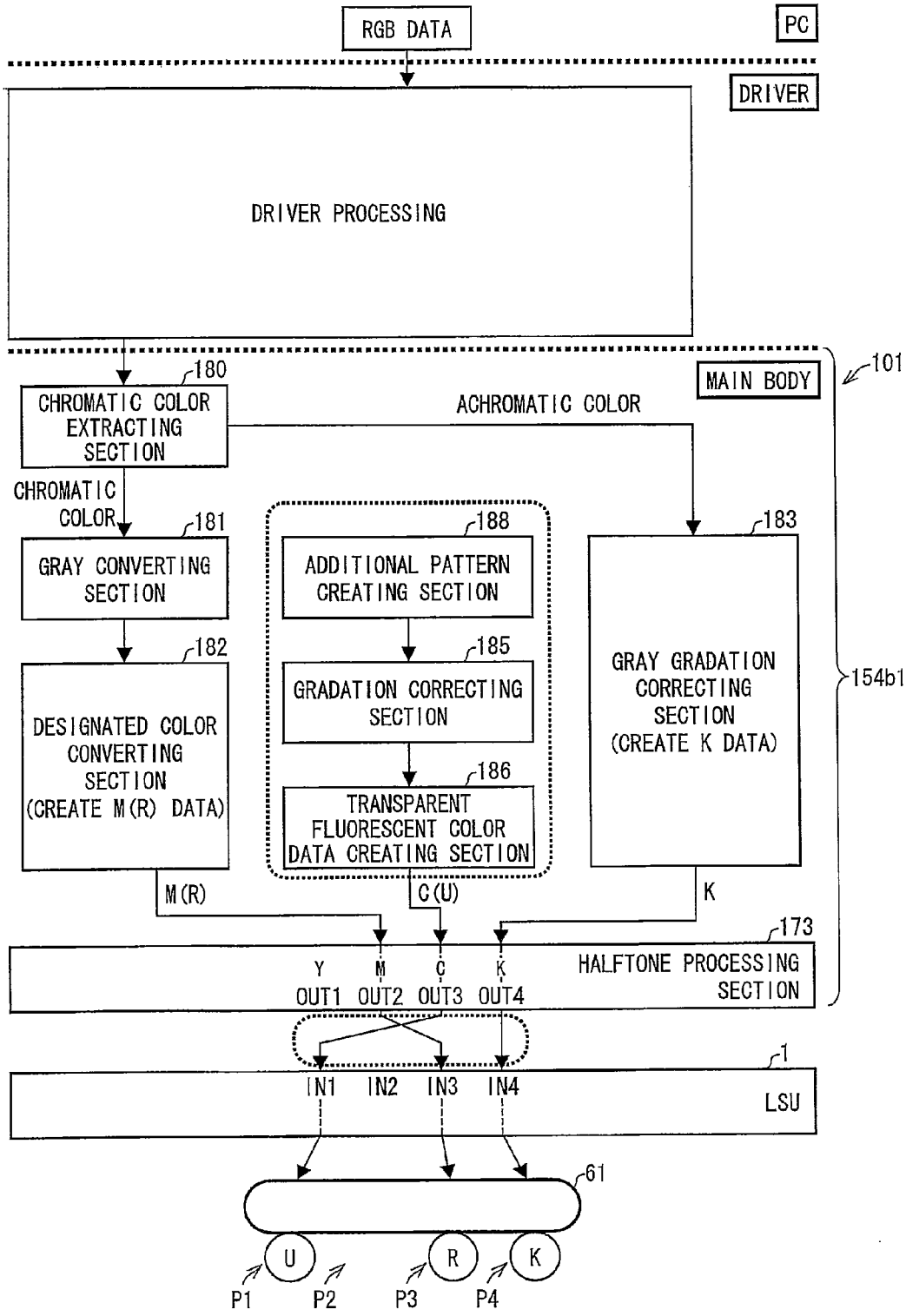

FIG. 15 is a view showing another image processing carried out in a case where the image forming apparatus of the Embodiment 2 is used for creation of a secret document.

Figure 16:
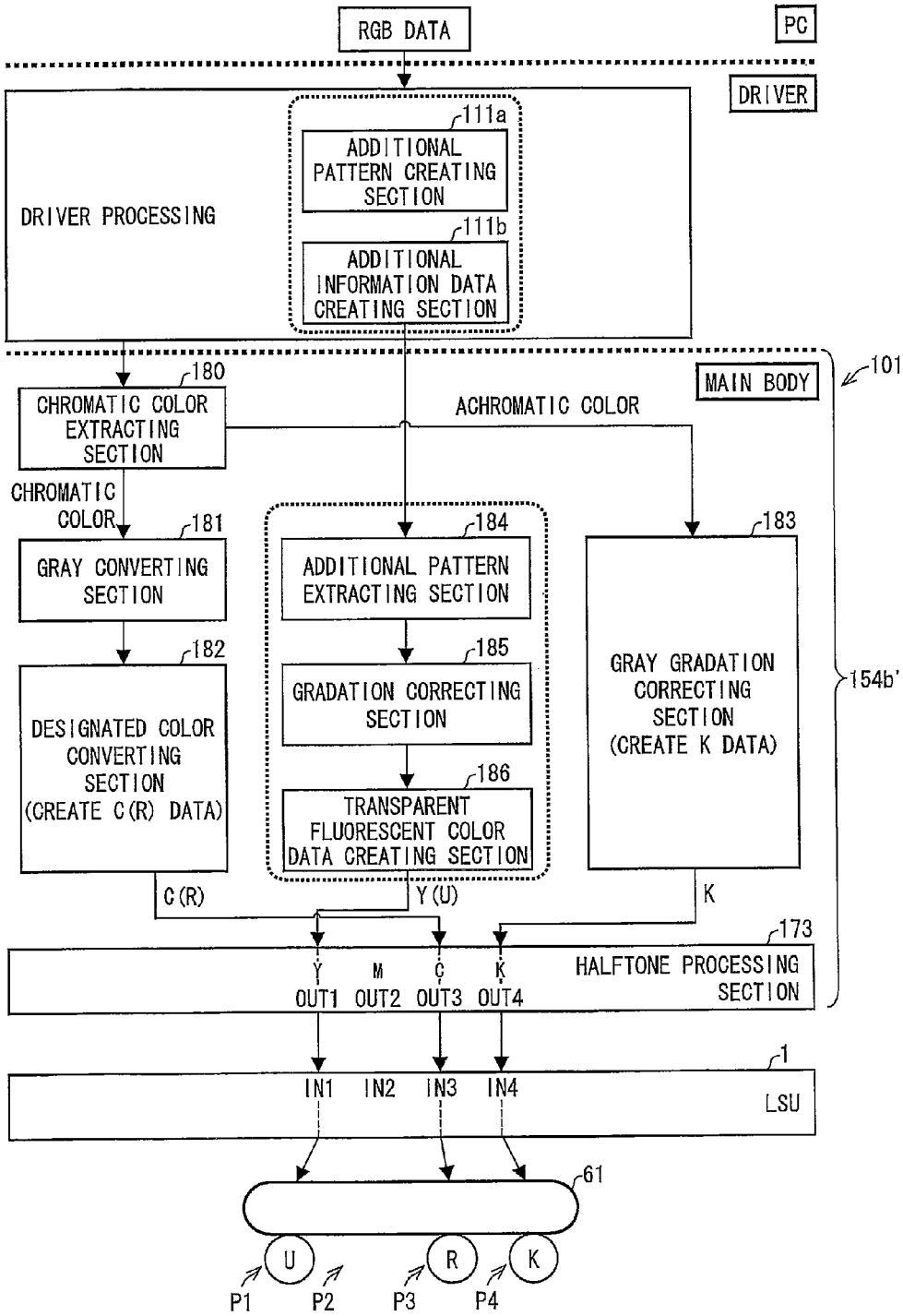

FIG. 16 is a view showing another image processing carried out in a case where the image forming apparatus of the Embodiment 2 is used for creation of a secret document.

Figure 17:
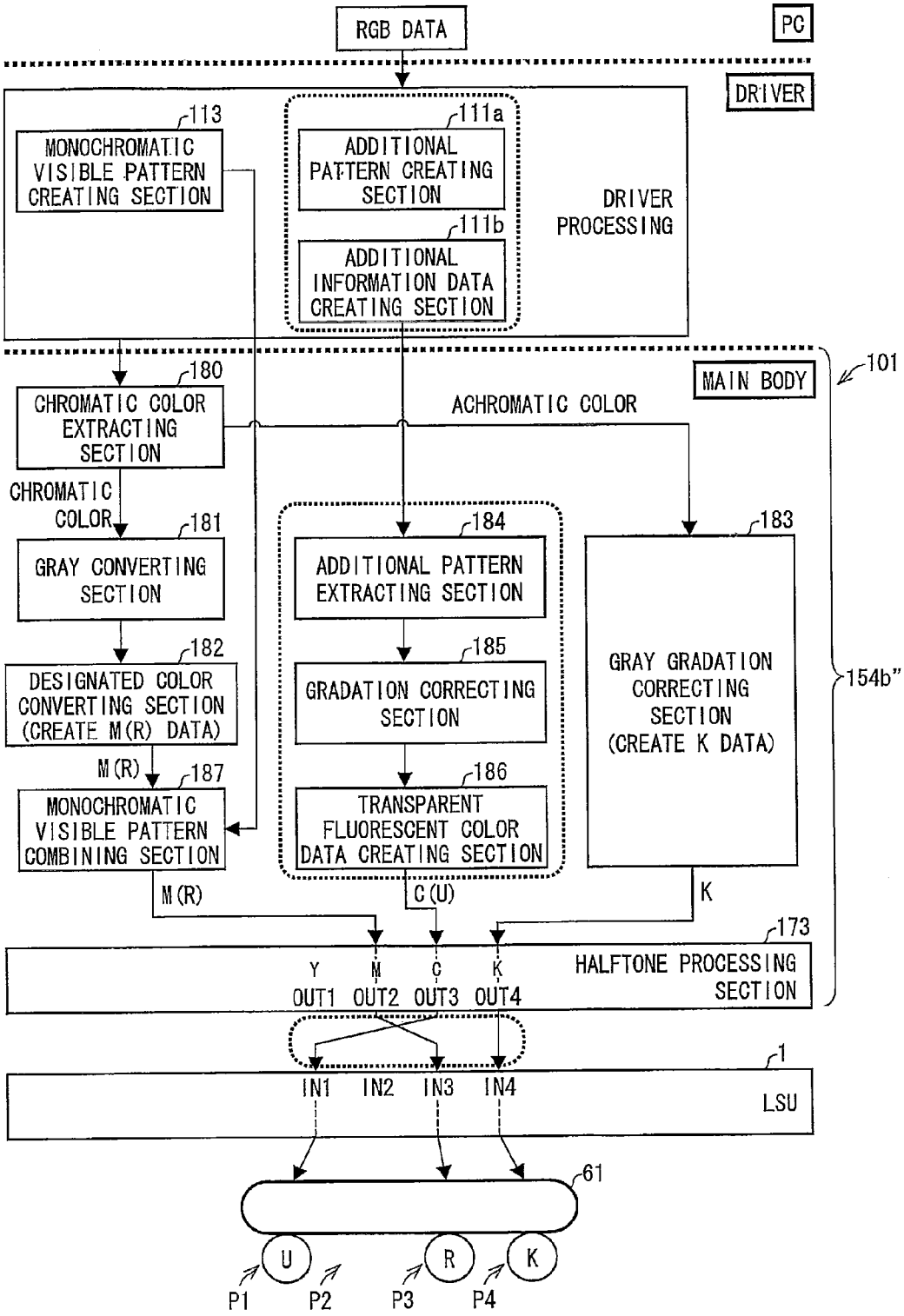

FIG. 17 is a view showing another image processing carried out in a case where the image forming apparatus of the Embodiment 2 is used for creation of a secret document.

Figure 18:
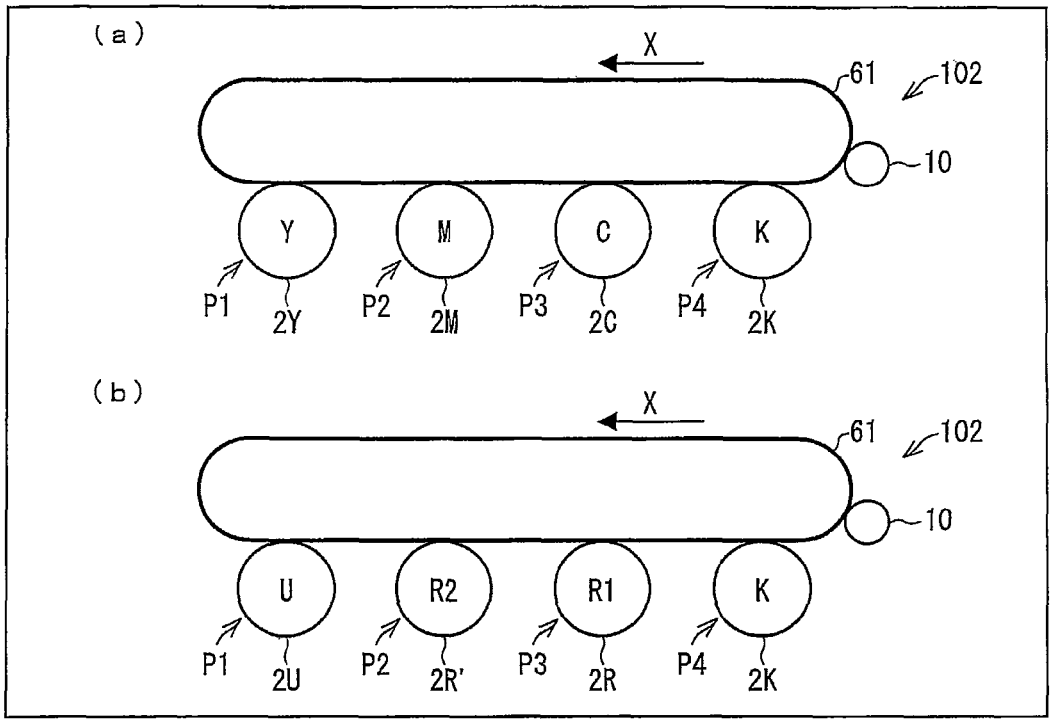

(a) of FIG. 18 is a view illustrating a preferable example of the way in which developing units are disposed in a case where the image forming apparatus of the Embodiment 3 is used for creation of a full-color image, and (b) of FIG. 18 is a view illustrating a preferable example of the way in which developing units are disposed in a case where the image forming apparatus of the Embodiment 3 is used for creation of a secret document.

Figure 19:
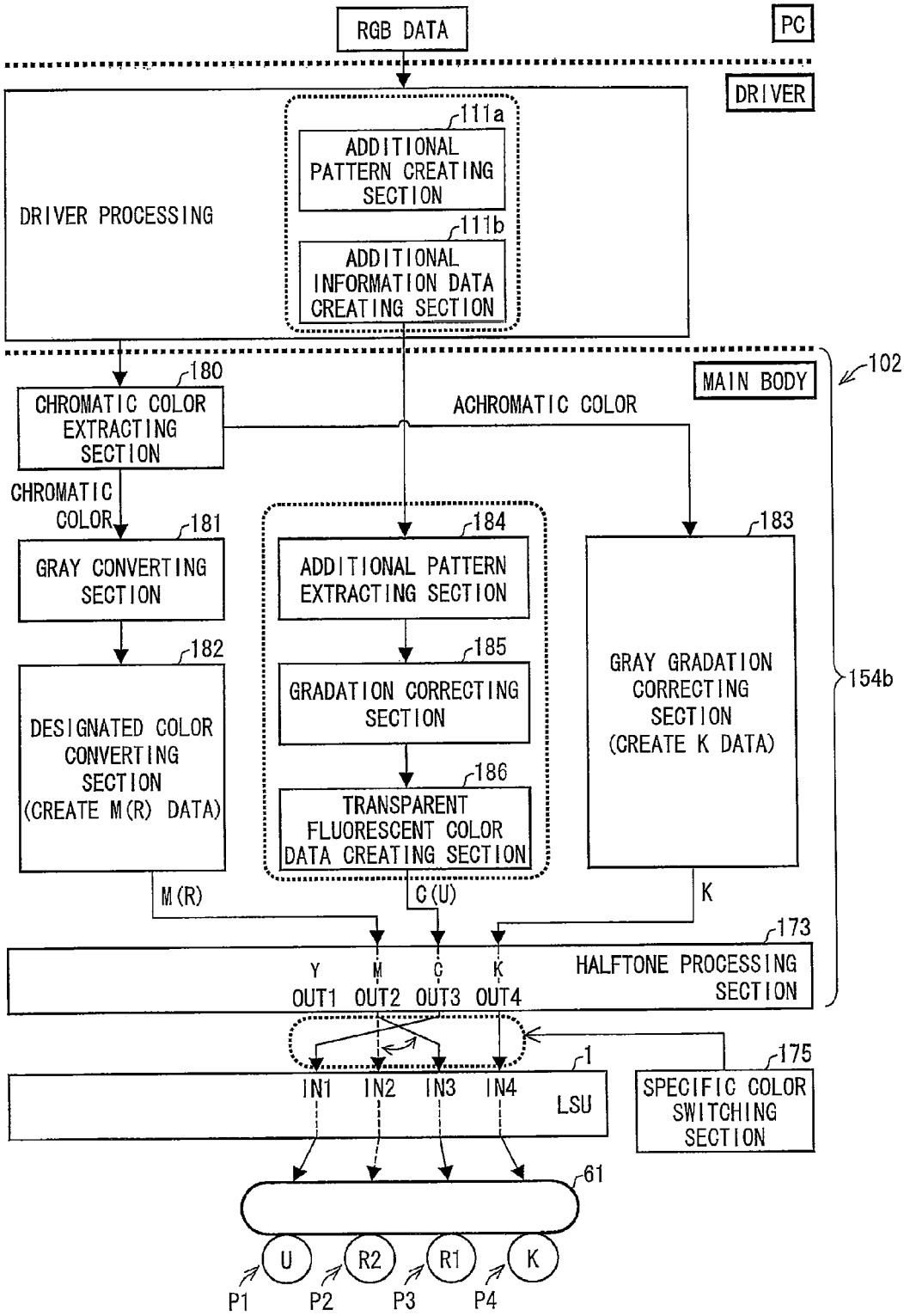

FIG. 19 is a view showing image processing carried out in a case where the image forming apparatus of the Embodiment 3 is used for creation of a secret document.

Figure 20:
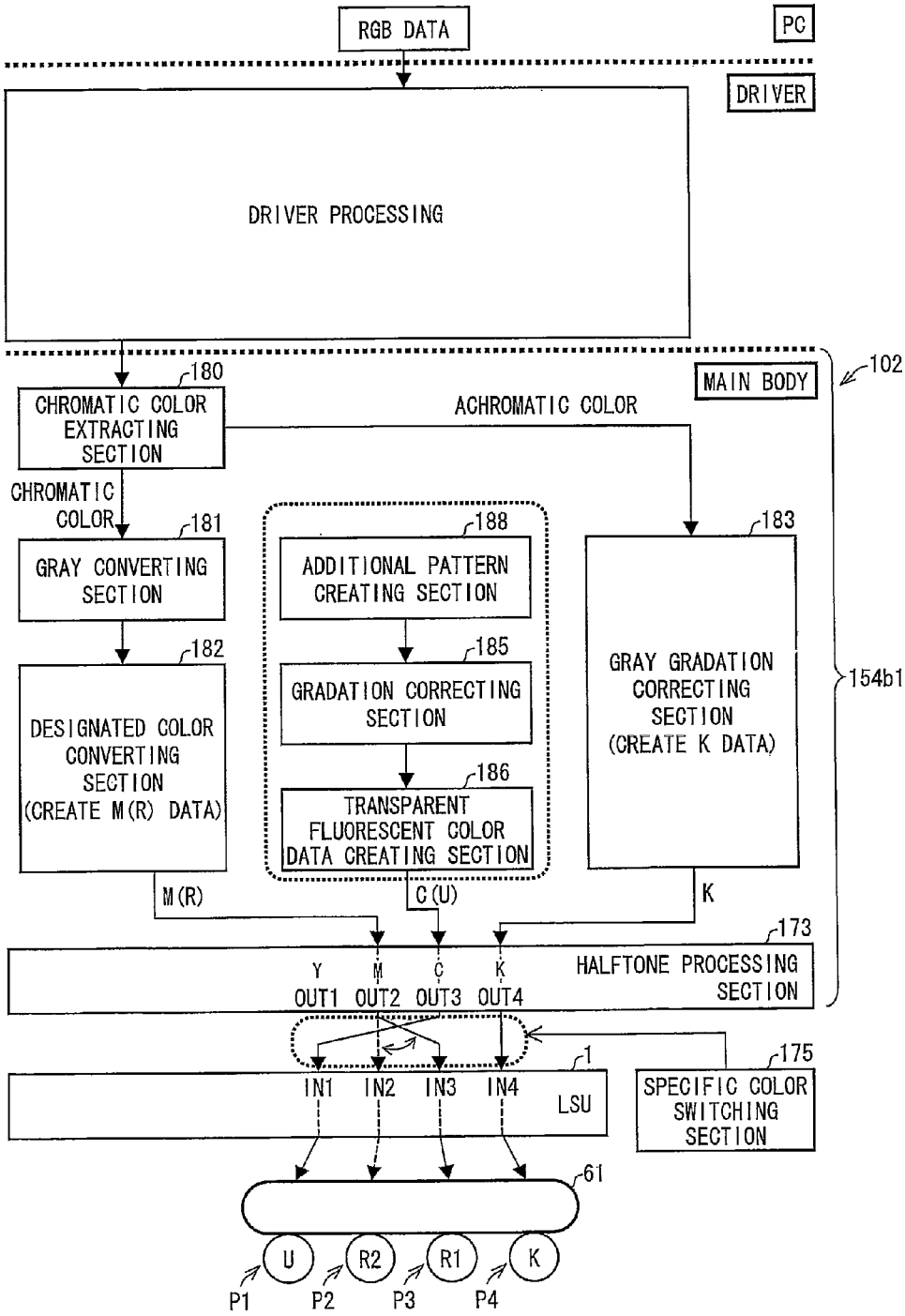

FIG. 20 is a view showing another image processing carried out in a case where the image forming apparatus of the Embodiment 3 is used for creation of a secret document.

Figure 21:
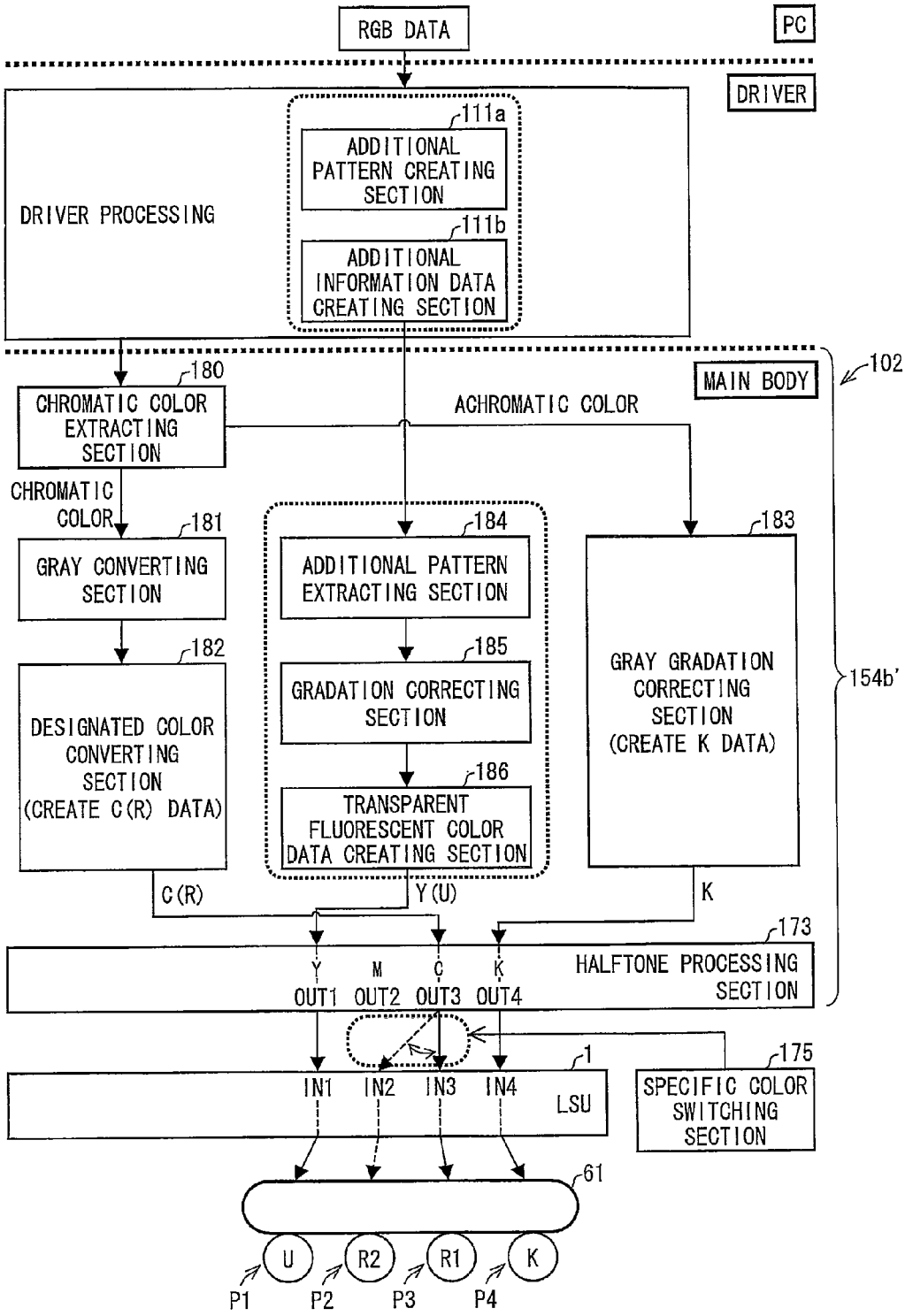

FIG. 21 is a view showing another image processing carried out in a case where the image forming apparatus of the Embodiment 3 is used for creation of a secret document.

Figure 22:
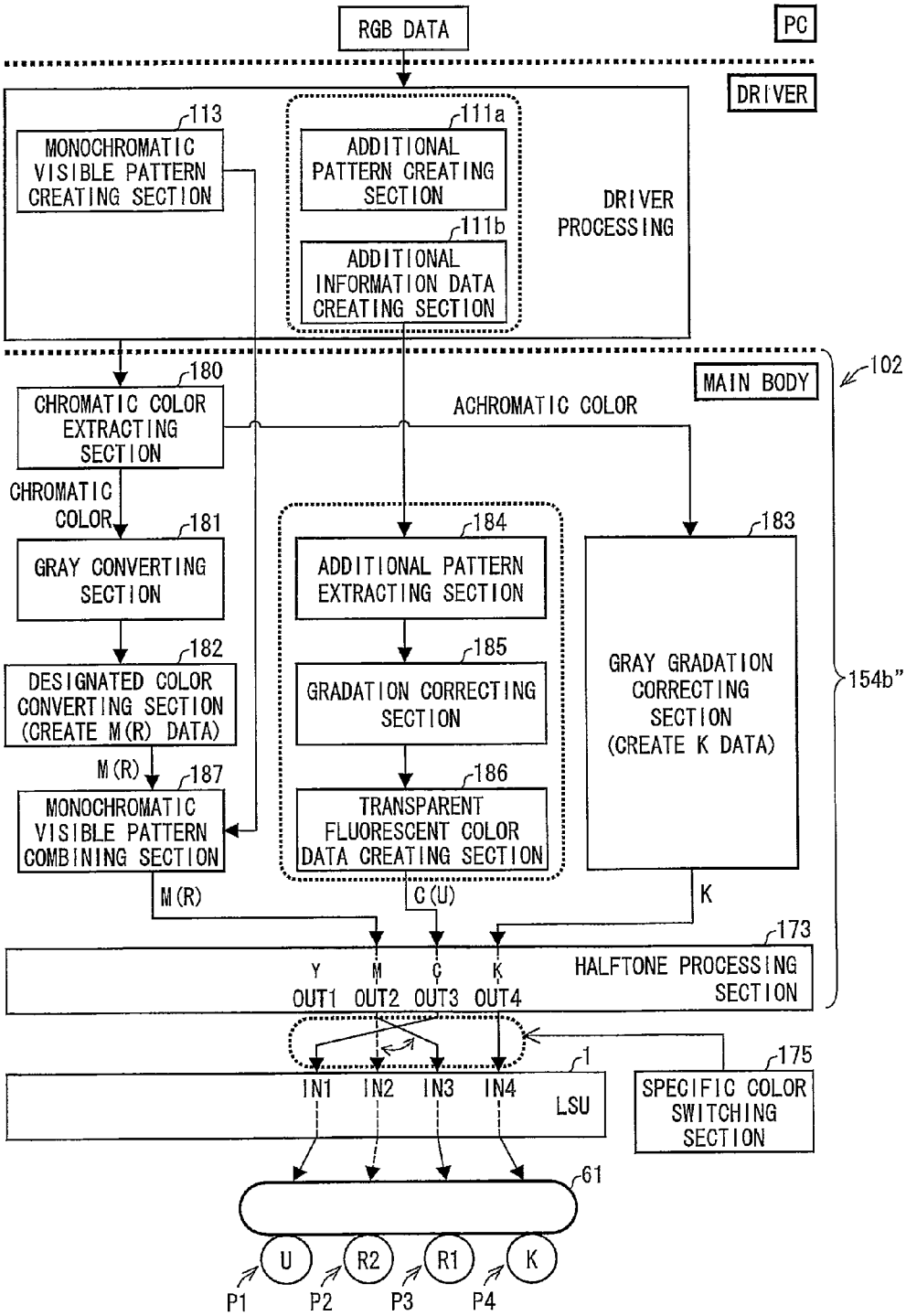

FIG. 22 is a view showing another image processing carried out in a case where the image forming apparatus of the Embodiment 3 is used for creation of a secret document.

Figure 23:
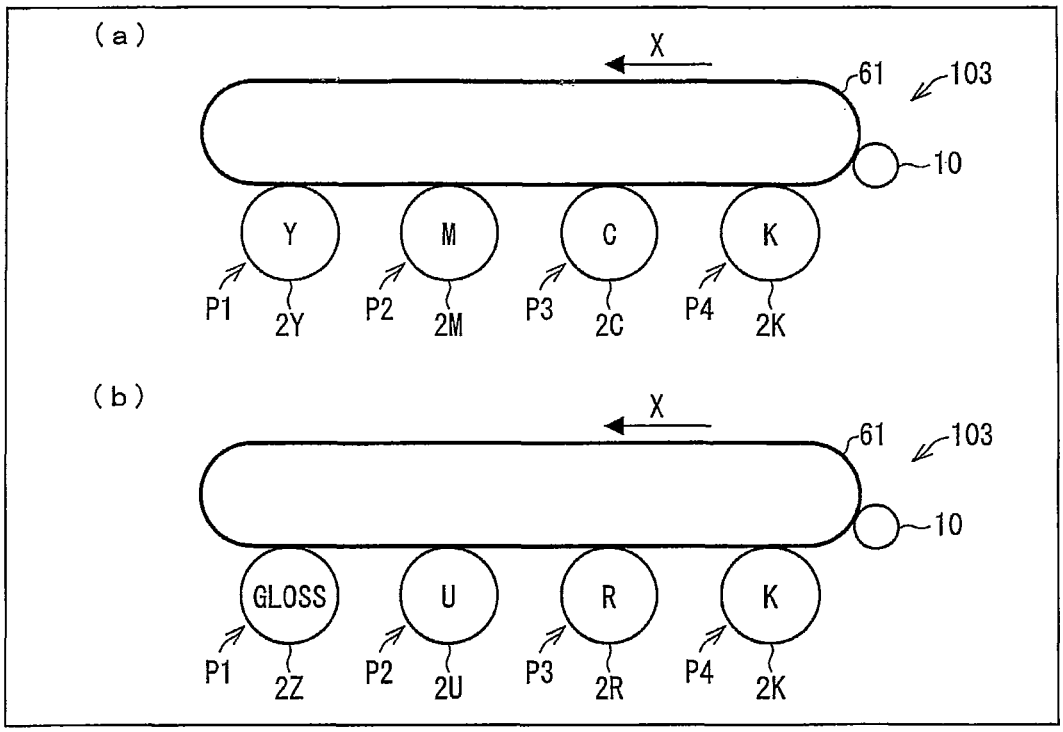

(a) of FIG. 23 is a view illustrating a preferable example of the way in which developing units are disposed in a case where the image forming apparatus of the Embodiment 4 is used for creation of a full-color image, and (b) of FIG. 23 is a view illustrating a preferable example of the way in which developing units are disposed in a case where the image forming apparatus of the Embodiment 4 is used for creation of a secret document.

Figure 24:
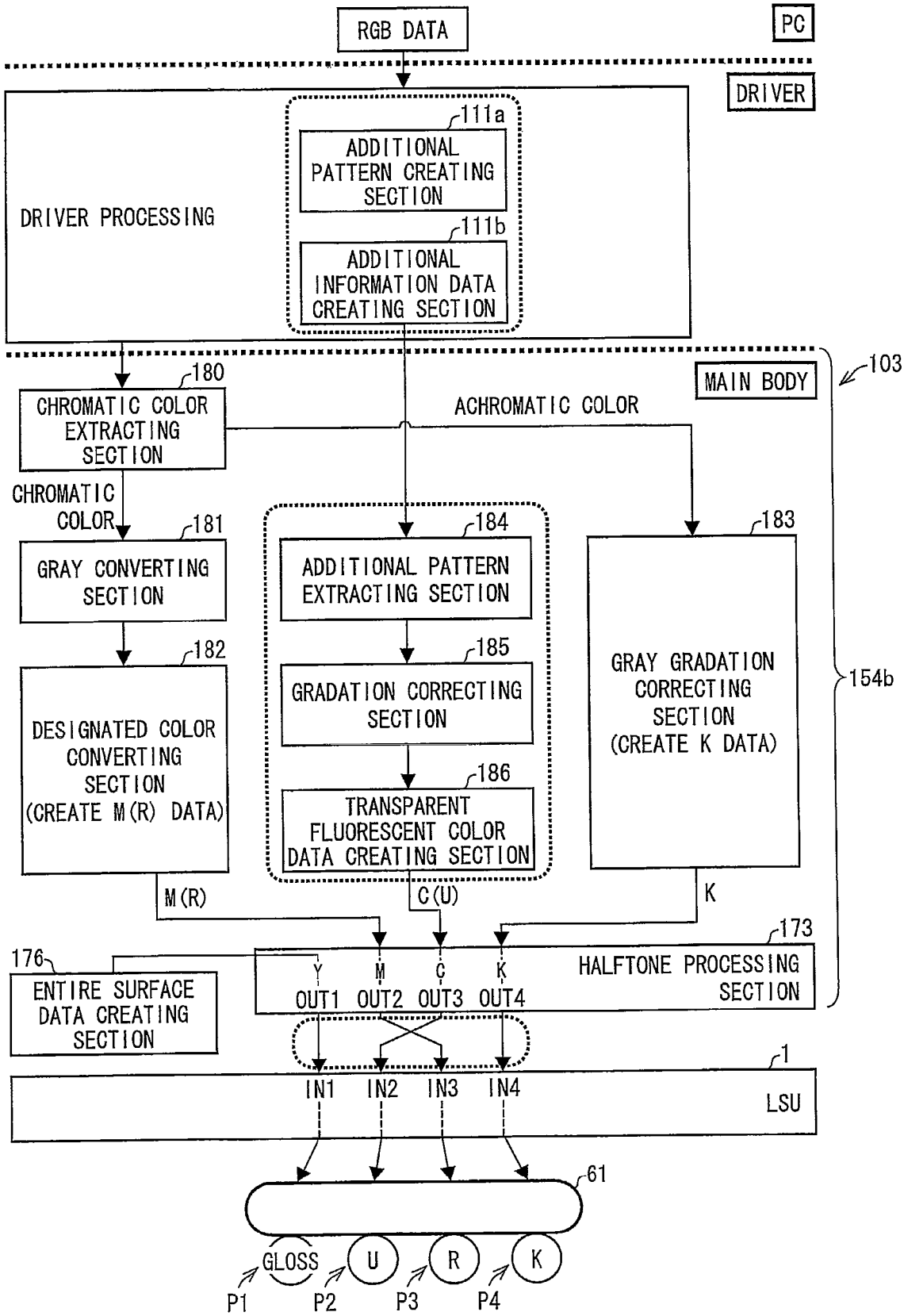

FIG. 24 is a view showing image processing carried out in a case where the image forming apparatus of the Embodiment 4 is used for creation of a secret document.

Figure 25:
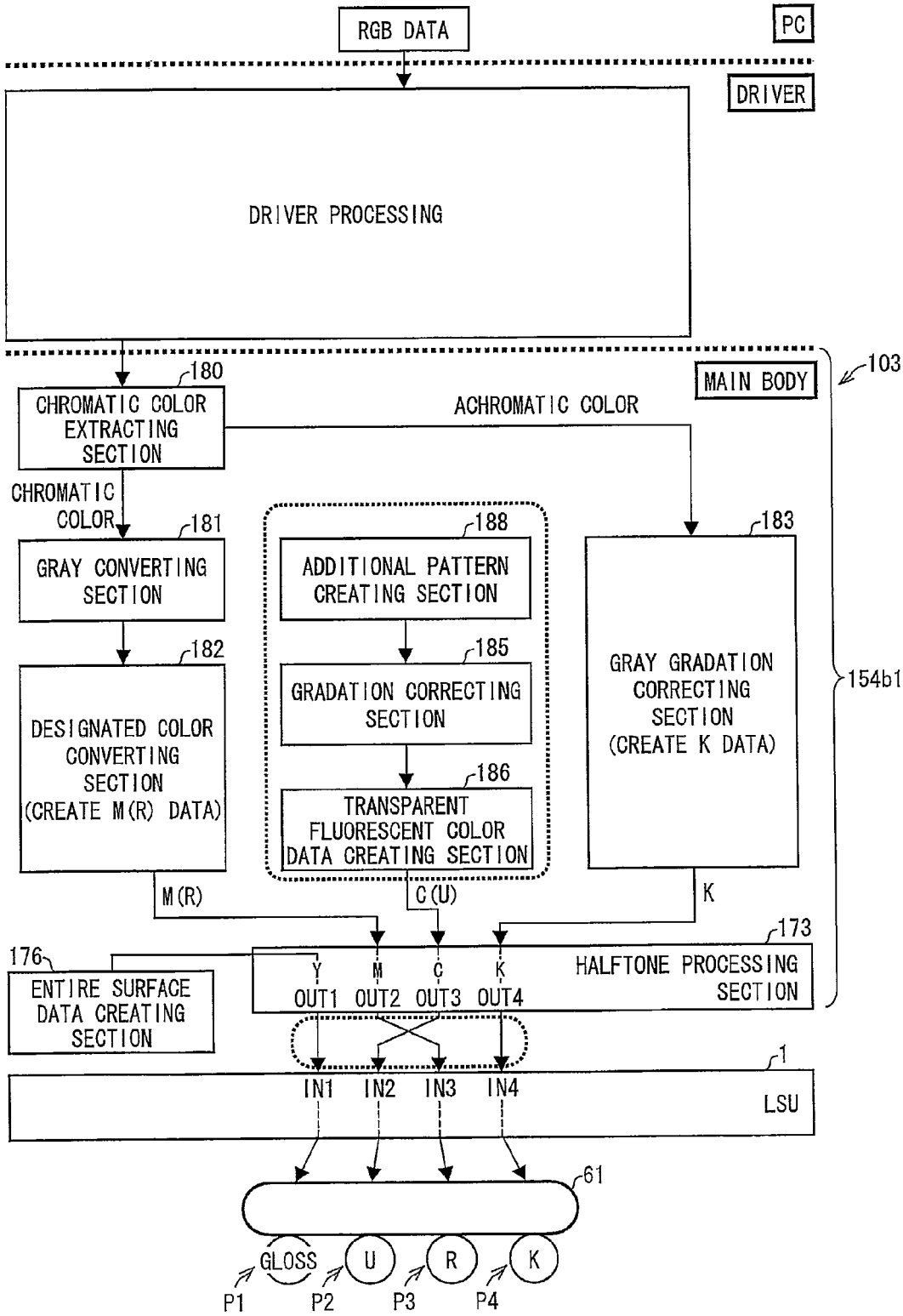

FIG. 25 is a view showing another image processing carried out in a case where the image forming apparatus of the Embodiment 4 is used for creation of a secret document.

Figure 26:
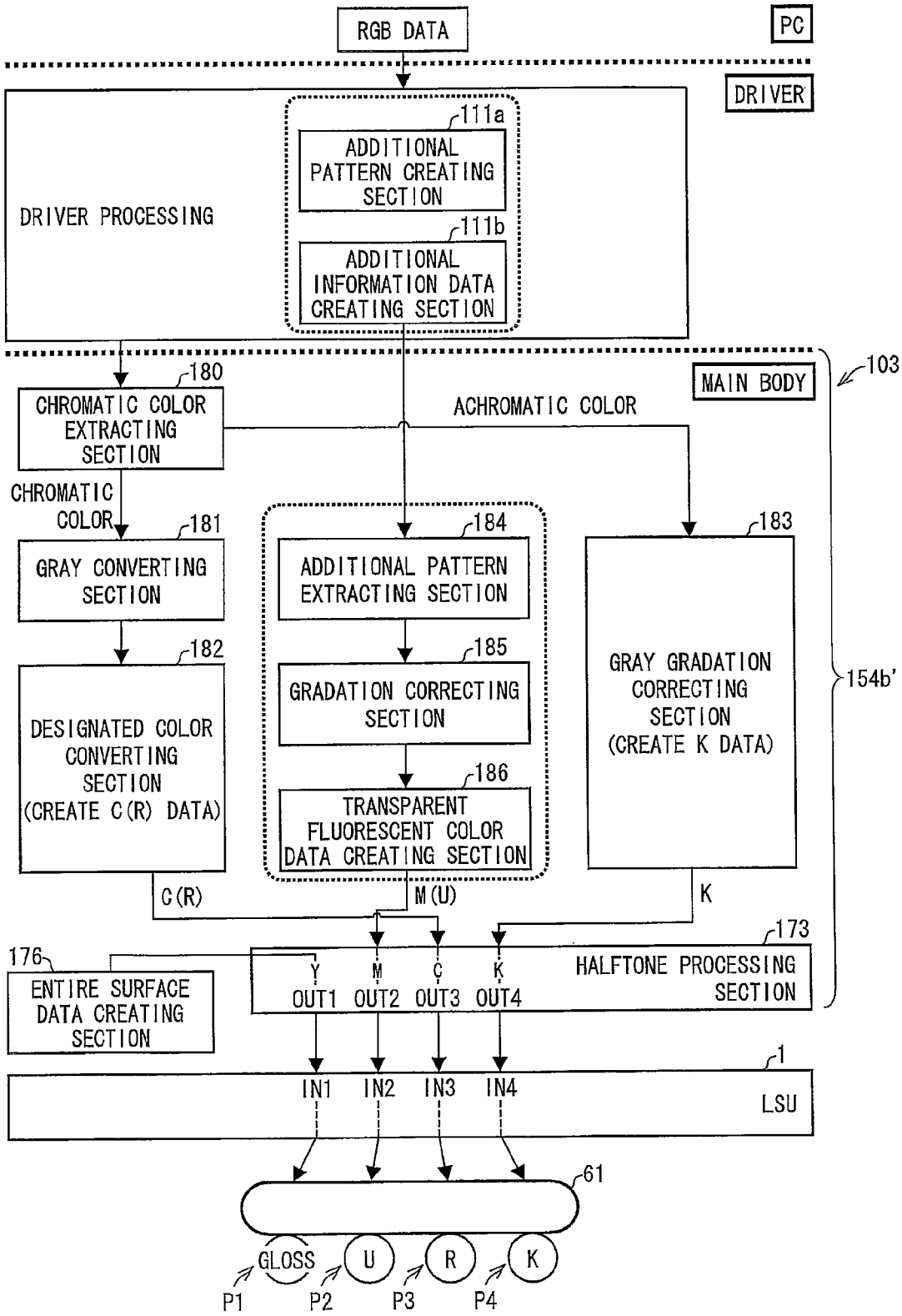

FIG. 26 is a view showing another image processing carried out in a case where the image forming apparatus of the Embodiment 4 is used for creation of a secret document.

Figure 27:
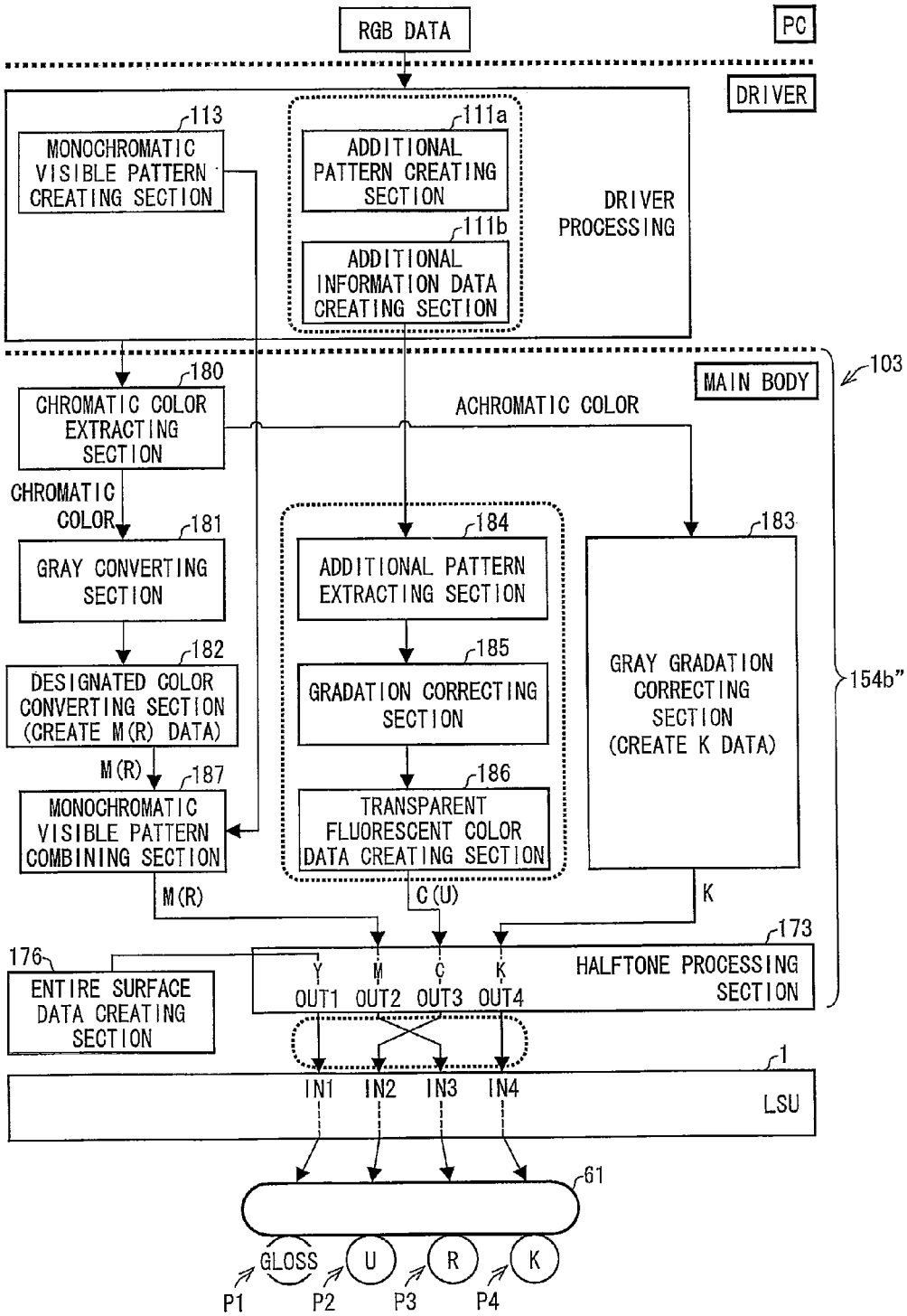

FIG. 27 is a view showing another image processing carried out in a case where the image forming apparatus of the Embodiment 4 is used for creation of a secret document.

DESCRIPTION OF EMBODIMENTS

Embodiment 1

Embodiment 1 of the present invention is described below in detail with reference to the drawings.

Figure 1:
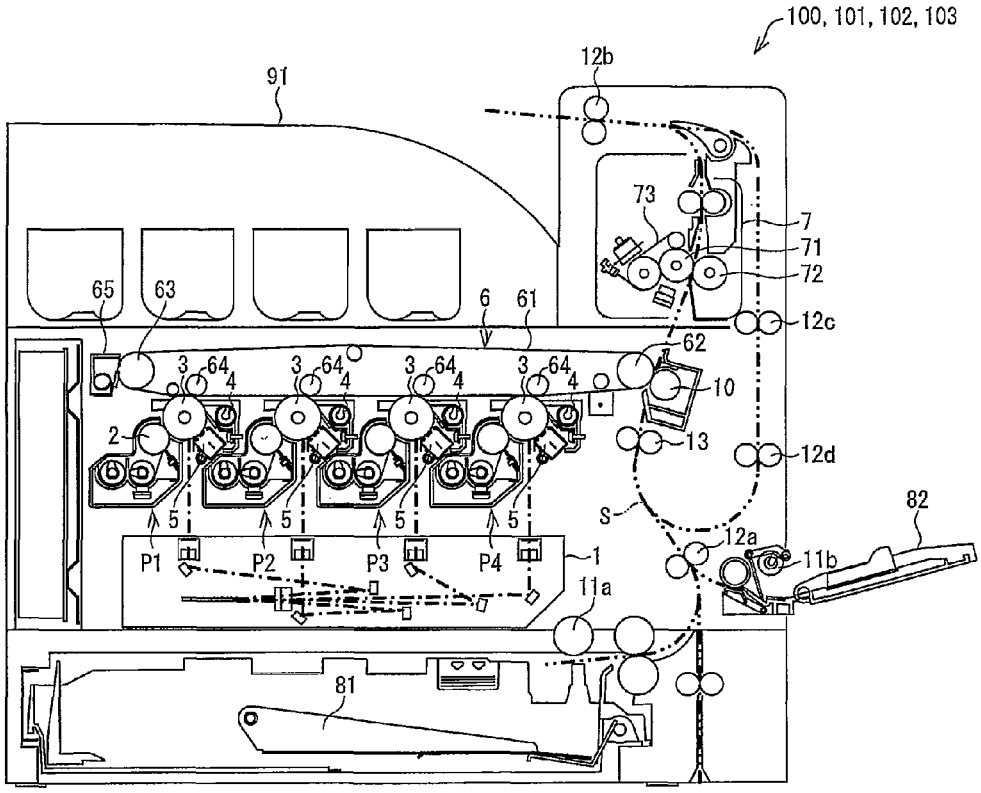
FIG. 1 is a view illustrating a configuration of an image forming apparatus of Embodiments 1 through 4 of the present invention.

FIG. 1 is a view illustrating a configuration of an image forming apparatus of the present invention.

An image forming apparatus 100 is connected to an information processing apparatus (not shown) such as a personal computer via LAN or the like. The image forming apparatus 100 is a printer that forms a multicolor or monochrome image on predetermined paper (recording paper, sheet) on the basis of image data externally supplied.

The image forming apparatus 100 includes an exposure unit 1, developing units 2, photoreceptor drums 3, charging units 5, cleaner units 4, an intermediate transfer belt unit 6, a fixing unit 7, a paper feeding cassette 81, a paper output tray 91 etc.

In the present image forming apparatus 100, four image forming stations P1 through P4 can be provided as an image forming section. Each of the four image forming stations P1 through P4 includes a developing unit 2, a photoreceptor drum 3, a charging unit 5, and a cleaner unit 4. The four image forming stations P1 through P4 have a basically identical configuration. However, identification information is assigned to each of the image forming stations P. A control section 151 (later described) can distinguish the image forming stations P from one another by the identification information. Since the image forming apparatus 100 includes the four image forming stations P, an image can be formed with the use of toners (developers) of four colors.

The charging units 5 are charging devices for uniformly charging surfaces of the photoreceptor drums 3 to a predetermined electric potential. The charging units 5 may be non-contact type charging units as shown in FIG. 1 or may be contact type charging units such as roller type charging units or brush type charging units.

The exposure unit 1 exposes the surfaces of the photoreceptor drums 3 thus charged to light in accordance with inputted image data so as to form electrostatic latent images corresponding to the image data. The exposure unit 1 may be a laser scanning unit (LSU) including a laser emitting section, reflecting mirrors etc. as shown in FIG. 1 or may be, for example, an EL or LED writing head in which light-emitting elements are disposed in an array.

The developing units 2 visualize the electrostatic latent images thus formed on the photoreceptor drums 3 with the use of toners. The developing units 2 are detachably provided in the image forming apparatus 100. In the present image forming apparatus 100, developing units 2K, 2Y, 2M, 2C, and 2U that contain five types of toners, i.e., black (K) toner, yellow (Y) toner, magenta (M) toner, cyan (C) toner, and transparent fluorescent toner, respectively can be mounted in a predetermined combination. This is described later in detail.

The cleaner units 4 remove and collect toners remaining on the surfaces of the photoreceptor drums 3 after the development and image transfer.

The intermediate transfer belt unit 6 which is provided above the photoreceptor drums 3 includes an intermediate transfer belt 61, an intermediate transfer belt driving roller 62, an intermediate transfer belt follower roller 63, intermediate transfer rollers 64, and an intermediate transfer belt cleaning unit 65. Note that four intermediate transfer rollers 64 are provided so as to correspond to the four image forming stations P1 through P4.

The intermediate transfer belt driving roller 62, the intermediate transfer belt follower roller 63, and the intermediate transfer rollers 64 provide the intermediate transfer belt 61 in a tensioned state, and the intermediate transfer belt 61 is driven by these rollers to rotate. Further, the intermediate transfer rollers 64 give transfer bias so as to transfer, onto the intermediate transfer belt 61, the toner images formed on the photoreceptor drums 3.

The intermediate transfer belt 61 is provided so as to be in contact with the photoreceptor drums 3. The toner images of respective colors which are formed on the photoreceptor drums 3 are sequentially transferred onto the intermediate transfer belt 61 so as to be superimposed on each other. Thus, a multicolored toner image is formed on the intermediate transfer belt 61. The intermediate transfer belt 61 is formed endlessly from a film whose thickness is, for example, in a range from 100 μm to 150 μm.

The toner images are transferred from the photoreceptor drums 3 to the intermediate transfer belt 61 by the intermediate transfer rollers 64 that are in contact with a reverse side of the intermediate transfer belt 61. A high voltage transfer bias (a high voltage that has a polarity (+) reverse to the charge polarity (−) of the toner) is applied to the intermediate transfer rollers 64 to achieve transfer of the toner images. Each of the intermediate transfer rollers 64 is formed on the basis of a metal (such as stainless steel) axis whose diameter is, for example, in a range from 8 to 10 mm, and a surface of each of the intermediate transfer rollers 64 is covered with a electrically conductive elastic material (such as EPDM and foam polyurethane). Because of this electrically conductive elastic material, the intermediate transfer rollers 64 can uniformly apply the high voltage to the intermediate transfer belt 61. Explained in the present embodiment is an exemplary case in which roller type transfer electrodes are used. It should be noted that brush type transfer electrodes may be used instead of the roller type transfer electrodes.

As described above, the electrostatic latent image on each of the photoreceptor drums 3 is visualized by the toner of respective colors and are stacked on the intermediate transfer belt 61. Thus, the image information thus stacked is transferred, by rotation of the intermediate transfer belt 61, on paper (later described) by a transfer roller 10 disposed at a position where the paper makes contact with the intermediate transfer belt 61.

In this case, the intermediate transfer belt 61 and the transfer roller 10 are pressured so as to form a predetermined nip, and a voltage (high voltage that has a polarity (+) reverse to the charge polarity (−) of the toner) is applied to the transfer roller 10 to transfer the toner on the paper. For the purpose of constantly obtaining the nip, one of the transfer roller 10 and the intermediate transfer belt driving roller 62 is made of a solid material such as metal and the other is made of a soft material such as an elastic roller (e.g. elastic rubber roller and foam resin roller).

Among the toner that adheres to the intermediate transfer belt 61 due to the contact between the intermediate transfer belt 61 and the photoreceptor drums 3, some toner remains on the intermediate transfer belt 61 without being transferred when the toner images are transferred from the intermediate transfer belt 61 on the paper. Such remained toner causes a problem that colors of the toner are undesirably mixed in the next imaging process. Therefore, such toner is removed and collected by the intermediate transfer belt cleaning unit 65. The intermediate transfer belt cleaning unit 65 includes, for example, a cleaning blade serving as a cleaning member that is in contact with the intermediate transfer belt 61. A part of the intermediate transfer belt 61 which part is in contact with the cleaning blade is supported from the reverse side by the intermediate transfer belt follower roller 63.

The paper feeding cassette 81 is a tray for storing paper used for image formation, and is provided below the exposure unit 1 of the image forming apparatus 100. Further, paper used for image formation can be placed also on a manual paper feeding cassette 82. The paper output tray 91 provided in an upper portion of the image forming apparatus 100 is a tray for laying the printed sheet facedown.

Further, in the image forming apparatus 100, a sheet carrying path S is provided which is substantially vertical and which is for carrying sheets on the paper feeding cassette 81 and sheets on the manual paper feeding cassette 82 to the paper output tray 91 via the transfer roller 10 and the fixing unit 7. Disposed, in the vicinity of the sheet carrying path S, between the paper feeding cassette 81 or the manual paper feeding cassette 82 and the paper output tray 91 are pickup rollers 11*a* and 11*b*, a plurality of carrying rollers 12*a* through 12*d*, a resist roller 13, the transfer roller 10, the fixing unit 7 etc.

The plurality of carrying rollers 12*a* through 12*d* are small rollers for facilitating and assisting conveyance of the sheets, and are provided along the sheet carrying path S. The pickup roller 11*a* is provided in the vicinity of an end of the paper feeding cassette 81, and supplies sheets one by one from the paper feeding cassette 81 to the sheet carrying path S. Similarly, the pickup roller 11*b* is provided in the vicinity of an end of the manual paper feeding cassette 82, and supplies sheets one by one from the manual paper feeding cassette 82 to the sheet carrying path S.

The resist roller 13 temporarily keeps a sheet carried along the sheet carrying path S, and carries the sheet to the transfer roller 10 when an edge of the toner image on the photoreceptor drums 3 meets an edge of the sheet.

The fixing unit 7 includes a heat roller 71 and a pressure roller 72. The heat roller 71 and the pressure roller 72 sandwich a sheet and rotate. The heat roller 71 is controlled by the control section 151 (see FIG. 5) so as to have a predetermined fixing temperature. The control section 151 controls the heat roller 71 on the basis of a signal from a heat detector (not shown). The heat roller 71 and the pressure roller 72 press the sheet while applying heat on the sheet. Thereby, the heat roller 71 and the pressure roller 72 fuse, mix and press the multicolored toner image which is transferred on the sheet, thereby thermally fixing the toner image on the sheet. Further, an external fixing belt 73 for externally fixing the heat roller 71 is provided.

Next, the sheet carrying path S is described in detail. As described above, the image forming apparatus includes the paper feeding cassette 81 in which sheets are stored in advance and the manual paper feeding cassette 82. The pickup roller 11*a* is disposed so as to supply sheets one by one from the paper feeding cassette 81 to the sheet carrying path S, and the pickup roller 11*b* is disposed so as to supply sheets one by one from the manual paper feeding cassette 82 to the sheet carrying path S.

A sheet carried from the paper feeding cassette 81 or the manual paper feeding cassette 82 is carried to the resist roller 13 by the carrying rollers 12*a* disposed along the sheet carrying path S, and then is carried to the transfer roller 10 at such timing that an edge of the sheet meets an edge of image information on the intermediate transfer belt 61. Thus, the image information is printed on the sheet. Subsequently, the sheet is delivered to the fixing unit 7 in which unfixed toner on the sheet is fused and fixed by heat. Then, the sheet is outputted onto the paper output tray 91 via the carrying roller 12*b*.

The above carrying path is a path taken in a case where one-sided printing is requested. Meanwhile, in a case where double-sided printing is requested, after the one-sided printing is completed, the sheet that passed through the fixing unit 7 is held at its rear end by the final carrying roller 12*b*. In this state, the carrying roller 12*b* rotates in a reverse direction. Thus, the sheet is led to the carrying rollers 12*c* and 12*d*, and is then carried to the resist roller 13. After the reverse side is printed, the sheet is outputted to the paper output tray 91.

The present image forming apparatus 100 functions not only as an image forming apparatus for a full-color image (full-color mode), but also as an image forming apparatus for creation of a secret document (transparent color mode).

In a case where the present image forming apparatus 100 functions as an image forming apparatus for a full-color image, the four developing units 2 which respectively contain toners (visible toners) of black (K), cyan (C), magenta (M), and yellow (Y) for forming a full-color image are mounted in the four image forming stations P1 through P4 shown in FIG. 1.

Meanwhile, in a case where the present image forming apparatus 100 functions as an image forming apparatus for creation of a secrete document, four developing units 2 that respectively contain a black toner, a transparent fluorescent (transparent light) toner which is an invisible toner, and two of cyan toner, magenta toner, and yellow toner are mounted in the four image forming stations P1 through P4.

In a case where the transparent fluorescent toner is used, a visible image is expressed by the black toner and a color that can be reproduced within a color reproduction range determined by the other two visible toners. For example, in a case where the two colors selected from the three colors (cyan, magenta, and yellow) are yellow and magenta, a visible image is expressed, for example, by red or orange that can be reproduced by mixing the yellow toner and the magenta toner.

The following description deals with, as an example, a case where the two colors selected from the three colors (cyan, magenta, and yellow) are yellow and magenta. However, a combination of the two colors is not limited in particular as described above. Note, however, that in a case where a combination of magenta and yellow is used, a reproduced color includes a red hue, and therefore red color of a seal stamped on a secret document (color of vermilion ink-pad) in countries, such as Japan and China, in which seals are used can be reproduced. Accordingly, such an image forming apparatus in which the combination of magenta and yellow is used is preferable as an image forming apparatus used in the countries in which seals are used.

The invisible toner is a transparent (colorless) toner which can hardly be observed under visible light and that can be recognized when irradiated by special light. Examples of the invisible toner include a transparent fluorescent toner that contains a fluorescent substance that glows when irradiated by ultraviolet ray (ultraviolet light, ultraviolet radiation) and a colorless infrared light absorbing toner that contains an infrared light absorbing agent that absorbs an infrared ray (infrared light, infrared radiation). The transparent fluorescent toner exhibits color and can be recognized when irradiated by ultraviolet light. Meanwhile, the colorless infrared light absorbing toner becomes black and can be recognized when irradiated by infrared light by absorbing the infrared light.

The transparent fluorescent toner has a similar constitution to visible toners such as black toner, cyan toner, magenta toner, and yellow toner that can be recognized under visible light except for that the transparent fluorescent toner contains no coloring agent and contains a fluorescent dye or a fluorescent pigment instead of a coloring agent. Further, the transparent fluorescent toner can be produced by a similar method to the visible toners. Each of the fluorescent dye and the fluorescent pigment has an absorption peak in a near-ultraviolet region (400 nm or smaller) and has an emission peak in a visible light region.

The colorless infrared light absorbing toner also has a similar constitution to the visible toners except for that the colorless infrared light absorbing toner contains no coloring agent and contains an infrared light absorbing agent instead of a coloring agent. Further, the colorless infrared light absorbing toner also can be produced by a similar method to the visible toners. The infrared light absorbing agent may be, for example, ytterbium or a neodymium compound. Ytterbium or a neodymium compound efficiently absorbs incident light in an infrared light region (700 nm or larger).

The present embodiment deals with, as an example, a case where the transparent fluorescent toner that contains a fluorescent substance that glows when irradiated by ultraviolet light is used as an invisible toner.

(a) of FIG. 2 illustrates a preferable example of the way in which four developing units 2 are disposed in a case where the present image forming apparatus 100 is used as an image forming apparatus for creation of a full-color image, and (b) of FIG. 2 illustrates a preferable example the way in which four developing units 2 are disposed in a case where the present image forming apparatus 100 is used as an image forming apparatus for creation of a secret document. In the present image forming apparatus 100, four developing units 2 are disposed in this way.

In the present embodiment, in a case where the image forming apparatus 100 is used for creation of a full-color image, the yellow developing unit 2Y that contains a yellow toner is provided in the image forming station P1 that is located, when viewed from the transfer roller 10, in a most upstream side of a rotation direction of the intermediate transfer belt 61 that rotates in a direction indicated by the arrow X, as shown in (a) of FIG. 2. The magenta developing unit 2M that contains a magenta toner is provided in the image forming station P2 that is located in a downstream side of the image forming station P1. The cyan developing unit 2C that contains a cyan toner is provided in the image forming station P3 that is located in a downstream side of the image forming station P2. The black developing unit 2K that contains a black toner is provided in the image forming station P4 that is located closest to the transfer roller 10, i.e., located in a most downstream side.

In a case where the developing units are disposed in this way, a yellow toner image, a magenta toner image, a cyan toner image, and a black toner image are stacked on the intermediate transfer belt 61 in this order. As a result, the black toner is located at the top. The toner images are then transferred on a sheet by the transfer roller 10. Thus, the order in which the toner images are stacked is reversed. As a result, on the sheet, the black toner image is located at the bottom, and the yellow toner image is located at the top. Since yellow toner has higher transmittance than magenta toner, cyan toner, and black toner, colors of the lower layers can be seen through in a case where the yellow toner image is located at the top, thereby widening a color reproduction range.

Meanwhile, in the present embodiment, in a case where the image forming apparatus 100 is used for creation of a secret document, the transparent fluorescent color developing unit 2U (first developing unit) that contains a transparent fluorescent toner is provided in the image forming station P1 that is located, when viewed from the transfer roller 10, in a most upstream side of a rotation direction of the intermediate transfer belt 61 that rotates in a direction indicated by the arrow X, as shown in (b) of FIG. 2. The yellow developing unit 2Y (third developing unit or fourth developing unit) that contains a yellow toner is provided in the image forming station P2 that is located in a downstream side of the image forming station P1. The magenta developing unit 2M (fourth developing unit or third developing unit) that contains a magenta toner is provided in the image forming station P3 that is located in a downstream side of the image forming station P2. The black developing unit 2K (second developing unit) that contains a black toner is provided in the image forming station P4 that is located closest to the transfer roller 10, i.e., located in a most downstream side.

In a case where the developing units are disposed in this way, a transparent fluorescent toner image, a yellow toner image, a magenta toner image, and a black toner image are stacked on the intermediate transfer belt 61 in this order. As a result, the black toner image is located at the top. The toner images are then transferred on a sheet by the transfer roller 10. Thus, the order in which the toner images are stacked is reversed. As a result, on the sheet, the black toner image is located at the bottom, and the transparent fluorescent toner image is located at the top.

The transparent fluorescent toner emits (reflects) light when irradiated by ultraviolet light of a predetermined wavelength. Thus, the transparent fluorescent toner can be recognized. Accordingly, in a case where the transparent fluorescent toner image is stacked on the sheet so as to be located below the magenta toner image, cyan toner image and black toner image, the toner located above the transparent fluorescent toner image blocks ultraviolet light, thereby preventing the ultraviolet light from reaching the transparent fluorescent toner image. As a result, the transparent fluorescent toner cannot emit light. Accordingly, even in a case where the transparent fluorescent toner image is stacked together with toner images of other colors, an additional information image formed by the transparent fluorescent toner can be caused to appear without any missing parts by stacking the transparent fluorescent toner image at the top.

Also in a case where the colorless infrared light absorbing toner containing an infrared light absorbing agent is used as an invisible toner, it is preferable that a colorless infrared light absorbing toner image is stacked at the top on a sheet. In a case where the colorless infrared light absorbing toner image is covered by visible toner images, visible toner reflects infrared light used for recognition of the colorless infrared light absorbing toner, thereby preventing the infrared light from reaching the colorless infrared light absorbing toner. As a result, a part of the colorless infrared light absorbing toner which the infrared light does not reach cannot absorb infrared light, and therefore does not become black. By stacking the colorless infrared light absorbing toner image at the top, infrared light can be absorbed without any problem and an additional information image formed by the colorless infrared light absorbing toner can be caused to appear without any missing parts, even in a case where the colorless infrared light absorbing toner image is stacked together with toner images of visible toners.

If it is only desired that the transparent fluorescent toner image be stacked at the top on the sheet, it is possible that the yellow developing unit 2Y shown in (a) of FIG. 2 is removed from the image forming station P1, and is mounted in the image forming station P3 from which the cyan developing unit 2C is removed.

However, in a case where the yellow toner is provided above the magenta toner, color of the magenta toner can be seen through since the yellow toner has higher transmittance than the magenta toner as described above. As a result, a color reproduction range can be widened.

By the way, in a general full-color image forming apparatus, developing units that respectively contain toners of yellow, magenta, cyan, and black are associated with respective image forming stations P in which the developing units are mounted. Such an image forming apparatus confirms whether or not a correct developing unit has been mounted (whether or not a developing unit that contains a toner of a correct color has been mounted). In a case where a developing unit mounted in an image forming station P contains a toner whose color is different from a predetermined one, a user is notified that the developing unit has been mounted in an incorrect image forming station, and the image forming apparatus does not carry out an image forming operation.

It is confirmed whether or not a predetermined developing unit has been mounted in a predetermined image forming station P, for example, by attaching an IC tag to each of the developing units 2 and by reading out information stored in the IC tag when the developing unit is mounted in the image forming station P.

FIGS. 3 and 4 are perspective views each illustrating an outline configuration of one of the developing units 2. As illustrated in FIG. 3, each of the developing units 2 includes a developing tank 200 and a toner cartridge 201. The developing units 2 are detachable from the image forming apparatus 100.

The toner cartridge 201 contains a toner which is a developing agent. As illustrated in FIG. 4, the toner cartridge 201 includes a stirring member 202, an IC tag 203, and a transparent window 204. The stirring member 202 stirs the toner contained in the toner cartridge 201. When the developing unit 2 is mounted in a corresponding image forming station P of the image forming apparatus 100, a dog clutch 205 attached to a rotary axis of the stirring member 202 engages with a dog clutch 205 provided on the image forming apparatus 100. The stirring member 202 is rotated by a driving force from a driving source (not shown) connected to the dog clutch 205 provided on the image forming apparatus 100. The transparent window 204 allows a main body sensor 206 which is a detecting section provided in the image forming apparatus 100 to detect whether or not the developing unit 2 has been mounted.

The IC tag 203 stores at least information indicative of a color of the toner contained in the developing unit 2, for example. The IC tag 203 may additionally store information such as a product name, a serial number, and a manufacturer of a replacement part, and a product name, a manufacturer, a raw material, a volume, and a use-by date of a content.

The information stored in the IC tag 203 is read by a communication section 207 of the image forming apparatus 100. The communication section 207 is provided in each of the image forming stations P1 through P4. The image forming apparatus 100 judges whether or not the developing unit 2 is allowed to be mounted in the corresponding image forming station P on the basis of information read out from the IC tags 203 by the communication sections 207-1 through 207-4 of the image forming stations P1 through P4.

As is clear from (a) and (b) of FIG. 2, in the present image forming apparatus 100, the black developing unit 2K is always mounted in the image forming station P4, but developing units 2 mounted in the other image forming stations P1 through P3 vary depending on whether the image forming apparatus 100 is used for creation of a full-color image or for creation of a secret document.

In the present image forming apparatus 100, in order to allow such a change in the developing units 2 mounted in the image forming stations P, the control section 151 judges a mode of the image forming apparatus 100 on the basis of a developing unit 2 mounted in the image forming station P1. Thus, types (colors) of the developing units 2 that are allowed to be mounted in the image forming stations P are changed depending on whether the image forming apparatus 100 is used for creation of a full-color image or for creation of a secret document.

FIG. 5 is a block diagram illustrating a substantial part of a control system of the image forming apparatus 100.

The control section 151 includes a CPU, a ROM, and a RAM, and is a controlling center that controls each section of the present image forming apparatus 100. The control section 151 is connected to each section (the image forming stations P1 through P4, the exposure unit 1, an image reading section 90 etc.) of the present image forming apparatus 100 via a data bus 155, and controls operations of each section.

The communication sections 207-1 through 207-4 are provided in the image forming stations P1 through P4, and read out information stored in the IC tags 203 attached to developing units 2 mounted in the image forming stations P. The communication section 207-1 is provided in the image forming station P1, the communication section 207-2 is provided in the image forming station P2, the communication section 207-3 is provided in the image forming station P3, and the communication section 207-4 is provided in the image forming station P4. The information read out by the communication sections 207-1 through 207-4 is supplied to the control section 151 via the data bus 155.

The control section 151 determines, based on the information supplied from the communication sections 207-1 through 207-4, whether the present image forming apparatus 100 is used for creation of a secret document or for creation of a full-color image (mode of the image forming apparatus 100).

In the present image forming apparatus 100, the developing unit 2U that contains a transparent fluorescent toner is predetermined as a developing unit mounted in the image forming station P1. Accordingly, in a case where installation of the developing unit 2U that contains a transparent fluorescent toner in the image forming station P1 is detected based on the information supplied from the communication section 207-1, the control section 151 judges that the image forming apparatus 100 is used for creation of a secret document.

Further, in the present image forming apparatus 100, in a full-color image creation mode, the yellow developing unit 2Y is predetermined as a developing unit mounted in the image forming station P1. Accordingly, in a case where installation of the yellow developing unit 2Y in the image forming station P1 is detected based on the information supplied from the communication section 207-1, that, the control section 151 judges that the image forming apparatus 100 is used for creation of a full-color image.

After determining the mode, the control section 151 determines, based on the mode thus determined, types (colors) of developing units 2 that are allowed to be mounted (installed) in the image forming stations P1 through P3. Specifically, in a case where the image forming apparatus 100 is used for creation of a secret document, the transparent fluorescent developing unit 2U is determined as a developing unit 2 that is allowed to be mounted in the image forming station P1, the yellow developing unit 2Y is determined as a developing unit 2 that is allowed to be mounted in the image forming station P2, and the magenta developing unit 2M is determined as a developing unit 2 that is allowed to be mounted in the image forming station P3.

Meanwhile, in a case where the image forming apparatus 100 is used for creation of a full-color image, the yellow developing unit 2Y is determined as a developing unit 2 that is allowed to be mounted in the image forming station P1, the magenta developing unit 2M is determined as a developing unit 2 that is allowed to be mounted in the image forming station P2, and the cyan developing unit 2C is determined as a developing unit 2 that is allowed to be mounted in the image forming station P3.

Note that a developing unit 2 that is allowed to be mounted in the image forming station P4 is the black developing unit 2K regardless of the mode.

This allows developing units 2 mounted in the image forming stations P1 through P3 to vary depending on whether the image forming apparatus 100 is used for creation of a full-color image or for creation of a secret document.

An external communication interface 153 connects a host apparatus and a server apparatus, each of which is an external personal computer, to the present image forming apparatus 100 via a network such as LAN. When the external communication interface 153 receives image data to be printed from the host apparatus, the control section 151 supplies the image data thus received to an image processing section 154.

The image processing section 154 carries out image processing with respect to the image data thus supplied so as to convert the image data into print data for forming toner images corresponding to colors of the toners, and then supplies the print data to the exposure unit 1.

In the present image forming apparatus 100, the image processing carried out in the image processing section 154 varies depending on whether the present image forming apparatus 100 is used for creation of a full-color image or for creation of a secret document.

On this account, the image processing section 154 includes (i) an image processing section 154*a* for full-color image which is an image processing section used for creation of a full-color image and (ii) an image processing section (first image processing means, second image processing means) 154*b* for secret document which is an image processing section used for creation of a secrete document. In FIG. 5, the image processing section 154*a* for full-color image and the image processing section 154*b* for secret document are shown as separate members. Note, however, that the image processing section 154*b* for secret document uses functions of the image processing section 154*a* for full-color image.

The image processing section 154*a* for full-color image carries out conventional image processing for forming a full-color image with respect to image data supplied to the image processing section 154 so as to create print data of yellow, magenta, cyan, and black (function of full-color image processing means).

Meanwhile, the image processing section 154*b* for secret document carries out image processing for two-color image with respect to the image data supplied to the image processing section 154 so as to create print data of yellow, magenta, and black (function of the first image processing means), and create print data of transparent fluorescent color for creating a toner image of additional information (function of the second image processing means).

Here, the image processing section 154*b* for secret document creates the print data of transparent fluorescent color on the basis of an additional pattern. The additional pattern may be stored in a hard disc (HD) 152 provided in the image forming apparatus 100 or may be stored in the RAM or the ROM (not shown) provided in the control section 151, for example. Alternatively, the additional pattern may be obtained, via the external communication interface 153, from the host apparatus or the server apparatus, each of which is an external personal computer, or from an application program on the WEB.

The process of creating print data of transparent fluorescent color, i.e., the process of adding an additional information image to a formed image (printed image, copied image) may be forcibly carried out with respect to all images formed by the image forming apparatus 100. Alternatively, every time an image is formed (every time print job or copy job is carried out), a user may determine whether or not an additional information image is added to the image thus formed, with the use of a screen for settings of a printer driver installed in the host apparatus that is connected to the image forming apparatus 100 via the external communication interface 153.

In the arrangement in which a user can determine, with the use of a screen for settings of a printer driver, whether or not an additional information image is required, the screen for settings of the printer driver may allow the user to select an additional pattern to be used from a plurality of additional patterns or may allow the user to create an additional pattern. Further, the screen for settings of the printer driver may allow the user to determine the way in which the additional pattern thus selected or created is disposed on a document image. Examples of information for determining the way in which the additional pattern is disposed include information indicative of a size of the additional pattern and include, if a plurality of additional patterns are disposed, information indicative of examples of the way in which the plurality of additional patterns are disposed.

Further, in the arrangement in which a user can determine, with the use of a screen for settings of a printer driver, whether or not an additional information image is required, the screen for settings of the printer driver may allow the user to designate a color that can be reproduced by yellow and magenta within a color reproduction range.

The exposure unit 1 exposes the photoreceptor drums 3 of the image forming stations P1 through P4 to light with the use of the print data received from the image processing section 154. The control section 151 causes each section of the image forming stations P1 through P4 to operate in time for the exposure carried out by the exposure unit 1.

FIG. 6 shows image processing carried out in a case where the present image forming apparatus 100 is used for creation of a full-color image.

In response to a print job requested by an external personal computer (PC), image data of a document image is supplied to the image forming apparatus 100 via LAN after driver processing for determining printing conditions. The image forming apparatus 100 receives the image data via the external communication interface 153 (see FIG. 5).

The image processing section 154*a* for full-color image of the image forming apparatus 100 includes an RGB to Lab converting section 170, a color converting section 171, a Lab to YMCK converting section 172, and a halftone processing section 173.

First, the RGB to Lab converting section 170 converts RGB data which is the inputted image data into Lab data. Here, L is a brightness index, and a and b are chromaticity indexes. Next, the color converting section 171 carries out color converting processing, such as color gamut compression, with respect to the Lab data in such a manner that a color gamut of the Lab data falls within an output color reproduction range of the present image forming apparatus 100. Next, the Lab to YMCK converting section 172 converts, with reference to a predetermined table, the Lab data into YMCK data of yellow, magenta, cyan, and black corresponding to the colors of the image forming stations P1 through P4. Then, the halftone processing section 173 creates halftone data of the YMCK data. Thus, print data of yellow, magenta, cyan, and black are created.

The halftone processing section 173 is provided with four output sections OUT1 through OUT4. The halftone data (print data) of yellow data is outputted from the output section OUT1. The halftone data of magenta data is outputted from the output section OUT2, the halftone data of cyan data is outputted from the output section OUT3, and the halftone data of black data is outputted from the output section OUT4.

Meanwhile, the exposure unit 1 is provided with input sections IN1 through IN4 corresponding to the four image forming stations P1 through P4. An electrostatic latent image is formed on the photoreceptor drum 3 of the image forming station P1 with the use of halftone data (print data) supplied to the input section IN1. An electrostatic latent image is formed on the photoreceptor drum 3 of the image forming station P2 with the use of print data supplied to the input section IN2, an electrostatic latent image is formed on the photoreceptor drum 3 of the image forming station P3 with the use of print data supplied to the input section IN3, and an electrostatic latent image is formed on the photoreceptor drum 3 of the image forming station P4 with the use of print data supplied to the input section IN4.

In the case where the image processing of the image processing section 154*a* for full-color image is carried out, the control section 151 connects the output sections OUT1, OUT2, OUT3, and OUT4 of the halftone processing section 173 to the input sections IN1, IN2, IN3, and IN4 of the exposure unit 1, respectively.

Thus, in the image forming station P1 in which the yellow developing unit 2Y is mounted, an electrostatic latent image is formed with the use of yellow print data, and in the image forming station P2 in which the magenta developing unit 2M is mounted, an electrostatic latent image is formed with the use of magenta print data. Further, in the image forming station P3 in which the cyan developing unit 2C is mounted, an electrostatic latent image is formed with the use of cyan print data, and in the image forming station P4 in which the black developing unit 2K is mounted, an electrostatic latent image is formed with the use of black print data.

Next, FIGS. 7 and 8 show image processing carried out in a case where the present image forming apparatus 100 is used for creation of a secret document. FIG. 7 shows an example in which an additional pattern and an example of the way in which the additional patter is disposed are determined with the use of a screen for settings of a printer driver so that additional information data is created in the printer driver. Meanwhile, FIG. 8 shows an example in which additional information data is created within the image forming apparatus 100.

First, the example shown in FIG. 7 is described. According to the arrangement of FIG. 7, creation of an additional pattern and creation of additional information data are carried out in driver processing. Accordingly, the printer driver includes an additional pattern creating section 111*a* and an additional information data creating section 111*b*. A user determines necessity of an additional pattern, selects an additional pattern, and designates the way in which the additional pattern is disposed with the use of a screen for settings of the printer driver. Created additional information data is supplied to the image forming apparatus 100 along with image data of a document image which is supplied in response to a print job.

The image processing section 154*b* for secret document of the image forming apparatus 100 includes a chromatic color extracting section 180, a gray converting section 181, a designated color converting section 182, a gray gradation correcting section 183, an additional pattern extracting section 184, a gradation correcting section 185, a transparent fluorescent color data creating section 186, and the halftone processing section 173.

First, the chromatic color extracting section 180 extracts a chromatic color based on RGB data which is inputted image data so as to separate the RGB data into chromatic color data and achromatic color data. This processing is carried out to determine an output of black and a designated color using colors (yellow and magenta in this case) other than black. The designated color is a color that can be reproduced with the use of yellow toner and magenta toner. FIGS. 7 and 8 each show an example in which the designated color is determined in advance.

The gray converting section 181 converts all the chromatic color data into gray data in such a manner that brightness (lightness) is preserved in order to convert the chromatic color data into a designated color. Then, the designated color converting section 182 converts the gray data into a ratio of yellow and magenta which constitutes the designated color in accordance with a hue (red in the present embodiment) expressing the designated color. Thus, yellow data and magenta data are created. Subsequently, the halftone processing section 173 creates, as output data (print data) for each plane, halftone data of the yellow data and the magenta data that constitute the designated color.

Meanwhile, the achromatic color data separated from the chromatic color data in the chromatic color extracting section 180 is supplied to the gray gradation correcting section 183. The gray gradation correcting section 183 carries out gray gradation correction with respect to the achromatic data so as to create black data. Then, the halftone processing section 173 creates, as output data (print data) of a black plane, halftone data of the black data.

Further, in parallel to the image data processing, the additional pattern extracting section 184 extracts an additional pattern on the basis of inputted additional information data. The gradation correcting section 185 carries out gradation correction with respect to the additional pattern thus extracted. Then, the transparent fluorescent color data creating section 186 creates transparent fluorescent color data. Subsequently, the halftone processing section 173 creates, as output data (print data) of a transparent fluorescent color plane, halftone data of the transparent fluorescent color data. The transparent fluorescent color data is supplied to the halftone processing section 173 as if it is cyan data.

As in the case where the image forming apparatus 100 is used for creation of a full-color image, the halftone processing section 173 causes the halftone data of the yellow data to be outputted from the output section OUT1 and causes the halftone data of the magenta data to be outputted from the output section OUT2. The halftone data of the transparent fluorescent color data is outputted from the output section OUT3 corresponding to cyan, and the halftone data of the black data is outputted from the output section OUT4.

Meanwhile, as described above, the input sections IN1 through IN4 of the exposure unit 1 are associated with the image forming stations P1 through P4, respectively.

Accordingly, the control section 151 of FIG. 5 switches connections between the output sections OUT1 through OUT3 of the halftone processing section 173 and the input sections IN1 through IN3 of the exposure unit 1 to those corresponding to the developing units 2U, 2Y, and 2M mounted in the image forming stations P1 through P3, respectively.

Specifically, the output section OUT3 is connected to the input section IN1 corresponding to the image forming station P1 in which the transparent fluorescent color developing unit 2U is mounted, the output section OUT1 is connected to the input section IN2 corresponding to the image forming station P2 in which the yellow developing unit 2Y is mounted, and the output section OUT2 for magenta is connected to the input section IN3 corresponding to the image forming station P3 in which the magenta developing unit 2M is mounted.

Thus, in the image forming station P1 in which the transparent fluorescent color developing unit 2U is mounted, an electrostatic latent image is formed with the use of the transparent fluorescent color print data, in the image forming station P2 in which the yellow developing unit 2Y is mounted, an electrostatic latent image is formed with the use of the yellow print data, and in the image forming station P3 in which the magenta developing unit 2M is mounted, an electrostatic latent image is formed with the use of magenta print data.

Note that the output section OUT4 from which the halftone data of the black data is outputted is always connected to the input section IN4 corresponding to the image forming station P4 in which the black developing unit 2K is mounted, regardless of the mode.

Meanwhile, FIG. 8 shows an example in which additional information data is created within the image forming apparatus 100 as described above. In this example, the image forming apparatus 100 includes an image processing section 154*b*1 for secret document which includes an additional pattern creating section 188. Thus, an additional pattern is created within the image forming apparatus 100 on the basis of additional patterns stored in the hard disc (HD) 152 shown in FIG. 5 or the RAM and ROM of the control section 151.

In a case where additional pattern data is created within the image forming apparatus 100 as described above, an additional information image formed with the use of a transparent fluorescent toner may be forcibly printed on all printed or copied images or a user may determine, with the use of a printer driver installed in an external personal computer PC, whether or not an additional information image formed with the use of a transparent fluorescent toner should be printed on an original image.

FIG. 9 shows another image processing carried out in a case where the image forming apparatus 100 is used for creation of a secret document. In this case, a designated color can be additionally selected with the use of a screen for settings of a printer driver.

In driver processing, creation of an additional pattern, creation of additional information data, and selection of a designated color are carried out. Accordingly, the printer driver includes a designated color setting section 112 in addition to the additional pattern creating section 111*a* and the additional information data creating section 111*b*.

A user determines not only necessity of an additional pattern, an additional pattern to be used, and the way in which the additional pattern is disposed etc. but also a designated color. Created additional information data and information of the designated color are supplied to the image forming apparatus 100 along with image data of a document image which is supplied in response to a print job. An image processing section 154*b*' for secret document detects the user designated color designated within a color reproduction range determined by yellow and magenta, and creates yellow print data and magenta print data so that the user designated color thus detected can be obtained. That is, the designated color converting section 182 converts gray data into a ratio of yellow and magenta constituting the user designated color that has been designated with the use of a screen for settings of the printer driver.

This allows a user to determine a color reproduced by two of the visible toners other than the black toner, thereby improving convenience of the image forming apparatus 100. Note that the driver processing is the same as that of FIG. 7 except for that the designated color can be determined, and therefore is not explained any further.

FIG. 10 shows another exemplary arrangement in which the connections between the output sections OUT1 through OUT4 of the halftone processing section 173 and the input sections IN1 through IN4 of the exposure unit 1 in the image processing section 154 are the same as those of the case where the image forming apparatus 100 is used for creation of a full-color image (see FIG. 6), but instead processing corresponding to the switching of the connections (switching of the connections that is carried out in a case where the image forming apparatus 100 is used for creation of a secret document) is carried out within an image processing section 154' for secret document.

As described above, the halftone processing section 173 is provided with the four output sections OUT1 through OUT4. In a case where the image forming apparatus 100 is used for creation of a full-color image, halftone data of yellow data is outputted from the output section OUT1, halftone data of magenta data is outputted from the output section OUT2, halftone data of cyan data is outputted from the output section OUT3, and halftone data of black data is outputted from the output section OUT4.

In the arrangement of FIG. 10, the image processing section 154*b*' for secret document changes which of the output sections OUT1 through OUT3 of the halftone processing section 173 the yellow data, magenta data, which are created in the designated color converting section 182, and transparent fluorescent color data, which is created in the transparent fluorescent color data creating section 186, are supplied to.

Specifically, the transparent fluorescent color data created in the transparent fluorescent color data creating section 186 is supplied to the halftone processing section 173 as if it is yellow data. Thus, halftone data (print data) of the transparent fluorescent color data is outputted from the image forming station P1 (corresponding to yellow in the full-color image creation mode) in which the transparent fluorescent color developing unit 2U is mounted.

Further, the yellow data created in the designated color converting section 182 is supplied to the halftone processing section 173 as if it is magenta data. Thus, halftone data (print data) of the yellow data is outputted from the image forming station P2 (corresponding to magenta in the full-color image creation mode) in which the yellow developing unit 2Y is mounted.

Further, the magenta data created in the designated color converting section 182 is supplied to the halftone processing section 173 as if it is cyan data. Thus, halftone data (print data) of the magenta data is outputted from the image forming station P3 (corresponding to cyan in the full-color image creation mode) in which the magenta developing unit 2M is mounted.

As a result, in the image forming station P1 in which the transparent fluorescent color developing unit 2U is mounted, an electrostatic latent image is formed with the use of the transparent fluorescent color print data, in the image forming station P2 in which the yellow developing unit 2Y is mounted, an electrostatic latent image is formed with the use of the yellow print data, and in the image forming station P3 in which the magenta developing unit 2M is mounted, an electrostatic latent image is formed with the use of the magenta print data without changing connections between the halftone processing section 173 and the exposure unit 1 from those (see FIG. 6) of the case where the image forming apparatus 100 is used for creation of a full-color image.

According to the arrangement of FIG. 10, even a conventional full-color image forming apparatus, which does not have the function of detecting a change in developing units mounted in the image forming stations P1 through P3, can be turned into an image forming apparatus of the present invention which can create a secret document by updating software including a printer driver, provided that (i) the image processing section 154*b* for secrete document can carry out image processing with the use of the image processing section 154*a* for full-color image and (ii) only updating of the software is necessary.

FIG. 11 shows an example in which a monochromatic visible pattern can be created with the use of a screen for settings of a printer driver in addition to the exemplary arrangement of FIG. 9. That is, in driver processing, creation of an additional pattern, creation of additional information data, selection of a designated color, and creation of a monochromatic visible pattern are carried out. Accordingly, the printer driver includes a monochromatic visible pattern creating section 113 in addition to the additional pattern creating section 111*a*, the additional information data creating section 111*b*, and the designated color setting section 112.

A user determines not only necessity of an additional pattern, an additional pattern to be used, the way in which the additional pattern is disposed etc., but also determines a designated color and necessity of a monochromatic visible pattern. As with the additional pattern formed with the use of a transparent fluorescent toner, the monochromatic visible pattern may be selected from monochromatic color patterns stored in the hard disc (HD) 152 provided in the image forming apparatus 100 or may be obtained from the host apparatus or the server apparatus, each of which is an external personal computer, or from an application program on the WEB via the external communication interface 153.

An image processing section 154*b*" for secret document further includes a monochromatic visible pattern combining section 187 which combines data of the monochromatic visible pattern created in the monochromatic visible pattern creating section 113 with yellow data and magenta data that are supplied from the designated color converting section 182. Data thus combined is supplied to the halftone processing section 173.

In a case where the monochromatic visible pattern creating section 113 is provided, an image of a chromatic color that is different from the designated color can be formed within a color reproduction range determined by two types of visible toners, i.e., yellow toner and magenta toner. This allows an improvement in convenience of the image forming apparatus. Note that the other processing is the same as that of FIG. 9, and therefore is not explained repeatedly.

FIG. 12 (*a*) shows exemplary arrangements of print data and a printing result obtained in a case where the image forming apparatus is used for creation of a full-color image and where image data of a document image of RGB data is printed, and FIG. 12 (*b*) shows exemplary arrangements of print data and a printing result obtained in a case where the image forming apparatus is used for creation of a secret document and where image data of a document image of RGB data is printed.

These cases are the same in black data containing "CERTIFICATE . . . " indicated by the reference numeral 309. Meanwhile, these cases are different in yellow data and magenta data. This is because cyan data (indicated by the reference numeral 310), which should be formed with the use of a cyan toner, is reproduced by yellow data and magenta data in a case where the image forming apparatus 100 is used for creation of a secret document. In the present image forming apparatus 100, image processing in which cyan data is reproduced by yellow data and magenta data is carried out. Note, however, that image processing in which cyan data is omitted may be carried out.

"ACKNOWLEDGED" indicated by the reference numeral 308 is a part of a document image in which part a seal is stamped and which part is reproduced by a designated color.

In this example, words "ORIGINAL DOCUMENT" (indicated by the reference numeral 311) that are equally spaced on an entire recording sheet and a two-dimensional bar code (indicated by the reference numeral 312) that is located on a lower left portion of the document are printed as additional patterns.

As described above, according to the image forming apparatus 100 of the present embodiment, the image processing section 154*b* for secret document creates print data of visible toners of black, yellow, and magenta based on image data of a document image with the use of the functions of the image processing section 154*a* for full-color image, and creates print data for the transparent fluorescent toner based on additional information data. Then, the image forming stations P1 through P4 serving as an image forming section reproduce the document image with the use of the visible toners on the basis of the print data of the respective visible toners, and reproduce an additional information image with the use of the transparent fluorescent toner on the basis of the print data for the transparent fluorescent color.

With the arrangement, although a full-color image of the document image cannot be reproduced, it is possible to obtain an image that is difficult to falsify and forge in which the additional information image is printed, with the use of the transparent fluorescent toner, on the document image that is expressed by black and a color that is reproduced within a color reproduction range determined by two of the visible toners other than the black toner.

Furthermore, since four developing units 2 are mounted in the image forming apparatus 100, the image forming apparatus 100 except the image processing section 154*b*, 154*b*1, 154*b*' or 154*b*" for secret document can be easily realized from a widely-used full-color image forming apparatus by replacing, with the developing unit 2U that contains an invisible toner, one of developing units other than a black developing unit, i.e., one of yellow developing unit, magenta developing unit, and cyan developing unit.

Further, the image processing section 154*b*, 154*b*1, 154*b*' or 154*b*" for secret document also can be realized just by updating software, for example, by loading an image processing program into an arithmetic processing section including CPU etc. of a full-color image forming apparatus or by changing a printer driver of the image forming apparatus in addition to this.

It is thus possible to provide a small and inexpensive image forming apparatus which can output an image that is difficult to falsify and forge in compliance with a users' demand.

The above description has dealt with a case where the image forming apparatus 100 is a printer which processes externally supplied image data. However, the image forming apparatus 100 may be applied to a copying machine. In a case where the image forming apparatus 100 is applied to a copying machine, selection of an additional pattern and selection of a designated color are carried out with the use of an operation panel or the like.

In a case where the functions of the present invention are applied to a copying machine, an additional pattern can be added to a document on which no additional pattern is added by copying the document. This allows even a document created by a normal printer which does not have the functions of the present invention to be turned into a document on which an additional pattern is added by copying the document with the use of a copying machine having the functions of the present invention. Thereafter, the document to which the additional pattern is thus added can be managed as an original document.

The following description deals with switching between the mode in which the image forming apparatus 100 is used for creation of a full-color image and the mode in which the image forming apparatus 100 is used for creation of a secret document.

As described above, developing units 2 mounted in the image forming stations P1 through P3 differ depending on whether the image forming apparatus 100 is used for creation of a full-color image or for creation of a secret document. This necessitates switching a standard by which the control section 151 judges whether developing units 2 that have been mounted are correct ones or not. Further, it is also necessary to change image processing carried out in the image processing section 154 and to change connections between the output sections of the image processing section 154 and the input sections of the exposure unit 1.

As described above, in the present image forming apparatus 100, the control section 151 determines a mode of the image forming apparatus 100 on the basis of a developing unit 2 mounted in the image forming station P1.

In a case where the yellow developing unit 2Y is mounted in the image forming station P1, the control section 151 determines that the image forming apparatus 100 is used for creation of a full-color image. Then, the developing units 2Y, 2M, 2C, and 2K are determined as developing units 2 that are allowed to be mounted in the image forming stations P1, P2, P3, and P4, respectively.

Meanwhile, in a case where the transparent fluorescent color developing unit 2U is mounted in the image forming station P1, the control section 151 determines that the image forming apparatus 100 is used for creation of a secret document. Then, the developing units 2U, 2Y, 2M, and 2K are determined as developing units 2 that are allowed to be mounted in the image forming stations P1, P2, P3, and P4, respectively.

In a case where it is determined that the image forming apparatus 100 is used for creation of a full-color image and where a previous mode is the mode for creation of a secret document, the control section 151 switches a processing system used in the image processing section 154 from the image processing section 154*b*, 154*b*1, 154*b*' or 154*b*" for secret document to the image processing section 154*a* for full-color image. Further, in a case where the image processing section 154*b*, 154*b*1 or 154*b*" for secret document was used in the image processing section 154, connections between the output sections of the image processing section 154 (output sections of the halftone processing section 173) and the input sections of the exposure units 1 are changed to those for creation of a full-color image (see FIG. 6).

Meanwhile, in a case where it is determined that the image forming apparatus 100 is used for creation of a secret document and where a previous mode is the mode for creation of a full-color image, the control section 151 switches a processing system used in the image processing section 154 from the image processing section 154*a* for full-color image to the image processing section 154*b*, 154*b*1, 154*b*' or 154*b*" for secret document. Further, in a case where the image processing section 154*b*, 154*b*1 or 154*b*" for secret document is used in the image processing section 154, connections between the output sections of the image processing section 154 (output sections of the halftone processing section 173) and the input sections of the exposure units 1 are changed to those for creation of a secret document (see FIGS. 7, 8, 9, and 11).

Alternatively, another arrangement is also possible in which the mode is determined based on developing units 2 mounted in the image forming stations P1 and P2. In this arrangement, the control section 151 detects types (colors) of the developing units 2 mounted in the image forming stations P1 and P2 on the basis of information supplied from the communication sections 207-1 through 207-4. Then, the control section 151 determines, based on the types (colors) thus detected, whether the image forming apparatus 100 is used for creation of a full-color image or for creation of a secret document (i.e., the mode of the image forming apparatus 100). Then, the control section 151 determines, based on the mode thus determined, types (colors) of developing units 2 which are allowed to be mounted (installed) in the image forming stations P1 through P3.

Specifically, in a case where it is determined, based on the information supplied from the communication sections 207-1 through 207-2, that the transparent fluorescent color developing unit 2U is mounted in the image forming station P1 and that the yellow developing unit 2Y is mounted in the image forming station P2, the control section 151 determines that the image forming apparatus 100 is used for creation of a secret document. Then, the transparent fluorescent color developing unit 2U is determined as a developing unit 2 that is allowed to be mounted in the image forming station P1, the yellow developing unit 2Y is determined as a developing unit 2 that is allowed to be mounted in the image forming station P2, and the magenta developing unit 2M is determined as a developing unit 2 that is allowed to be mounted in the image forming station P3.

Meanwhile, in a case where it is determined, based on the information supplied from the communication sections 207-1 through 207-2, that the yellow developing unit 2Y is mounted in the image forming station P1 and that the magenta developing unit 2M is mounted in the image forming station P2, the control section 151 determines that the image forming apparatus 100 is used for creation of a full-color image. Then, the yellow developing unit 2Y is determined as a developing unit 2 that is allowed to be mounted in the image forming station P1, the magenta developing unit 2M is determined as a developing unit 2 that is allowed to be mounted in the image forming station P2, and the cyan developing unit 2C is determined as a developing unit 2 that is allowed to be mounted in the image forming station P3.

It can be assumed that, for example, a user who is not familiar with the image forming apparatus 100 mistakenly places the transparent fluorescent color developing unit 2U in the image forming station P1, although the user wishes to use the image forming apparatus 100 for the purpose of creation of a full-color image. In an arrangement in which the mode is determined only based on a developing unit 2 mounted in the image forming station P1, the mode is undesirably switched even when the transparent fluorescent color developing unit 2U is mistakenly mounted.

Meanwhile, in the arrangement in which the mode is determined based on two developing units 2 mounted in the image forming stations P1 and P2, it is not until the yellow developing unit 2Y is mounted in the image forming station P2 that the mode is determined. Since the switching of the mode is more carefully carried out, it is possible to avoid unnecessary switching of the mode caused by such misplacement of a developing unit 2.

The present embodiment is not limited to the arrangement in which the image forming apparatus 100 itself determines the mode. Another arrangement is also possible in which a serviceman determines the mode in conformity with user's wishes. In this case, a standard by which the control section 151 determines whether developing units 2 respectively mounted in the image forming stations P1 through P4 are allowed to be mounted or not is determined in advance. Thus, a processing system used in the image processing section 154 and connections between the output sections of the image processing section 154 and the input sections of the exposure unit 1 are forcibly switched. In this way, it is possible to exclude combinations other than a combination determined in advance.

Further, another arrangement is also possible in which a serviceman replaces firmware which is software for causing the image forming apparatus 100 to operate, in conformity with user's wishes. In this case, a standard by which the control section 151 determines whether developing units 2 are allowed to be mounted or not, a processing system used in the image processing section 154, and connections between the output sections of the image processing section 154 and the input sections of the exposure unit 1 are collectively switched. In this case, since the firmware is replaced, an image forming apparatus cannot be switched between the mode for creation of a full-color image and the mode for creations of a secret document, for example, by replacing developing units 2, unlike the above image forming apparatus 100. Therefore, seemingly, such an image forming apparatus can be used only for creation of a full-color image or only for creation of a secret document. However, such an arrangement is also encompassed in the scope of the present invention.

As described above, in other words, an image forming apparatus of the present invention is an image forming apparatus in which four developing units can be mounted, the image forming apparatus including: the developing unit 2U that contains an invisible toner which can hardly be observed under visible light; the developing unit 2K that contains a visible toner of black; and two of the developing units 2Y, 2M, and 2C that contain yellow toner, magenta toner, and cyan toner, respectively; and the image processing section 154*b* for secret document which (i) creates print data for the visible toner of black, and print data for two of the visible toners of yellow, magenta, and cyan with the use of the functions of the image processing section 154*a* for full-color image for creating print data for respective visible toners of black, yellow, magenta, and cyan on the basis of image data of a document image, and (ii) creates print data of the invisible toner on the basis of image data of an additional information image.

The image forming stations P1 through P4 form, on a recording sheet, an image created by forming toner images according to the image data of the document image with the use of the print data for the respective visible toners which print data are created in the image processing section 154*b* for secret document and by forming a toner image according to the image data of the additional information image with the use of the print data of the invisible toner which print data is created in the image processing section 154*b* for secret document.

Further, in other words, an image forming apparatus of the present invention is an image forming apparatus in which four developing units can be mounted, the image forming apparatus including: the image processing section 154*a* for full-color image which creates print data for respective visible toners of black, yellow, cyan, and magenta on the basis of image data of a document image; and the image processing section 154*b* for secret document which (i) separates the image data of the document image into chromatic data and achromatic data, (ii) creates, based on the chromatic data, print data for respective visible toners of chromatic colors and creates, based on the achromatic data, print data for the visible toner of black with the use of the functions of the image processing section 154*a* for full-color image, and (iii) creates, based on image data of an additional information image, print data for an invisible toner which can hardly be observed under visible light.

In the full-color mode, the developing units 2K, 2Y, 2M, and 2C that respectively contain the visible toners of black, yellow, magenta, and cyan are mounted, and the image forming stations P1 through P4 form toner images according to the image data of the document image with the use of the print data of the respective visible toners which print data are created in the image processing section 152*a* for full-color image, and form, on a recording sheet, a full-color image that is created from the toner images thus formed.

Meanwhile, in the transparent color mode, the developing unit 2U that contains an invisible toner is mounted in replacement of one of the developing units used in the full-color image mode other than the black developing unit 2K, i.e., one of the three developing units 2Y, 2M, and 2C that respectively contain the visible toners of yellow, cyan, and magenta, and the image forming stations P1 through P4 form (i) toner images according to the image data of the document image with the use of the print data for the respective visible toners which print data are created in the image processing section 154*b* for secret document and (ii) a toner image according to the image data of the additional information image with the use of the print data for the invisible toner which print data is created in the image processing section 154*b* for secret document, and form, on a recording sheet, an image created from the toner images thus formed.

Embodiment 2

The present embodiment discusses, as an example, an arrangement in which an image forming apparatus includes three developing units, i.e., a developing unit that contains an invisible toner, a developing unit that contains a visible toner of black, and a developing unit that contains a visible toner of a specific chromatic color in a case where the image forming apparatus functions as an image forming apparatus for creation of a secret document.

For convenience of description, constituents that have identical functions to those of the Embodiment 1 are given identical reference numerals, and are not explained repeatedly.

Like the image forming apparatus 100 of the Embodiment 1, an image forming apparatus 101 of the Embodiment 2 functions not only as an image forming apparatus for creation of a full-color image (full-color mode) but also as an image forming apparatus for creation of a secret document (transparent color mode).

In a case where the image forming apparatus 101 functions as an image forming apparatus for creation of a full-color image, developing units 2K, 2C, 2M, and 2Y that respectively contain toners (visible toners) of black (K), cyan (C), magenta (M), and yellow (Y) for creating a full-color image are mounted in four image forming stations P1 through P4 (see FIG. 1) as illustrated in (a) of FIG. 13, as in the image forming apparatus 100.

The present image forming apparatus 101 is different from the image forming apparatus 100 in mode for creation of a secret document (transparent color mode).

In a case where the present image forming apparatus 101 functions as an image forming apparatus for creation of a secret document, the black developing unit 2K, a transparent fluorescent color developing unit 2U, and a specific color developing unit 2R that contains a visible toner of a specific color are mounted in three image forming stations out of the four image forming stations P1 through P4, and no developing unit is mounted in a remaining image forming station, as illustrated in (b) of FIG. 13.

This allows the image forming apparatus 101 used for creation of a secret document to output an image which is difficult to falsify and forge in which an additional information image formed with the use of a transparent fluorescent toner which is an invisible toner is printed on a document image expressed by black and the specific color.

The specific color may be any chromatic color which a user desires. In the present image forming apparatus 101, the specific color is red, which can reproduce color of a vermillion inkpad.

In a case where the specific color is a color which falls within a color reproduction range that can be expressed by a combination of two chromatic colors, the specific color can be obtained by mixing the colors. However, in a case where the specific color is obtained by mixing the colors, it is difficult to completely prevent a change in tinge caused by humidity and temperature of a space in which the image forming apparatus is placed or temperature etc. within the image forming apparatus. Further, in a case where the specific color is obtained by mixing the colors, it may be impossible to obtain a desired color by any image processing due to a restriction of the color reproduction range.

As described above, countries, such as Japan and China, in which seals are used, place a high value on red of a vermillion inkpad. China especially places a special importance on red of a vermillion inkpad among various kinds of red.

In view of this, in the present image forming apparatus 101, a visible toner that is produced in advance so as to exhibit a specific desired color by itself is used. This naturally causes no problem related to a color reproduction range. Further, it is possible to surely prevent a change in tinge caused by humidity and temperature of a space in which the image forming apparatus is placed or temperature etc. within the image forming apparatus.

As a result, in countries, such as Japan and China, in which seals are used, the present image forming apparatus 101 can be a high-value added apparatus that is capable of constantly and stably reproducing a desired color of a vermillion inkpad well in a case where the image forming apparatus 101 is used for creation of a secret document.

In the present image forming apparatus 101, it is preferable that the black developing unit 2K, the transparent fluorescent color developing unit 2U, and the specific color developing unit 2R be disposed as illustrated in (b) of FIG. 13.

Specifically, it is preferable that the transparent fluorescent color developing unit 2U (first developing unit), the specific color developing unit 2R (fifth developing unit), and the black developing unit 2K (second developing unit) be disposed in this order from an upstream side towards a downstream side of a rotation direction of the intermediate transfer belt 61, which rotates in a direction indicated by the arrow X, when viewed from the transfer roller 10.

In a case where the developing units are disposed in this way, a transparent fluorescent toner image, a toner image of the specific color, and a black toner image are staked in this order on the intermediate transfer belt 61. As a result, the black toner image is located at the top. Then, in a case where the toner images are transferred on a sheet by the transfer roller 10, the order in which the toner images are stacked is reversed. As a result, on the sheet, the black toner image is located at the bottom, and the transparent fluorescent toner image is located at the top.

This allows the transparent fluorescent toner to be located at the top, as in the image forming apparatus 100. Consequently, an additional information image formed with the use of the transparent fluorescent toner can be caused to appear without any missing parts even in a case where the transparent fluorescent toner image is stacked along with toner images of other colors.

In the example of (b) of FIG. 13, the image forming station P2 is an empty station. Note, however, that the image forming station P1 or P3 may be an empty station.

However, the present image forming apparatus 101 employs an arrangement in which a control section 151 (see FIG. 5) determines a mode of the image forming apparatus 101 on the basis of a developing unit 2 mounted in the image forming station P1 that is located in a most upstream side of the rotation direction, as in the image forming apparatus 100. In such an arrangement, an arrangement in which the image forming station P1 is an empty station cannot be employed.

The control section 151 switches, depending on whether the image forming apparatus 101 is used for creation of a full-color image or for creation of a secret document, the types (colors) of developing units 2 that are allowed to be mounted in the image forming stations P as follows.

Also in the present embodiment, the control section 151 determines, based on information supplied from the communication sections 207-1 through 207-4, whether the present image forming apparatus 101 is used for creation of a secret document or for creation of a full-color image (i.e., mode of the image forming apparatus 101).

As in the image forming apparatus 100, in a case where installation of the yellow developing unit 2Y in the image forming station P1 is detected, the control section 151 determines that the image forming apparatus 101 is used for creation of a full-color image. Meanwhile, in a case where installation of the transparent fluorescent color developing unit 2U in the image forming station P1 is detected, the control section 151 determines that the image forming apparatus 101 is used for creation of a secret document.

In a case where it is determined that the image forming apparatus 101 is used for creation of a secret document, the control section 151 determines that the transparent fluorescent color developing unit 2U is a developing unit 2 that is allowed to be mounted in the image forming station P1, no developing unit is mounted in the image forming station P2, the specific color developing unit 2R is a developing unit 2 that is allowed to be mounted in the image forming station P3, and the black developing unit 2K is a developing unit 2 that is allowed to be mounted in the image forming station P4.

FIG. 14 shows image processing carried out in a case where the present image forming apparatus 101 is used for creation of a secret document. FIG. 14 corresponds to FIG. 7 of the Embodiment 1, and shows an example in which an additional pattern an example of the way in which the additional pattern is disposed are determined with the use of a screen for settings of a printer driver, and additional information data is created in the printer driver.

According to this example, a chromatic color extracting section 180 extracts a chromatic color on the basis of RGB data which is inputted image data so as to separate the RGB data into chromatic data and achromatic data. This process is carried out to determine an output of black and color (specific color, in this case) other than black.

A gray converting section 181 converts all the chromatic data thus separated into gray data in such a manner that brightness (lightness) of the chromatic data is maintained in order to convert the gray data into the specific color. Then, a designated color converting section 182 creates specific color data from the gray data, and a halftone processing section 173 creates, as output data (print data) for a specific color plane, halftone data of the specific color data. The specific color data is supplied to the halftone processing section 173 as if it is magenta data.

Note that a process for creating output data (print data) for a black plane and a process for creating output data (print data) for a transparent fluorescent color plane are identical to those explained with reference to FIG. 7, and therefore are not explained repeatedly.

The halftone processing section 173 causes the specific color print data which disguises as magenta print data to be outputted from OUT2 as in the case where the image processing apparatus 101 operates as an image processing apparatus for creation of a full-color image. Further, the transparent fluorescent color print data which disguises as cyan print data is outputted from OUT3, and the halftone data of the black data is outputted from an output section OUT4.

The control section 151 switches connections between the output sections OUT2 and OUT3 of the halftone processing section 173 and input sections IN1 and IN3 of an exposure unit 1 so that the transparent fluorescent color print data and the specific color print data that are outputted from the halftone processing section 173 correspond to the developing units 2U and 2R mounted in the image forming stations P1 and P3, respectively.

Specifically, the input section IN1 that corresponds to the image forming station P1 in which the transparent fluorescent color developing unit 2U is mounted is connected to the output section OUT3 (output section for cyan) of the halftone processing section 173, and the input section IN3 that corresponds to the image forming station P3 in which the specific color developing unit 2R is mounted is connected to the output section OUT2 (output section for magenta) of the halftone processing section 173.

Note that a connection between the output section OUT4 of the halftone processing section 173 and the input section IN4 of the exposure unit 1 is never changed.

The above description has dealt with the example of FIG. 14 that corresponds to FIG. 7 of the Embodiment 1. However, an arrangement shown in FIG. 15 that corresponds to FIG. 8 of the Embodiment 1 is also possible. In the arrangement of FIG. 15, an image processing section 154*b*1 for secret document includes an additional pattern creating section 188. Thus, an additional pattern is created within the image forming apparatus 101 on the basis of additional patterns stored in a hard disc (HD) 152 or RAM and ROM of the control section 151 (see FIG. 5).

Further, an arrangement shown in FIG. 16 that corresponds to FIG. 10 of the Embodiment 1 is also possible. In the arrangement of FIG. 16, connections between the output sections OUT1 through OUT4 of the halftone processing section 173 and the input section IN1 through IN4 of the exposure unit 1 in the image processing section 154 are identical to those of the case where the image forming apparatus 101 is used for creation of a full-color image (see FIG. 6), but instead processing corresponding to the switching of the connections (switching of the connections that is carried out in a case where the image forming apparatus 101 is used for creation of a secret document) is carried out within an image processing section 154*b*' for secret document. Note that the designated color setting section 112 shown in FIG. 10 is not provided in the present image forming apparatus 101. This is because a designated color cannot be designated since the visible toner of the specific color is used in the present image forming apparatus 101.

Transparent fluorescent color data created in a transparent fluorescent color data creating section 186 is supplied to the halftone processing section 173 as if it is yellow data. Further, specific color data created in the designated color converting section 182 is supplied to the halftone processing section 173 as if it is cyan data.

This allows halftone data (print data) of the transparent fluorescent color to be outputted from the image forming station P1 (corresponding to yellow in the full-color image creation mode) in which the transparent fluorescent color developing unit 2U is mounted. Further, halftone data (print data) of the specific color is outputted from the image forming station P3 (corresponding to cyan in the full-color image creation mode) in which the specific color developing unit 2R is mounted.

Furthermore, an arrangement shown in FIG. 17 that corresponds to FIG. 11 of the Embodiment 1 is also possible. In the arrangement of FIG. 17, a printer driver includes a monochromatic visible pattern creating section 113 in addition to an additional pattern creating section 111*a* and an additional information data creating section 111*b*. Thus, a monochromatic visible pattern can be determined with the use of a screen for settings of the printer driver. Also in this example, the designated color setting section 112 shown in FIG. 11 is not provided in the present image forming apparatus 101. This is because the visible toner of the specific color is used in the present image forming apparatus 101, and therefore a designated color cannot be designated.

Embodiment 3

The present embodiment discusses, as an example, an arrangement in which an image forming apparatus includes: a developing unit that contains an invisible toner, a developing unit that contains a visible toner of black, and two developing units each containing a visible toner of a specific color, i.e., a developing unit that contains first visible toner and a developing unit that contain second visible toner in a case where the image forming apparatus functions as an image forming apparatus for creation of a secret document, the image forming apparatus further including a specific color switching section (developing unit selecting means) that selects, based on a predetermined condition, one of the two developing units each containing a visible toner of a specific color.

For convenience of description, constituents that have identical functions to those used in the Embodiments 1 and 2 are given identical reference numerals, and are not explained repeatedly.

Like the image forming apparatus 100 of the Embodiment 1 and the image forming apparatus 101 of the Embodiment 2, an image forming apparatus 102 of the Embodiment 3 functions not only as an image forming apparatus for creation of a full-color image (full-color mode) but also as an image forming apparatus for creation of a secret document (transparent color mode).

In a case where the image forming apparatus 102 functions as an image forming apparatus for creation a full-color image, developing units 2K, 2C, 2M, and 2Y that respectively contain toners (visible toners) of black (K), cyan (C), magenta (M), and yellow (Y) for creating a full-color image are mounted in four image forming stations P1 through P4 (see FIG. 1) as shown in (a) of FIG. 18, as in the image forming apparatus 100 and the image forming apparatus 101.

The present image forming apparatus 102 is different from the image forming apparatuses 100 and 101 in mode for creation of a secret document (transparent color mode).

In a case where the present image forming apparatus 102 functions as an image forming apparatus for creation of a secret document, the black developing unit 2K, a transparent fluorescent color developing unit U, and two developing units 2R and 2R' each of which contains a visible toner of a specific color are mounted in the four image forming stations P1 through P4, as shown in (b) of FIG. 18. Note that a visible toner contained in the developing unit 2R is identical to that of the developing unit 2R' in hue, but is different from that of the developing unit 2R' in tinge.

With the arrangement, the image forming apparatus 102 used for creation of a secret document can create two types of images each of which is difficult to falsify and forge and whose specific colors are identical in hue but are different in tinge by printing an additional information image formed with the use of the transparent fluorescent toner which is an invisible toner on a document image expressed by black and a specific color.

It is preferable that each of the specific colors is red, which can reproduce color of a vermillion inkpad for the reason described in the Embodiment 2. In countries where people care so much about color of a vermillion inkpad, there are various demands for red (e.g., formal red, informal red whose tinge is slightly different from the formal red), as compared to other hues. According to the above arrangement, at least two types of red can be reproduced without mixing colors. This improves convenience of the image forming apparatus, thereby adding a higher value to the image forming apparatus.

Which of the two types of specific colors (R1 and R2) contained in the two developing units 2R and 2R' is used may be determined in accordance with a user's instruction, may be determined depending on a user with the use of a user authentication technique, or may be determined depending on an application program.

It is preferable that the black developing unit 2K, the transparent fluorescent color developing unit 2U, and the two developing units 2R and 2R' that respectively contain toners of the specific colors (R1 and R2) be disposed as illustrated in (b) of FIG. 18.

Specifically, it is preferable that the transparent fluorescent color developing unit 2U (first developing unit), the developing unit 2R' (sixth developing unit) that contains the toner of the specific color (R2), the developing unit 2R (fifth developing unit) that contains the toner of the specific color (R1), and the black developing unit 2K (second developing unit) be disposed in this order from an upstream side towards a downstream side of a rotation direction of the intermediate transfer belt 61, which rotates in a direction indicated by the arrow X, when viewed from the transfer roller 10. Needless to say, the order in which the developing unit 2R' that contains the toner of the specific color (R2) and the developing unit 2R that contains the toner of the specific color (R1) are disposed may be reversed.

In a case where the developing units are disposed in this way, a transparent fluorescent toner image, a toner image of the specific color, and a black toner image are stacked on the intermediate transfer belt 61 in this order. As a result, the black toner image is located at the top. Then, in a case where the toner images are transferred on a sheet by the transfer roller 10, the order in which the toner images are stacked is reversed. As a result, on the sheet, the black toner image is located at the bottom, and the transparent fluorescent toner image is located at the top.

This allows the transparent fluorescent toner to be located at the top, as in the image forming apparatuses 100 and 101. Consequently, an additional information image formed with the use of the transparent fluorescent toner can be caused to appear without any missing parts even in a case where the transparent fluorescent toner image is stacked along with toner images of other colors.

Also in the present embodiment, the control section 151 determines, based on information supplied from the communication sections 207-1 through 207-4, whether the present image forming apparatus 102 is used for creation of a secret document or for creation of a full-color image (i.e., mode of the image forming apparatus 102).

In a case where installation of the yellow developing unit 2Y in the image forming station P1 is detected, the control section 151 determines that the image forming apparatus 102 is used for creation of a full-color image, as in the image forming apparatuses 100 and 101. Meanwhile, in a case where installation of the transparent fluorescent color developing unit 2U in the image forming station P1 is detected, the control section 151 determines that the image forming apparatus 102 is used for creation of a secret document.

In a case where it is determined that the image forming apparatus 102 is used for creation of a secret document, the control section 151 determines that the transparent fluorescent color developing unit 2U is a developing unit 2 that is allowed to be mounted in the image forming station P1, the developing unit 2R' that contains the toner of the specific color (R2) is a developing unit 2 that is allowed to be mounted in the image forming station P2, the developing unit 2R that contains the toner of the specific color (R1) is a developing unit 2 that is allowed to be mounted in the image forming station P3, and the black developing unit 2K is a developing unit 2 that is allowed to be mounted in the image forming station P4.

FIG. 19 shows image processing carried out in a case where the present image forming apparatus 102 is used for creation of a secret document. FIG. 19 corresponds to FIG. 7 of the Embodiment 1 and FIG. 14 of the Embodiment 2, and shows an example in which an additional pattern and an example of the way in which the additional pattern is disposed are determined with the use of a screen for settings of a printer driver, and additional information data is created in the printer driver.

According to this arrangement, specific color data (R1 or R2) created in a designated color converting section 182 is supplied to a halftone processing section 173. Then, the halftone processing section 173 creates, as output data (print data) of a specific color plane, halftone data of the specific color data. The specific color data is supplied to the halftone processing section 173 as if it is magenta data.

Note that a process for creating output data (print data) of a black plane and a process for creating output data (print data) of a transparent fluorescent color plane are identical to those explained with reference to FIG. 7, and therefore are not explained repeatedly.

The halftone processing section 173 causes the specific color print data which disguises as magenta print data to be outputted from OUT2 as in the case where the image processing apparatus 102 operates as an image processing apparatus for creation of a full-color image. Further, the transparent fluorescent color print data which disguises as cyan print data is outputted from OUT3, and the halftone data of the black data is outputted from an output section OUT4.

The control section 151 switches connections between the output sections OUT2 and OUT3 of the halftone processing section 173 and input sections IN1 and IN3 of an exposure unit 1 so that the transparent fluorescent color print data and the specific color print data that are outputted from the halftone processing section 173 correspond to the developing units 2U and 2R mounted in the image forming stations P1 and P3, respectively.

Specifically, the input section IN1 that corresponds to the image forming station P1 in which the transparent fluorescent color developing unit 2U is mounted is connected to the output section OUT3 (output section for cyan) of the halftone processing section 173, and the input section IN3 that corresponds to the image forming station P3 in which the developing unit 2R that contains the toner of the specific color (R1)

is mounted is connected to the output section OUT2 (output section for magenta) of the halftone processing section 173.

Note that a connection between the output section OUT4 of the halftone processing section 173 and the input section IN4 of the exposure unit 1 is never changed.

The present image forming apparatus 102 further includes a specific color switching section (developing unit selecting means) 175, as shown in FIG. 19. The specific color switching section 175 switches an input section to which the output section OUT2 for outputting the specific color print data is connected between (i) the input section IN3 to which the output section OUT2 is connected in the above example and (ii) the input section IN2 that corresponds to the image forming station P2 in which the developing unit 2R' that contains the toner of the specific color (R2) is provided.

The specific color switching section 175 switches, based on a predetermined condition, an input section to which the output section OUT2 is connected between the input section IN2 and the input section IN3 of the exposure unit 1.

For example, the specific color switching section 175 switches, based on an authentication result of a user authentication device (not shown) or based on an application program, an input section to which the output section OUT2 is connected between the input section IN2 and the input section IN3 of the exposure unit 1. Note that another arrangement is also possible in which a specific color is designated in the printer driver.

The above description has dealt with the example of FIG. 19 that corresponds to FIG. 7 of the Embodiment 1 and FIG. 14 of the Embodiment 2. However, an arrangement shown in FIG. 20 that corresponds to FIG. 8 of the Embodiment 1 and FIG. 15 of the Embodiment 2 is also possible. In the arrangement of FIG. 20, an image processing section 154*b*1 for secret document includes an additional pattern creating section 188. Thus, an additional pattern is created within the image forming apparatus 102 on the basis of additional patterns stored in a hard disc (HD) 152 or RAM and ROM of the control section 151 (see FIG. 5).

Further, an arrangement shown in FIG. 21 that corresponds to FIG. 10 of the Embodiment 1 and FIG. 16 of the Embodiment 2 is also possible. In the arrangement of FIG. 21, connections between the output sections OUT1 through OUT4 of the halftone processing section 173 and the input section IN1 through IN 4 of the exposure unit 1 in the image processing section 154 are identical to those of the case where the image forming apparatus 102 is used for creation of a full-color image (see FIG. 6), but instead processing corresponding to the switching of the connections (switching of the connections that is carried out in a case where the image forming apparatus 102 is used for creation of a secret document) is carried out within an image processing section 154*b*' for secret document. Note that the designated color setting section 112 is not provided in the present image forming apparatus 102. This is because a designated color cannot be designated since the visible toner of the specific color is used in the present image forming apparatus 102.

Transparent fluorescent color data created in a transparent fluorescent color data creating section 186 is supplied to the halftone processing section 173 as if it is yellow data. This allows halftone data (print data) of the transparent fluorescent color to be outputted from the image forming station P1 (corresponding to yellow in the full-color image creation mode) in which the transparent fluorescent color developing unit 2U is mounted.

Meanwhile, specific color data created in a designated color converting section 182 is supplied to the halftone processing section 173 as if it is cyan data. Then, under the switching control of the specific color switching section 175, halftone data (print data) of the specific color is outputted from the image forming station P3 (corresponding to cyan in the full-color image creation mode) in which the developing unit 2R that contains the toner of the specific color (R1) is mounted or the image forming station P2 (corresponding to magenta in the full-color image creation mode) in which the developing unit 2R' that contains the toner of the specific color (R2) is mounted.

Furthermore, an arrangement shown in FIG. 21 that corresponds to FIG. 11 of the Embodiment 1 and FIG. 17 of the Embodiment 2 is also possible. In the arrangement of FIG. 21, a printer driver includes a monochromatic visible pattern creating section 113 in addition to an additional pattern creating section 111*a* and an additional information data creating section 111*b*. Thus, a monochromatic visible pattern can be determined with the use of a screen for settings of the printer driver. Also in this example, the designated color setting section 112 is not provided in the present image forming apparatus 102. This is because a designated color cannot be designated since the visible toner of the specific color is used in the present image forming apparatus 102.

Embodiment 4

The present embodiment discusses, as an example, an arrangement in which an image forming apparatus includes: a developing unit that contains an invisible toner, a developing unit that contains a visible toner of black, a developing unit that contains a visible toner of a specific color, and a developing unit that contains a gloss adding toner in a case where the image forming apparatus functions as an image forming apparatus for creation of a secret document, the image forming apparatus further including data creating means for creating print data for the gloss adding toner.

For convenience of description, constituents that have identical functions to those used in the Embodiments 1, 2 and 3 are given identical reference numerals, and are not explained repeatedly.

Like the image forming apparatuses 100, 101, and 102 of the Embodiments 1, 2, and 3, an image forming apparatus 103 of the Embodiment 4 functions not only as an image forming apparatus for creation of a full color image (full-color mode) but also as an image forming apparatus for creation of a secret document (transparent color mode).

In a case where the image forming apparatus 103 functions as an image forming apparatus for creation a full-color image, developing unit 2K, 2C, 2M, and 2Y that respectively contain toners (visible toners) of black (K), cyan (C), magenta (M), and yellow (Y) for creating a full-color image are mounted in four image forming stations P1 through P4 (see FIG. 1) as shown in (a) of FIG. 23, as in the image forming apparatuses 100, 101 and 102.

The present image forming apparatus 103 is different from the image forming apparatuses 100, 101 and 102 in mode for creation of a secret document (transparent color mode).

In a case where the present image forming apparatus 103 functions as an image forming apparatus for creation of a secret document, the black developing unit 2K, a transparent fluorescent color developing unit, a specific color developing unit 2R, and a developing unit 2Z for gloss application that contains a gloss adding toner are mounted in the four image for stations P1 through P4, as shown in (b) of FIG. 23.

This allows the image forming apparatus 103 used for creation of a secret document to obtain a higher-quality image that is more difficult to falsify and forge by printing an additional information image that is formed with the use of the transparent fluorescent toner which is an invisible toner on a document image that is expressed by black and the specific color and by further adding gloss to a surface of the image thus created.

It is preferable that the specific color is red, which can reproduce color of a vermillion inkpad for the reason described in the Embodiment 2.

The gloss adding toner contained in the developing unit 2Z for gloss application is similar to the visible toners, such as black toner, cyan toner, magenta toner, and yellow toner, which can be recognized under visible light except for that the gloss adding toner contains no coloring agent. Further, the gloss adding toner can be produced by a similar method to the visible toners. The gloss adding toner may be the one which has a larger percentage of wax to produce more gloss.

It is preferable that the black developing unit 2K, the transparent fluorescent color developing unit 2U, the specific color developing unit 2R, and the developing unit 2Z for gloss application be disposed as illustrated in (b) of FIG. 23.

Specifically, it is preferable that the developing unit 2Z (seventh developing unit) for gloss application, the transparent fluorescent color developing unit 2U (first developing unit), the specific color developing unit 2R (fifth developing unit), and the black developing unit 2K (second developing unit) be disposed in this order from an upstream side towards a downstream side of a rotation direction of the intermediate transfer belt 61, which rotates in a direction indicated by the arrow X, when viewed from the transfer roller 10.

In a case where the developing units are disposed in this way, a gloss adding toner image, a transparent fluorescent toner image, and a toner image of the specific color, and a black toner image are stacked on the intermediate transfer belt 61 in this order. As a result, the black toner image is located at the top. Then, in a case where the toner images are transferred on a sheet by the transfer roller 10, the order in which the toner images are stacked is reversed. As a result, on the sheet, the black toner image is located at the bottom, the gloss adding toner image is located at the top, and the transparent fluorescent toner image is located under the gloss adding toner image.

This allows the transparent fluorescent toner to be located above the black toner image and the toner image of the specific color, as in the image forming apparatuses 100, 101 and 102. Consequently, an additional information image formed with the use of the transparent fluorescent toner can be caused to appear without any missing parts even in a case where the transparent fluorescent toner image is stacked along with toner images of other colors.

In addition, since the gloss adding toner image is located at the top, it is necessary to remove the toner image (toner layer) formed with the use of the gloss adding toner located at the top in a case where someone tries to falsify or forge the toner image formed with the use of the black toner and the toner of the specific color or the toner image formed with the use of the transparent fluorescent toner. This reduces gloss of a part that has been altered as a result of the falsification or the forgery as compared to the other parts, thereby making it possible to more easily find out that an image has been falsified or forged. That is, it is possible to obtain an image that is more difficult to falsify and forge.

Also in the present embodiment, the control section 151 determines, based on information supplied from the communication sections 207-1 through 207-4, whether the present image forming apparatus 103 is used for creation of a secret document or for creation of a full-color image (i.e., mode of the image forming apparatus 103).

As in the image forming apparatuses 100, 101 and 102, in a case where installation of the yellow developing unit 2Y in the image forming station P1 is detected, the control section 151 determines that the image forming apparatus 103 is used for creation of a full-color image.

Meanwhile, in a case where installation of the transparent fluorescent color developing unit 2U in the image forming station P2 is detected, the control section 151 determines that the image forming apparatus 103 is used for creation of a secret document.

In a case where it is determined that the image forming apparatus 103 is used for creation of a secret document, the control section 151 determines that the developing unit 2Z for gloss application is a developing unit 2 that is allowed to be mounted in the image forming station P1, the transparent fluorescent color developing unit 2U is a developing unit 2 that is allowed to be mounted in the image forming station P2, the specific color developing unit 2R is a developing unit 2 that is allowed to be mounted in the image forming station P3, and the black developing unit 2K is a developing unit 2 that is allowed to be mounted in the image forming station P4.

FIG. 24 shows image processing carried out in a case where the present image forming apparatus 103 is used for creation of a secret document. FIG. 24 corresponds to FIG. 7 of the Embodiment 1 and FIG. 14 of the Embodiment 2, and shows an example in which an additional pattern and an example of the way in which the additional pattern is disposed are determined with the use of a screen for settings of a printer driver, and additional information data is created in the printer driver.

According to this arrangement, specific color data created in a designated color converting section 182 is supplied to a halftone processing section 173. Then, the halftone processing section 173 creates, as output data (print data) for a specific color plane, halftone data of the specific color data. The specific color data is supplied to the halftone processing section 173 as if it is magenta data.

Note that a process for creating output data (print data) of a black plane and a process for creating output data (print data) of a transparent fluorescent color plane are identical to those explained with reference to FIG. 7, and therefore are not explained repeatedly.

An entire surface data creating section (data creating means) 176 creates print data for the gloss adding toner contained in the developing unit 2Z for gloss application that is mounted in the image forming station P1. The print data that has been thus created in the entire surface data creating section 176 which print data is for applying the gloss adding toner to an entire surface of a sheet or to an entire image forming region is supplied to the yellow halftone processing section 173, and then outputted from an output section OUT1 of the halftone processing section 173 as if it is yellow print data.

The halftone processing section 173 causes the specific color print data which disguises as magenta print data to be outputted from OUT2 as in the case where the image processing apparatus 103 operates as an image processing apparatus for creation of a full-color image. Further, the transparent fluorescent color print data which disguises as cyan print data is outputted from OUT3, and the halftone data of the black data is outputted from an output section OUT4. Further, the print data, for applying the gloss adding toner, which is created in the entire surface data creating section 176 is outputted from the output section OUT1 that corresponds to yellow.

The control section 151 switches connections between the output sections OUT2 and OUT3 of the halftone processing section 173 and input sections IN1 and IN3 of an exposure unit 1 so that the transparent fluorescent color print data and the specific color print data that are outputted from the halftone processing section 173 correspond to the developing units 2U and 2R mounted in the image forming stations P1 and P3, respectively.

Specifically, the input section IN1 that corresponds to the image forming station P1 in which the transparent fluorescent color developing unit 2U is mounted is connected to the output section OUT3 (output section for cyan) of the halftone processing section 173, and the input section IN3 that corresponds to the image forming station P3 in which the specific color developing unit 2R is mounted is connected to the output section OUT2 (output section for magenta) of the halftone processing section 173.

Note that a connection between the output section OUT4 of the halftone processing section 173 and the input section IN4 of the exposure unit 1 and a connection between the output section OUT1 of the halftone processing section 173 and the input section IN1 of the exposure unit 1 are never changed.

The above description has dealt with the example of FIG. 24 that corresponds to FIG. 7 of the Embodiment 1 and FIG. 14 of the Embodiment 2. However, an arrangement shown in FIG. 25 that corresponds to FIG. 8 of the Embodiment 1 and FIG. 15 of the Embodiment 2 is also possible. In the arrangement of FIG. 25, an image processing section 154*b*1 for secret document includes an additional pattern creating section 188. Thus, an additional pattern is created within the image forming apparatus 103 on the basis of additional patterns stored in a hard disc (HD) 152 or RAM and ROM of the control section 151 (see FIG. 5).

Further, an arrangement shown in FIG. 26 that corresponds to FIG. 10 of the Embodiment 1 and FIG. 16 of the Embodiment 2 is also possible. In the arrangement of FIG. 26, connections between the output sections OUT1 through OUT4 of the halftone processing section 173 and the input section IN1 through IN 4 of the exposure unit 1 in the image processing section 154 are identical to those of the case where the image forming apparatus 103 is used for creation of a full-color image (see FIG. 6), but instead processing corresponding to the switching of the connections (switching of the connections that is carried out in a case where the image forming apparatus 103 is used for creation of a secret document) is carried out within an image processing section 154*b*' for secret document. Note that the designated color setting section 112 is not provided in the present image forming apparatus 103. This is because a designated color cannot be designated since the visible toner of the specific color is used in the present image forming apparatus 103.

Transparent fluorescent color data created in a transparent fluorescent color data creating section 186 is supplied to the halftone processing section 173 as if it is yellow data. This allows halftone data (print data) for the transparent fluorescent color to be outputted from the image forming station P1 (corresponding to yellow in the full-color image creation mode) in which the transparent fluorescent color developing unit 2U is mounted.

Meanwhile, specific color data created in a designated color converting section 182 is supplied to the halftone processing section 173 as if it is cyan data. Then, under the switching control of the specific color switching section 175, halftone data (print data) for the specific color is outputted from the image forming station P3 (corresponding to cyan in the full-color image creation mode) in which the specific color developing unit 2R is mounted.

The print data for gloss application that has been created in the entire surface data creating section 176 is outputted from the halftone processing section 173 as if it is yellow data. This allows halftone data (print data) for gloss application to be outputted from the image forming station P1 (corresponding to yellow in the full-color image creation mode) in which the developing unit 2Z for gloss application is mounted.

Furthermore, an arrangement shown in FIG. 27 that corresponds to FIG. 11 of the Embodiment 1 and FIG. 17 of the Embodiment 2 is also possible. In the arrangement of FIG. 27, a printer driver includes a monochromatic visible pattern creating section 113 in addition to an additional pattern creating section 111*a* and an additional information data creating section 111*b*. Thus, a monochromatic visible pattern can be determined with the use of a screen for settings of the printer driver. Also in this example, the designated color setting section 112 is not provided in the present image forming apparatus 103. This is because a designated color cannot be designated since the visible toner of the specific color is used in the present image forming apparatus 103.

The present invention may be realized by way of software. The present invention includes a CPU (central processing unit) and memory devices (memory media). The CPU (central processing unit) executes instructions in control programs realizing the functions (means). The memory devices include a ROM (read only memory) which contains programs, a RAM (random access memory) to which the programs are loaded, and a memory containing the programs and various data. The objective of the present invention can also be achieved by mounting to the image forming apparatus a computer-readable storage medium containing control program code (executable program, intermediate code program, or source program), which is software realizing the aforementioned functions, in order for the computer (or CPU, MPU) to retrieve and execute the program code contained in the storage medium.

The storage medium may be, for example, a tape, such as a magnetic tape or a cassette tape; a magnetic disk, such as a Floppy (Registered Trademark) disk or a hard disk, or an optical disk, such as CD-ROM/MO/MD/DVD/CD-R; a card, such as an IC card (memory card) or an optical card; or a semiconductor memory, such as a mask ROM/EPROM/EEPROM/flash ROM.

The image forming apparatus may be arranged to be connectable to a communications network so that the program code may be delivered over the communications network. The communications network is not limited in any particular manner, and may be, for example, the Internet, an intranet, extranet, LAN, ISDN, VAN, CATV communications network, virtual dedicated network (virtual private network), telephone line network, mobile communications network, or satellite communications network. The transfer medium which makes up the communications network is not limited in any particular manner, and may be, for example, wired line, such as IEEE 1394, USB, electric power line, cable TV line, telephone line, or ADSL line; or wireless, such as infrared radiation (IrDA, remote control), Bluetooth (Registered Trademark), 802.11 wireless, HDR, mobile telephone network, satellite line, or terrestrial digital network. The present invention encompasses a computer data signal which is embedded in a carrier wave and in which the program code is embodied electronically.

The present invention is not limited to the description of the embodiments above, but may be altered by a skilled person within the scope of the claims. An embodiment based on a proper combination of technical means disclosed in different embodiments is encompassed in the technical scope of the present invention.

The four image forming apparatuses 100 through 103 which are different in transparent mode are described in the Embodiments 1 through 4, respectively. However, another arrangement is also possible in which, for example, the image forming apparatus 100 can use the transparent color modes of the image forming apparatuses 101 through 103 in addition to the transparent color mode of the image forming apparatus 100. In this case, any one of these four transparent color modes is selected, and based on the transparent color mode thus selected, the control section 151 changes a combination of developing units 2 that are allowed to be mounted in the image forming stations P1 through P3.

As described above, in order to attain the above object, an image forming apparatus of the present invention in which four developing units can be provided, includes: a developing unit that contains an invisible toner which can hardly be observed under visible light; a developing unit that contains a visible toner of black; at least one developing unit that contains a visible toner of a chromatic color; first image processing means for creating print data for the visible toner of black and print data for the visible toner of the chromatic color with use of functions of full-color image processing means for creating, based on image data of a document image, print data for respective visible toners of black, yellow, magenta, and cyan; second image processing means for creating print data for the invisible toner on basis of image data of an additional information image; and an image forming section that forms toner images according to the image data of the document image with use of the print data for the visible toners which print data are created in the first image processing means, forms a toner image according to the image data of the additional information image with use of the print data for the invisible toner which print data is created in the second image processing means, and forms an image on a recording sheet from the toner images thus formed.

With the arrangement, it is possible to provide a small and inexpensive image forming apparatus which can output an image that is difficult to falsify and forge in compliance with a users' demand.

The image forming apparatus of the present invention may be arranged to include: a first developing unit that contains the invisible toner; a second developing unit that contains a visible toner of black; a third developing unit that contains a visible toner of yellow, magenta or cyan; and a fourth developing unit that contains a visible toner of yellow, magenta or cyan which visible toner has a color different from that of the third developing unit, the first image processing means creating print data for the visible toners respectively contained in the second through fourth developing units.

According to the arrangement, by replacing one of the developing units that respectively contain yellow toner, magenta toner, and cyan toner with the developing unit that contains an invisible toner, it is possible to obtain an image that is difficult to falsify and forge in which an additional information image that is formed with the use of the invisible toner is printed on a document image that is expressed by black and a color that can be reproduced within a color reproduction range determined by remaining two of yellow, magenta, and cyan.

In this case, the image forming apparatus of the present invention is preferably arranged such that the two visible toners respectively contained in the third developing unit and the fourth developing unit are visible toners of yellow and magenta.

This is because, in countries, such as Japan and China, in which seals are used, most secret documents bear words written in black and a seal stamped in red (vermilion). That is, the above arrangement in which red can be reproduced by yellow and magenta is preferable in the countries in which seals are used.

Further, in this case, the image forming apparatus of the present invention may be arranged such that the first image processing means separates the image data of the document image into chromatic color data and achromatic color data, creates, based on the chromatic color data, the print data for the visible toners respectively contained in the third developing unit and the fourth developing unit, and creates, based on the achromatic color data, the print data for the visible toner of black contained in the second developing unit.

In image processing for creating a full-color image, color data of yellow, magenta, cyan, and black are created based on image data of a document image. However, one of yellow, magenta, and cyan is replaced by the invisible toner. As a result, a full-color reproduction process that is normally carried out cannot be carried out based on such color data for a full-color image. Further, in a case where color data corresponding to the color of the visible toner replaced by the invisible toner is omitted, an image part that is reproduced only by the color cannot be reproduced.

In the above arrangement, the first image processing means replaces the chromatic color data separated from the image data of the document image with data of a specific color that is reproduced by two of the visible toners of yellow, magenta, and cyan. Thus, data corresponding to the colors of the visible toners contained in the third developing unit and the fourth developing unit are created. Accordingly, data of a color of the visible toner replaced by the invisible toner is included in the data of the remaining two colors.

Consequently, the image part that is reproduced only by the color of the visible toner replaced by the invisible toner can be reproduced by the specific color obtained by mixing the remaining two colors. Further, since the data of the remaining two colors are the same, all image parts other than a black image part can be expressed by the specific color.

Further, in this case, the image forming apparatus of the present invention may be arranged to further include a designated color setting section that allows a user to designate a color that can be reproduced by a combination of the two visible toners respectively contained in the third developing unit and the fourth developing unit within a color reproduction range determined by the colors of the two visible toners, the first image processing means creating the print data for the two visible toners respectively contained in the third developing unit and the fourth developing unit so that the color designated in the designated color setting section can be obtained.

According to the arrangement, a user can designate a color reproduced by the two visible toners contained in the third developing unit and the fourth developing unit with the use of the designated color setting section. For example, in a case where the two visible toners are visible toners of yellow and magenta, the user can designate color, such as red close to orange or crimson, which can be reproduced within a color reproduction range determined by a combination of yellow and magenta. This allows an improvement in convenience of the image forming apparatus.

The image forming apparatus of the present invention may be arranged to include a first developing unit that contains the invisible toner; a second developing unit that contains a visible toner of black; and a fifth developing unit that contains a visible toner of a specific color which is a chromatic color; the first image processing means creating print data for the visible toner of black and print data for the visible toner of the specific color.

According to the arrangement, it is possible to obtain an image that is difficult to falsify and forge by printing the additional information image that is formed with the use of the invisible toner on the document image expressed by black and the specific color. It is possible that the specific color is obtained from a combination of two chromatic colors. However, since the specific color is obtained by mixing the two chromatic colors, it is difficult to completely prevent a change in tinge caused by humidity and temperature of a space in which the image forming apparatus is placed or temperature etc. within the image forming apparatus. Further, in a case where the specific color is obtained by mixing the two chromatic colors, it may be impossible to obtain a desired color by any image processing due to a color reproduction range.

Meanwhile, in a case where a visible toner that is produced in advance so as to have a specific desired color is used, naturally, there occurs no problem related to a color reproduction range. Further, it is possible to surely prevent a change in tinge caused by humidity and temperature of a space in which the image forming apparatus is placed or temperature etc. within the image forming apparatus.

Further, in this case, the image forming apparatus of the present invention is preferably arranged such that the specific color is red which can reproduce color of a vermillion inkpad.

According to the arrangement, it is possible to surely prevent a change in tinge caused by changes in environment. Accordingly, color of a vermillion inkpad can be reproduced without any problem. On this account, the arrangement is more preferable in the countries, such as Japan and China, in which seals are used.

Further, in this case, the image forming apparatus of the present invention may be arranged such that the first image processing means separates the image data of the document image into chromatic color data and achromatic color data, creates, based on the chromatic color data, the print data for the visible toner of the specific color, and creates, based on the achromatic color data, the print data for the visible toner of black.

As described above, in a case where the image data is separated into the chromatic color data and achromatic color data, all the image parts of the chromatic data can be expressed as an image. Here, all the image parts of the chromatic data can be expressed as an image of the specific color.

The image forming apparatus of the present invention may be arranged to include a first developing unit that contains the invisible toner; a second developing unit that contains a visible toner of black; a fifth developing unit that contains a visible toner of a specific color which is a chromatic color; and a sixth developing unit that contains a visible toner of a specific color which has an identical hue to the visible toner contained in the fifth developing unit but has a different tinge from the visible toner contained in the fifth developing unit, the image forming apparatus further including developing unit selecting means for selecting the fifth developing unit or the sixth developing unit on basis of a predetermined condition, the first image processing means creating print data for the visible toner of black and print data for the visible toner of the specific color, the image forming section using, as a developing unit that contains a visible toner of a specific color, the fifth developing unit or the sixth developing unit selected by the developing unit selecting means.

According to the arrangement, it is possible to obtain an image that is difficult to falsify and forge by printing the additional information image that is formed with the use of the invisible toner on the document image that is expressed by black and the specific color, as in the above image forming apparatus. Moreover, since two types of visible toners of the specific colors that are different in tinge are used, the developing unit selecting means selects, based on a predetermined condition, one of the two types of visible toners.

This makes it possible to change a tinge of a specific color depending on an application program or a user, thereby further improving a convenience of the image forming apparatus.

Also in this case, the image forming apparatus of the present invention is preferably arranged such that the specific color is red which can reproduce color of a vermillion inkpad by itself.

As described above, in a case where the specific color is red that can reproduce a color of a vermillion inkpad by itself, it is possible to surely prevent a change in tinge caused by changes in environment, and therefore it is always possible to reproduce the color of a vermillion inkpad without any problem. On this account, the arrangement is more preferable in the countries, such as Japan and China, in which seals are used. Moreover, in countries where people care so much about color of a vermillion inkpad, there are various demands for red (e.g., formal red, informal red whose tinge is slightly different from the formal red), as compared to other hues. According to the above arrangement, at least two types of red can be reproduced. This allows an improvement in convenience of the image forming apparatus.

Also in this arrangement, the image forming apparatus of the present invention may be arranged such that the first image processing means separates the image data of the document image into chromatic color data and achromatic color data, creates, based on the chromatic color data, the print data for the visible toner of the specific color, and creates, based on the achromatic color data, the print data for the visible toner of black.

The image forming apparatus of the present invention may be arranged to include a first developing unit that contains the invisible toner; a second developing unit that contains a visible toner of black; a fifth developing unit that contains a visible toner of a specific color which is a chromatic color; and a seventh developing unit that contains a gloss adding toner for adding gloss to an image, the image forming apparatus further comprising data creating means for creating print data for the gloss adding toner which print data is for forming a toner image of the gloss adding toner on an entire surface of the recording sheet, the first image processing means creating print data for the visible toner of black and print data for the visible toner of the specific color, the image forming section further forming a toner image according to the print data for the gloss adding toner with use of the print data for the gloss adding toner created in the data creating means.

According to the arrangement, it is possible to obtain a higher-quality image that is more difficult to falsify and forge by printing the additional information image that is formed with the use of the invisible toner on the document image that is expressed by black and the specific color and by further adding gloss to a surface of the image thus created.

Also in this arrangement, the image forming apparatus of the present invention is preferably arranged such that the specific color is red which can reproduce color of a vermillion inkpad, for the same reason as that mentioned above.

Also in this arrangement, the image forming apparatus of the present invention may be arranged such that the first image processing means separates the image data of the document image into chromatic color data and achromatic color data, creates, based on the chromatic color data, the print data for the visible toner of the specific color, and creates, based on the achromatic color data, the print data for the visible toner of black.

The image forming apparatus of the present invention may be arranged such that the invisible toner contains a fluorescent substance which glows when irradiated by ultraviolet light.

A toner which contains, instead of pigment or dye, a fluorescent substance that glows when irradiated by ultraviolet light is a toner which can hardly be observed under visible light and which can be easily recognized under ultraviolet light, and therefore can be used as the invisible toner which can hardly be observed under visible light.

The image forming apparatus of the present invention may be arranged such that the invisible toner contains an infrared light absorbing agent which absorbs infrared light.

A toner which contains, instead of pigment or dye, an infrared light absorbing agent that absorbs infrared light is a toner which can hardly be observed under visible light and which becomes black and can be recognized under infrared light. Accordingly, in addition to the toner that contains a fluorescent substance, the toner that contains an infrared light absorbing agent can be used as the invisible toner which can hardly be observed under visible light.

In the arrangement in which the invisible toner is a toner that contains a fluorescent substance or an infrared light absorbing agent, the image forming apparatus of the present invention is preferably arranged such that the developing units are disposed so that the toner image of the additional information image which toner image is formed with use of the invisible toner contained in the first developing unit is located at the top layer after transfer onto the recording sheet is completed.

In a case where a toner image formed with the use of the visible toner is formed above a toner image formed with the use of the invisible toner so that the toner image of the invisible toner is covered by the toner image of the visible toner, there occurs a problem that it becomes impossible or difficult to recognize the toner image of the invisible toner that is located on a lower side.

For example, in a case where the invisible toner is the toner that contains a fluorescent substance, a part covered by the visible toner cannot reflect ultraviolet light, and the additional information image cannot be recognized in the part covered by the visible toner.

Meanwhile, in a case where the invisible toner is the toner that contains an infrared light absorbing agent, infrared light is reflected by the visible toner, and therefore does not reach the invisible toner. As a result, the additional information image cannot be recognized in the part covered by the visible toner.

According to the arrangement, the first through fourth developing units are disposed so that the toner image of the additional information image formed with the use of the invisible toner is located at the top on the recording sheet. As a result, the toner image of the invisible toner is not covered by the toner image of the visible toner even in a case where the additional information image formed with the use of the invisible toner and the toner image of the document image formed with the use of the visible toner are stacked.

Consequently, ultraviolet light or infrared light is not blocked by the visible toner, and therefore the additional information image can be caused to appear when irradiated by ultraviolet light or infrared light, regardless of whether the invisible light is an invisible toner that contains a fluorescent substance or an invisible toner that contains an infrared light absorbing agent.

In a general full-color image forming apparatus, a yellow toner image is located at the top when transferred on a recording sheet. Here, the yellow toner image is disposed at the top because yellow has the highest transmittance. That is, colors of toner images located below the yellow toner image can be seen through, thereby widening a color reproduction range, as compared to a case where color that is not yellow is located at the top. That is, the technique of disposing a yellow toner image at the top is different from the technique of disposing a toner image of an invisible toner in technical idea.

In the arrangement in which the gloss adding toner is used, the image forming apparatus of the present invention is preferably arranged such that the developing units are disposed so that the toner image that is formed with use of the gloss adding toner contained in the sixth developing unit is located at the top layer after transfer onto the recording sheet is completed.

Since the toner image of the gloss adding toner is located at the top, it is necessary to remove the toner image (toner layer) of the gloss adding toner located at the top in a case where someone tries to falsify or forge the toner image formed with the use of the visible toner and invisible toner. This reduces gloss of a part altered as a result of the falsification or the forgery as compared to the other parts, thereby making it possible to more easily find out that an image has been falsified or forged.

That is, in a case where the toner image of the gloss adding toner is located at the top, it is possible to obtain an image that is more difficult to falsify and forge.

In order to attain the above object, another image forming apparatus of the present invention in which four developing units can be provided, includes: full-color image processing means for creating, based on image data of a document image, print data for respective visible toners of black, yellow, cyan, and magenta; first image processing means for separating the image data of the document image into chromatic color data and achromatic color data, the first image processing means creating, based on the chromatic color data, print data for a visible toner of a chromatic color with use of functions of the full-color image processing means and creating, based on the achromatic color data, print data for the visible toner of black; second image processing means for creating, based on image data of an additional information image, print data for an invisible toner which can hardly be observed under visible light; and an image forming section that forms toner images, and forms an image on a recording sheet from the toner images thus formed, the image forming apparatus being switched between (i) a full-color mode in which developing units that contain visible toners of black, yellow, magenta, and cyan, respectively are mounted, and the image forming section forms toner images according to the image data of the document image with use of the print data for the visible toners which print data are created in the full-color image processing means, and forms a full-color image on a recording sheet from the toner images thus formed, and (ii) a transparent color mode in which at least one of the developing units used in the full-color mode other than the developing unit that contains the visible toner of black is replaced by a developing unit that contains the invisible toner, and the image forming section forms toner images according to the image data of the document image with use of the print data for the visible toners which print data are created in the first image processing means, forms a toner image according to the image data of the additional information image with use of the print data for the invisible toner which print data is created in the second image processing means, and forms an image on a recording sheet from the toner images thus formed.

This makes it unnecessary for a user of the image forming apparatus of the present invention and a service for providing the image forming apparatus to purchase a new one even in a case where work is changed from the one which more often requires secret documents to the one which more often requires full-color images. The user and the service can flexibly respond to such a change in work.

The image forming apparatus of the present invention may be arranged such that in the transparent color mode, the developing unit that contains the visible toner of black, the developing unit that contains the invisible toner, and developing units that respectively contain two of the visible toners of yellow, magenta, and cyan are mounted, and the first image processing means creates print data for the visible toner of black and print data for the two of the visible toners of yellow, magenta, and cyan.

According to the arrangement, in the transparent color mode, it is possible to obtain an image that is difficult to falsify and forge by printing an additional information image that is formed with the use of the invisible toner on a document image that is expressed by black and a color within a color reproduction range determined by remaining two of yellow, magenta, and cyan.

Further, in this case, the image forming apparatus of the present invention may be arranged to further include a first detecting section that detects installation of the developing unit that contains the invisible toner; and mode control means for switching a mode of the image forming apparatus to the transparent color mode when the first detecting section detects the installation of the developing unit that contains the invisible toner.

According to the arrangement, the image forming apparatus includes a detecting section that detects installation of the developing unit that contains the invisible toner, and in a case where the detecting section detects installation of the developing unit that contains the invisible toner, mode control means switches a mode to the transparent color mode.

Since the mode is automatically switched to the transparent color mode just by mounting the developing unit that contains the invisible toner to the image forming apparatus which operates in the full-color mode, not only a serviceman but also a user can switch the mode. This further improves convenience of the image forming apparatus.

The image forming apparatus of the present invention may be arranged such that in the transparent color mode, the developing unit that contains the visible toner of black, the developing unit that contains the invisible toner, and a developing unit that contains a visible toner of a specific color are mounted, and the first image processing means creates print data for the visible toner of black and print data for the visible toner of the specific color.

According to the arrangement, in the transparent color mode, it is possible to obtain an image that is difficult to falsify and forge by printing an additional information image that is formed with the use of the invisible toner on a document image that is expressed by black and the specific color.

Also in this case, the image forming apparatus of the present invention may be arranged to further include a first detecting section that detects installation of the developing unit that contains the invisible toner, and a mode of the image forming apparatus is switched to the transparent color mode when the first detecting section detects the installation of the developing unit that contains the invisible toner.

The image forming apparatus of the present invention may be arranged such that in the transparent color mode, the developing unit that contains the visible toner of black, the developing unit that contains the invisible toner, a fifth developing unit that contains a visible toner of a specific color which is a chromatic color, and a sixth developing unit that contains a visible toner of a specific color whose hue is identical to the visible toner contained in the fifth developing unit but whose tinge is different from the visible toner contained in the fifth developing unit are mounted, the image forming apparatus further including developing unit selecting means for selecting, based on a predetermined condition, the fifth developing unit or the sixth developing unit, the first image processing means creating the print data for the visible toner of black and print data for the visible toner of the specific color, and the image forming section using, as a developing unit that contains a visible toner of a specific color, the fifth developing unit or the sixth developing unit selected by the developing unit selecting means.

According to the arrangement, it is possible to obtain an image that is difficult to falsify and forge by printing an additional information image that is formed with the use of the invisible toner on a document image that is expressed by black and the specific color, as in the above image forming apparatus. Moreover, since two types of visible toners of specific colors that are different in tinge are mounted, the developing unit selecting means selects, based on a predetermined condition, any one of the two types of the visible toners of the specific colors.

This makes it possible to use a desired one of the specific colors that are identical in hue but different in tinge, depending on an application program or a user. This further improves convenience of the image forming apparatus.

The image forming apparatus of the present invention may be arranged such that in the transparent color mode, the developing unit that contains the visible toner of black, the developing unit that contains the invisible toner, a developing unit that contains a visible toner of a specific color which is a chromatic color, and a developing unit that contains a gloss adding toner for adding gloss to an image, the image forming apparatus further comprising data creating means for creating print data for the gloss adding toner which print data is for forming a toner image of the gloss adding toner on an entire surface of the recording sheet, the first image processing means creating the print data for the visible toner of black and print data for the visible toner of the specific color, and the image forming section further forming a toner image according to the print data for the gloss adding toner with use of the print data for the gloss adding toner which print data is created in the data creating means.

According to the arrangement, in the transparent color mode, it is possible to obtain a higher-quality image that is more difficult to falsify and forge by printing the additional information image that is formed with the use of the invisible toner on the document image that is expressed by black and the specific color and by further adding gloss to a surface of the image thus created.

Also in this case, the image forming apparatus of the present invention may be arranged to further include a first detecting section that detects installation of the developing unit that contains the invisible toner, and a mode of the image forming apparatus is switched to the transparent color mode when the first detecting section detects the installation of the developing unit that contains the invisible toner.

Each means of the image forming apparatus may be realized by a computer. In this case, a program for causing a computer to function as each means of the image forming apparatus so that the image forming apparatus is realized by the computer and a computer-readable storage medium in which the program is stored are also encompassed in the scope of the present invention.

REFERENCE SIGNS LIST

2: Developing unit

2K: Developing unit of black

2U: Developing unit of transparent fluorescent color
2C: Developing unit of cyan
2Y: Developing unit of yellow
2M: Developing unit of magenta
2Z: Developing unit for gloss application
2R: Developing unit of specific color
2R': Developing unit of specific color
100-103: Image forming apparatus
151: Control section (detecting section, mode control means)
154*a*: Image processing section for full-color image (full-color image processing means)
154*b*: Image processing section for secret document (first image processing means, second image processing means)
154*b*': Image processing section for secret document (first image processing means, second image processing means)
154*b*": Image processing section for secret document (first image processing means, second image processing means)
154*b*1: Image processing section for secret document (first image processing means, second image processing means)
175: Specific color switching section (developing unit switching means)
176: Entire surface data creating section (data creating means)
P1-P4: Image forming station (image forming section)

The invention claimed is:

1. An image forming apparatus in which four developing units can be provided, comprising:

a developing unit that contains an invisible toner which can hardly be observed under visible light;

a developing unit that contains a visible toner of black;

a developing unit that contains a visible toner of a specific color which is a chromatic color;

a developing unit that contains a gloss adding toner for adding gloss to an image, a first image processor configured to create print data for the visible toner of black and print data for the visible toner of the specific color with use of functions of full-color image processing for creating, based on image data of a document image, print data for respective visible toners of black, yellow, magenta, and cyan;

a second image processor configured to create print data for the invisible toner on basis of image data of an additional information image, wherein the second image processor is separate from the first image processor;

a data creator configured to create print data for the gloss adding toner which print data is for forming a toner image of the gloss adding toner on an entire surface of a recording sheet; and an image forming section that forms toner images according to the image data of the document image with use of the print data for the visible toners which print data are created in the first image processor, forms a toner image according to the image data of the additional information with use of the print data for the invisible toner which print data is created in the second image processor, forms an image on a recording sheet from the toner images thus formed, and forms a toner image according to the print data for the gloss adding toner with use of the print data for the gloss adding toner created in the data creator, the developing units being disposed so that the toner image that is formed with use of the gloss adding toner is located at a top layer after transfer onto the recording sheet is completed.

2. The image forming apparatus according to claim 1, wherein the first image processor separates the image data of the document image into chromatic color data and achromatic color data, creates, based on the chromatic color data, the print data for the visible toner of the specific color, and creates, based on the achromatic color data, the print data for the visible toner of black.

3. The image forming apparatus according to claim 1, wherein the invisible toner contains a fluorescent substance which glows when irradiated by ultraviolet light.

4. The image forming apparatus according to claim 1, wherein the invisible toner contains an infrared light absorbing agent which absorbs infrared light.

5. The image forming apparatus according to claim 1, wherein the specific color is red which can reproduce color of a vermillion inkpad by itself.

6. An image forming apparatus in which four developing units can be provided, comprising:

a full-color image processor configured to create, based on image data of a document image, print data for respective visible toners of black, yellow, cyan, and magenta;

a first image processor configured to separate the image data of the document image into chromatic color data and achromatic color data, configured to create, based on the chromatic color data, print data for a visible toner of a specific color which is a chromatic color and further configured to create, based on the achromatic color data, print data for the visible toner of black with use of functions of the full-color image processor;

a second image processor configured to create, based on image data of an additional information image, print data for an invisible toner which can hardly be observed under visible light;

a data creator configured to create print data for a gloss adding toner which print data is for forming a toner image of the gloss adding toner on an entire surface of a recording sheet; and an image forming section that forms an image on the recording sheet with use of toners, the image forming apparatus being switched between (i) a full-color mode in which developing units that contain visible toners of black, yellow, magenta, and cyan, respectively are mounted, and the image forming section forms toner images according to the image data of the document image with use of the print data for the visible toners which print data are created in the full-color image processor, and forms a full-color image on a recording sheet from the toner images thus formed, and (ii) a transparent color mode in which a developing unit that contains the visible toner of black, a developing unit that contains the invisible toner, a developing unit that contains the visible toner of the specific color which is the chromatic color, and a developing unit that contains the gloss adding toner for adding gloss to the image are mounted, and the image forming section forms toner images according to the image data of the document image with use of the print data for the visible toners which print data are created in the first image processor, forms a toner image according to the image data of the additional information with use of the print data for the invisible toner which print data is created in the second image processor, forms an image on a recording sheet from the toner images thus formed, and forms a toner image according to the print data for the loss adding toner with use of the print data for the loss adding toner which print data is created in the data creator, in the transparent color mode, the developing units being disposed so that the toner image that is formed with the use of the gloss adding toner is located at a top layer after transfer onto the recording sheet is completed.

7. The image forming apparatus according to claim 6, further comprising:

a first detecting section that detects installation of the developing unit that contains the invisible toner; and mode controller configured to switch a mode of the image forming apparatus to the transparent color mode when the first detecting section detects the installation of the developing unit that contains the invisible toner.

8. The image forming apparatus according to claim 6, wherein the invisible toner contains a fluorescent substance which glows when irradiated by ultraviolet light.

9. The image forming apparatus according to claim 6, wherein the invisible toner contains an infrared light absorbing agent which absorbs infrared light.

10. The image forming apparatus according to claim 6, wherein the visible toner of the specific color is a visible toner of red which can reproduce color of a vermillion inkpad by itself.

11. A non-transitory computer-readable storage medium having computer-executable instructions embodied thereon, which, when executed by a processor, perform functions of an image forming apparatus in which four developing units can be provided; the image forming apparatus having a developing unit that contains an invisible toner which can hardly be observed under visible light; a developing unit that contains a visible toner of black; a developing unit that contains a visible toner of a specific color which is a chromatic color; a developing unit that contains a gloss adding toner for adding gloss to an image; and an image forming section that forms toner images according to the image data of the document image with use of print data for the visible toners, forms a toner image according to the image data of the additional information image with use of print data for the invisible toner, forms an image on the recording sheet from the toner images thus formed, and forms a toner image according to print data for the gloss adding toner with use of the print data for the gloss adding toner, comprising:

creating the print data for the visible toner of black and the print data for the visible toner of the specific color for creating based on image data of a document image, the print data for respective visible toners of black, yellow, magenta, and cyan;

creating the print data for the invisible toner on basis of image data of an additional information image; and creating the print data for the gloss adding toner which print data is for forming a toner image of the gloss adding toner on an entire surface of a recording sheet such that the toner image that is formed with use of the gloss adding toner is located at a top layer after transfer onto the recording sheet is completed.

12. A non-transitory computer-readable storage medium having computer-executable instructions embodied thereon, which, when executed by a processor, perform functions of an image forming apparatus in which four developing units can be provided, the image forming apparatus having a developing unit that contains a visible toner of black, a developing unit that contains an invisible toner, a developing unit that contains a visible toner of a specific color which is the chromatic color, and a developing unit that contains a gloss adding toner for adding gloss to an image; and an image forming section that forms an image on a recording sheet with use of toners, comprising:

creating, based on image data of a document image, print data for respective visible toners of black, yellow, cyan, and magenta;

separating the image data of the document image into chromatic color data and achromatic color data, and creating, based on the chromatic color data, print data for the visible toner of the specific color which is the chromatic color and creating, based on the achromatic color data, print data for the visible toner of black;

creating, based on image data of an additional information image, print data for the invisible toner which can hardly be observed under visible light;

creating print data for the gloss adding toner which print data is for forming a toner image of the gloss adding toner on an entire surface of the recording sheet such that the toner image that is formed with use of the gloss adding toner is located at a top layer after transfer onto the recording sheet is completed; and switching the image forming apparatus between (i) a full-color mode in which the image forming section forms toner images according to the image data of the document image with use of the print data for the visible toners, and forms a full-color image on the recording sheet from the toner images thus formed, and (ii) a transparent color mode in which the image forming section forms toner images according to the image data of the document image with use of the print data for the visible toners, forms a toner image according to the image data of the additional information image with use of the print data for the invisible toner, forms an image on the recording sheet from the toner images thus formed, and forms a toner image according to the print data for the gloss adding toner with use of the print data for the gloss adding toner.

* * * * *